US008418267B2

(12) United States Patent
Shaw et al.

(10) Patent No.: US 8,418,267 B2
(45) Date of Patent: Apr. 16, 2013

(54) PROMOTIONAL POCKET COVER AND METHOD OF CONSTRUCTING AND DISPLAYING

(76) Inventors: Tracy Lee Shaw, Tacoma, WA (US); Audrey Jean Alande, Tacoma, WA (US)

( * ) Notice: Subject to any disclaimer, the term of this patent is extended or adjusted under 35 U.S.C. 154(b) by 57 days.

(21) Appl. No.: 13/134,526

(22) Filed: Jun. 8, 2011

(65) Prior Publication Data

US 2011/0307420 A1 Dec. 15, 2011

Related U.S. Application Data

(60) Provisional application No. 61/354,780, filed on Jun. 15, 2010.

(51) Int. Cl.
*A41D 27/20* (2006.01)
*A41D 27/17* (2006.01)

(52) U.S. Cl.
USPC ..... 2/247; 2/46; 40/586

(58) Field of Classification Search ..... 40/586, 40/654.01; 2/46, 247–252, 279
See application file for complete search history.

(56) References Cited

U.S. PATENT DOCUMENTS 683,029 A * 9/1901 Estes ..... 2/251
1,222,735 A * 4/1917 Coleman ..... 2/251
1,821,809 A * 9/1931 Johnson ..... 2/254
2,606,587 A * 8/1952 Porter ..... 383/68
2,697,838 A * 12/1954 Bove et al. ..... 2/279
3,280,488 A * 10/1966 Rubin ..... 40/1.5
3,492,677 A * 2/1970 Bertelink ..... 2/279
3,647,056 A * 3/1972 Jacobson et al. ..... 206/5
4,667,347 A * 5/1987 Greer ..... 2/247
5,231,702 A * 8/1993 Masters ..... 2/244
5,737,775 A * 4/1998 Schwartz ..... 2/247
6,189,153 B1 * 2/2001 Diamond ..... 2/247
2011/0056001 A1 3/2011 Missett

OTHER PUBLICATIONS

U.S. Appl. No. 61/354,780, filed Jun. 15, 2011, Provisional Patent Application of Applicant Tracy L. Shaw, Decorative Pocket Flaps and Method of Construction and Display.

* cited by examiner

*Primary Examiner* — Gloria Hale
(74) *Attorney, Agent, or Firm* — Elizabeth Reilly; Patent Pending, PLLC

(57) ABSTRACT

A removably attachable promotional pocket cover comprises a single body unit generally in the shape of an arrow including a cover module and an insert module seamlessly connected thereto; the insert module generally rectangular in shape and cover module generally triangular in shape. The arrow shaped pocket cover is formed of three panel layers of material including a top panel layer and a back panel layer of wearer selected materials, and a supportive middle layer sandwiched therebetween. The cover module includes a surface area to affix promotional adornments thereon. A promotional pocket cover, method of construction and use are disclosed.

25 Claims, 47 Drawing Sheets

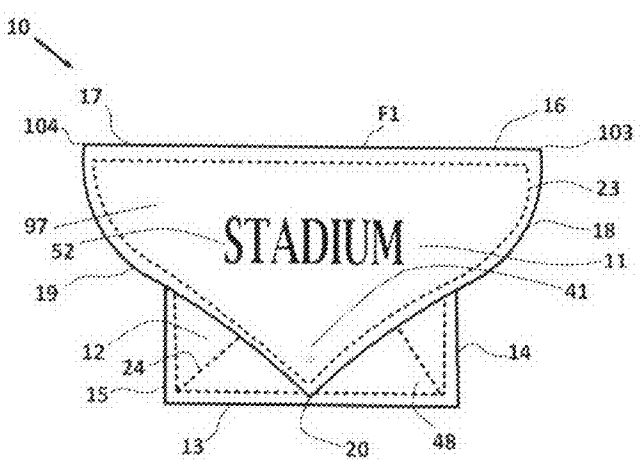
FIG. 8A
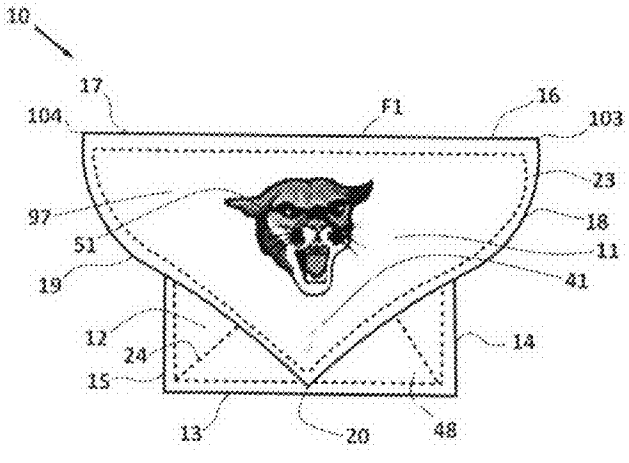
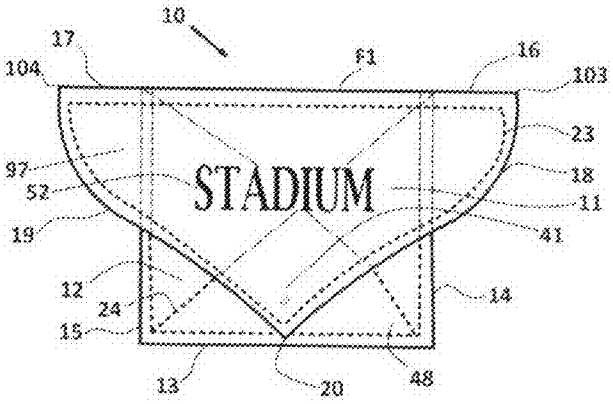
FIG. 8B
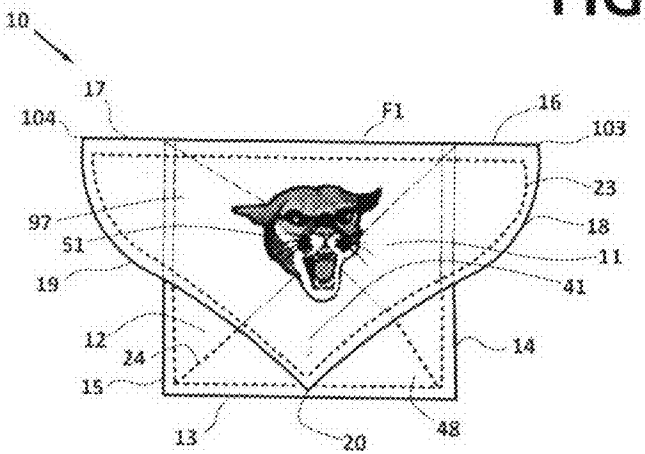

FIG. 33

Chart 1. Modified Patterns Useful in the Construction of Promotional Pocket Flaps 10

Including Various Sizes: Toddler 74; Pre – Kindergarten 75; Small 76; Medium 77; Large 78

| Figure | Longitudinal straight edge 64 | Length of lateral side straight edges 65 and 66 of insert element | Width of longitudinal straight edges 67 and 68 of flap element 62 | Length from longitudinal straight edge to vertex line a | Widest width of flap element line b |
|---|---|---|---|---|---|
| FIG. 28 Toddler Pattern 74 | 7.50 cm | 8.50 cm | 2.00 cm | 15.00 cm | 11.50 cm |
| FIG. 29 Pre – K Pattern 75 | 10.50 cm | 9.00 cm | 2.00 cm | 17.00 cm | 14.50 cm |
| FIG. 30 Small Pattern 76 | 11.70 cm | 9.50 cm | 2.00 cm | 18.20 cm | 15.70 cm |
| FIG. 31 Medium Pattern 77 | 12.00 cm | 9.50 cm | 2.00 cm | 19.50 cm | 16.00 cm |
| FIG. 32 Large Pattern 78 | 14.50 cm | 11.00 cm | 2.00 cm | 22.00 | 18.50 cm |

PROMOTIONAL POCKET COVER AND METHOD OF CONSTRUCTING AND DISPLAYING

FIELD OF THE INVENTION

The present invention generally relates to wearer selectable removably attachable promotional pocket covers which are inserted into a pocket cavity of a garment or apparel for the display of specific logos, or marks, or indicia, or inspirational slogans, or motivational slogans, or ribbons, or buttons, or mascot images, or team logos, or team colors, or images, or names, or symbols, or letters, or initials, or monograms, or monikers, or coat-of arms, or family crest, or dates, or embroidery, or embellishments, or decorations, or promotional images or messages, or special timely messages, or embellishments, or enhancements, or other promotional adornments which are identifiable with a specific cause, or charitable organization, or non-profit organization, or for-profit organization, or sports team, or sports league, or amateur sports team, or sports affiliation, or NASCAR®, or medical needs group, or commercial entity, or a special needs group, or foundation, or military organization, or commercial entity, or product, or public figure, or personal figure, or a media event, or publicity event, or public event, or personal event, special event, or personal loss, or animal, or holiday, or college, or university, or high school, or an automobile racing series, or an automobile racing team, or church, or club, or company, or department, or political party, or candidate, or issue, or interest group or cause, or t.v. show, or movie, or movie characters, or super-hero, or animated character, and the like, to raise recognition, awareness, support, loyalty, passion, spirit, or dedication, for that specific cause, team, special interest, charitable organization, non-profit organization, or for-profit organization, and/or the like, as mentioned above.

In addition, the present invention relates to a method of construction and pattern for a promotional pocket cover; and method of displaying the promotional pocket cover to be used with a preexisting garment pocket.

In addition, the present invention relates to using a promotional pocket cover as a method for raising money for charitable causes and other non-profit organizations, or for-profit organizations, or sports booster programs, or special timely causes, or any specific cause. A means and method by which money may be raised for any specific charitable cause or non-profit organization, or for-profit organization, or campaign or sports program, or music program, or any specific cause, by the sale of promotional pocket covers which are affixed with the specific logo, or mark, or indicium, or inspirational or motivational slogan, or ribbon, or button, or mascot, or team logo, or team colors, or image, or names, or initials, or monogram, or moniker, or coat-of-arms, or family crest, or symbol, or letters, or embroidery, or other decorations, or promotional images or messages, or special timely messages, or any promotional adornment, with which the specific charitable cause or non-profit organization, or for-profit organization, or sports team, or music program, or any specific cause, is readily identified, is provided hereby.

BACKGROUND OF THE INVENTION

Promotional materials with specific logos, marks, indicia, or inspirational or motivational slogans, ribbons, buttons, mascots, team logos, team colors, images, names, letters, numbers, symbols, embroidery, or other decorations, or promotional images or messages, or special timely messages, or embellishments, or enhancements, or any promotional adornment, are widely used by organizations or entities to promote pride and team spirit for causes of all types. Examples of such organizations and entities include charitable organizations, or non-profit organizations, or for-profits, or sports teams, or sports leagues, or amateur sports teams, or sports affiliations, NASCAR®, international sports teams, or medical needs groups, cancer groups, autism groups, Alzheimer's groups, heart association groups, clubs, or a special needs group, or military organizations, or commercial entities, or public figures, or personal figures, or media events, or public events, or personal events, animals, holidays, colleges, universities, high schools, automobile racing series, and automobile racing teams, churches, clubs, companies, law enforcement departments, political parties, candidates and issues, interest groups and causes, publicity events, or any specific cause. There are many companies that specialize in producing products that are used by these organizations for promotional purposes or for fundraising purposes or for charitable purposes, or for advertising.

Sports fans, or individuals closely affiliated with charitable organizations or non-profit organizations, or sports teams, or for-profit organizations, or other special causes, often wear garments or apparel, or carry articles, or use articles, displaying indicia associated with their favorite sports teams, charities, or non-profit organizations, or for-profit organizations, holidays, colleges, high school, or other specific causes. These garments or apparel are commonly athletic jerseys, T-shirts, shorts, bags, hats, mugs, glasses, plates, food containers, bumper stickers, window stickers, buttons, pens, pencils, clocks, coasters, wrist bands, and many more, which commonly indicate an association with the sports team, or charity, or non-profit organization, or for-profit organization, or special cause, by displaying colors, numbers, ribbons, symbols, names, initials, individual sports players and sports numbers, font types, mascots, team symbols, ribbons symbolic of a cause, promotional images or messages, inspirational or motivational messages, letters, names, dates, images, embellishments, or enhancement, or any promotional adornment showing an affiliation with a particular sports team or charity, or non-profit organization, or business, or any specific cause. Additionally, sports fans wear athletic garments with the name and player number of a particular sports fan. Furthermore, an individual may wear a T-shirt with the color and ribbon associated with a particular charity. Promotional departments, marketing organizations, and charitable organizations, non-profit organizations, and for-profit organizations, and educational institutions, sports teams, theme parks, amusement parks, movie makers, and others responsible for spirit advertising, and charitable fundraising, and promotion are always looking for new media on which to display their message.

An individual may have more than one favorite sports player, or more than one favorite charity, or special cause. However, popular promotional garments typically do not include the sports affiliation or charity, or sports number, and the like, of more than one player, or color, or charity, on a single garment or single apparel, and in addition, popular garments imprinted with a logo, indicia, slogan, message, or promotional adornment typically do not include pockets of garments, particularly jean pants.

In addition, this invention relates to a pattern and method for constructing removably attachable promotional pocket covers for garments, particularly jean pants, or apparel and a method of displaying a promotional pocket cover on a garment or apparel.

In addition, this invention relates to a method for raising money for charitable causes and other non-profit organizations, or sports booster programs, or school music program, or arts program, or cancer groups, or autistic awareness groups, or heart association groups, or any other special interest groups, or publicity event, or any other fund raiser group, and/or any specific cause. A means and method by which money may be raised for any specific charitable cause or non-profit organization, or sports booster program, or any special cause, by the sale of the promotional pocket covers which display indicia, logos, or inspirational or motivational slogan, letters, initials, names, images, symbols, ribbons, buttons, embellishments, decorations, or promotional images, or any promotional adornments, affixed thereon, with which the specific charitable cause or non-profit organization or sports team booster, and the like, is readily identified, is provided hereby.

Prior art U.S. Patent 2011/0056001 comprises a device for engagement with a pocket panel on an article of clothing which comprises a base member formed with substantially straight edge; a cover member formed with a substantially straight edge, wherein the edge of the cover member is joined with the edge of the base member to establish a hinge line at the juncture for rotation of the cover member to selectively create a potential space therebetween for receiving at least a portion of the pocket panel; and a means mounted on the device for engaging the device with the pocket panel to hold the pocket panel between the base member and the cover member; the base member is cardboard; and a means for engaging the device to a pocket panel are magnets. In U.S. Patent 2011/0056001 the engaging means is very unstable and more particularly the magnets can get dislodged easily. Moreover, the magnets will interfere with credit card magnetic strips, and hotel card magnetic strips. In addition, the magnets may present a risk if the magnets are swallowed by children. The base member can include cardboard which will wear easily and therefore will result in diminishing the longevity and usefulness of the pocket cover. More particularly, the base member comprising cardboard creates a pocket cover which would reasonably structurally collapse when washed.

SUMMARY

A removably attachable promotional pocket cover (hereinafter, promotional pocket cover(s)) is disclosed and claimed that is removably attachable to a pocket of a pre-existing garment, preferably jeans, or pocket of apparel, which functionally provides a promotional pocket cover whereupon a specific logo, or mark, or indicium, or image, trademark, tradename, or inspirational or motivational slogan, or ribbon, or button, or mascot, or team logo, or team colors, or image, or names, or letters, or initials, monograms, monikers, coat-of-arms, family crest, or symbols, or dates, or embroidery, or decorations, or promotional images, or inspirational messages, or special timely messages, or embellishments, or other adornments, or promotional adornments, (hereinafter, promotional adornments) can be affixed and displayed which are identifiable with a specific cause, or charitable organization, or non-profit organization, or for-profit organization, or sports team, or sports league, or amateur sports team, or sports affiliation, or NASCAR ®, or medical needs group, or commercial entity, or a special needs group, or foundation, or military organization, or commercial entity, or product, or public figure, or publicity event, or personal figure, or a media event, or public event, or personal event, or special event, or personal loss, or animal, or holiday, or college, or university, or high school, or automobile racing series, or automobile racing team, or church, or club, or company, or department, or political party, or candidate, or issue, or interest group, or cause, or t.v. show, or movie, or movie character, or super-hero, or animated character, or theme park character (hereinafter, "specific cause") to raise recognition, awareness, support, loyalty, passion, spirit, and dedication, esprit de corps and/ or funds, to the specific cause. The present invention in another embodiment is described and claimed comprising a pair of promotional pocket covers, which are transposable and complementary to each other. In addition, the promotional pocket cover can be reversible.

The promotional pocket cover comprises a single body unit generally in the shape of an arrow including an insert module and a cover module; wherein the promotional pocket cover having a longitudinal axis and a lateral axis. The insert module, generally in the shape of a rectangle, includes a longitudinal horizontal lower linear edge joined by two opposing vertical parallel linear side edges of a predetermined length; wherein the two vertical side edges delineating at predetermined length in opposing directions of a predetermined width form exterior opposing right angles forming two opposing horizontal longitudinal basal linear edges of the cover module parallel to the longitudinal horizontal lower linear edge; the cover module, generally in the shape of a triangle, includes two opposing curvilinear side edges meeting at an at an obtuse angle forming an upper apex.

The single body unit of the promotional pocket cover includes two modules: an insert module, and a cover module. The generally rectangular unit of the promotional pocket cover is configured to form the insert module; and the triangular unit of the promotional pocket cover is configured to form the cover module. Further, the promotional pocket cover includes three panels of material; a top panel, a back panel, and a middle panel sandwiched therebetween. The top panel is a wearer-selectable material which will become the top side of the promotional pocket cover, and the bottom panel is manufactured from a wearer-selectable material which will become the back side of the promotional pocket cover; and the middle panel is comprised of a stiffening panel, preferably pellon, to retain the form of the promotional pocket cover when folded and while the promotional pocket cover is being used.

As noted, the cover module is seamlessly continuously joined with the insert module to form a single body unit generally in the shape of an arrow of the promotional pocket cover. The insert module being generally rectangular in shape includes predetermined dimensions amenable to insertion into a pouch or cavity (hereinafter, "cavity") of a pocket of a garment or apparel, preferably a pocket of jean pants, such that the insert module is hidden within the pocket cavity when inserted therein; and the cover module being generally triangular in shape (but not limited to), having an obtuse angle at the apex, and having two opposing curvilinear sides (but not limited to) is of predetermined dimensions to cover a portion of the face of the jean pocket when folded thereupon. In use, the insert module provides a mounting means to pivotally maneuver and insert the insert module of the promotional pocket cover into the jean pocket where the insert module is concealed therein. The cover module is folded at the fold line along the top edge of the jean pocket. Thereby, the cover module provides a surface area for displaying means to position and affix thereon, a specific promotional adornment, which is readily identified with a specific cause of the wearer. The promotional adornment is displayed when the cover module is folded over the top edge of the jean pocket. Upon installation and use, initially the promotional pocket cover is maneuvered vertically proximate to the selected jean pocket; positioning the apex of the cover module to point down allowing the cover module to cover a portion of the face of the jean pocket; and allowing the insert module to extend vertically up from the cover module. Thereafter, the promotional pocket cover is removably attached to the face of the jean pocket by means of a fastening means, preferably a tack pin having a pin fastener element and a corresponding butterfly clutch element. The tack pin is releasably attached to the cover module by piercing the pin element throughin the cover module travelling throughin the face panel of the jean pocket; and the butterfly clutch is held and positioned on the inside of the garment pocket, facing the reverse side of the face of the garment pocket, free to receive the pin element of the tack pin. The pin element is engaged with the butterfly clutch and the cover module is removable attached to the face of the jean pocket. In use, the cover module of the promotional pocket cover is removably attached to the face of the garment pocket whereby the pin element of the tack pin punctures the top surface of the cover module and extends through the three layers therein, to the obverse side of the back side of the cover module; thereafter the pin element punctures the top surface of the face of the garment pocket and extends throughin to the reverse side of the garment pocket where the pin element is firmly retained by the butterfly clutch when inserted therein.

Thereafter, the insert module is folded 180° back upon the cover module, and contemporaneously the insert module is inserted into the cavity of the jean pocket. The insert module provides an anchoring means to support the cover module; and more particularly provides a protective layer between the butterfly clutch and the inner surface of the part of the jean pocket that would otherwise be directly in contact with the butterfly clutch. This configuration protects against extra wear on the jean material and protects the wearer. The tack pin retains desired alignment of the promotional pocket covers when installed upon the jean pocket. With such a configuration, in use, and when the wearer is sporting his/her jeans, almost zero relative movement can occur between the promotional pocket cover and the jean pocket. In addition, the tack pin can be wearer-selectable, preferably affixed with the inventor's logo, or can be selected from a variety of colors, designs, and logos, or image, trademark, tradename, and therefore provides a decorative embellishment to the promotional pocket cover. The pocket cover can be removably attached to the preexisting garment pocket by other fastening means including any one of hook and loop fastener components, snaps, hook and eyes.

The promotional pocket cover can be used on rear pockets or front pockets of jeans, but not exclusive thereto. The promotional pocket cover may be manufactured from material, including any one of natural or synthetic fabric materials, cotton, denim, colored denim, dungaree, polyester, linen, leather, corduroy, vinyl, flannel, seersucker, spandex, stine, silk, satin, velvet, felt, velveteen, faux fur, wool or wool blends, rayon, viscose, nylon, banton ,cashmere, or combinations thereof capable of retaining promotional adornments which includes any type of printed matter of any one of logos, images, trademarks, tradenames or decorative embellishment including any one of colors, ink, paint, puff paint, sequins, leather, jewelry, precious metals, studs, embroidery, ribbons or buttons or combinations thereof and material having sufficient flexibility allowing the material to be folded. Preferably, the material has sufficient resiliency to retain a variety of promotional adornments and to allow the material to be heat pressed.

Thus, a promotional pocket cover is utilized as an article of manufacture as a means for prominently displaying a variety of specific logos, or marks, or indicia, or image, trademark, tradename, or inspirational or motivational slogans, or ribbons, or buttons, or mascots, or team logos, or team colors, or images, or names, or letters, or initials, monograms, monikers, family crest, coat-of-arms, or dates, or symbols, or embroidery, or decorations, or promotional images, or inspirational messages, or special timely messages, or embellishments, or enhancements, or any promotional adornments, identifiable or associated with specific charitable organizations, or non-profit organizations, or sports teams, or sports leagues, or any specific cause which is removably attached to a pre-existing jean pocket. The promotional pocket cover is interchangeable and transferable among pockets of other preexisting jeans, or interchangeable among pockets of the same pair of preexisting jeans, but does not comprise the garment, and therefore, maintains the original integrity of the garment, or jeans, and thereby overcomes the burden of acquiring a variety or multiple number of pairs of jeans, which display a logo, or trademark, tradename, or decoration, or image, or colors, or other indicia, or promotional adornment, readily recognizable of an individual's specific charitable organization, or non-profit organization, or for-profit organization, or sports team, or sports league, or amateur sports team, or sports affiliation, NASCAR®, international sports team, or medical needs group, or cancer group, or autism group, or any specific cause.

In addition, according to the preferred construction of the promotional pocket cover, a pattern, template or pattern (hereinafter, "pattern") generally in the shape of an arrow is used to construct the three panels of material comprising the single body unit forming the promotional pocket cover. Various modifications of the arrow shape are envisioned, described and claimed hereby.

In addition, stitches are added along the marginal edges of the wearer-selectable promotional pocket cover to provide further reinforcement to the promotional pocket cover. More particularly, the stitched marginal edges can be sewn with a wearer-selected thread from a variety of colors, textures, including indicia identifiable with sports teams, or charitable organizations, non-profit, or for-profit, or any specific cause, and provide an additional promotional enhancement to the promotional pocket cover.

This invention relates to removably attachable promotional pocket covers and more particularly to a novel and improved removably attachable promotional pocket cover which comprises a single body unit, including two modules therein; an insert module and a cover module. The cover module can be removably attached to the face panel of a garment pocket or jean pocket; cover module is folded over the garment pocket or jean pocket edge and the insert module can be removably inserted in a pouch or cavity of a garment pocket or jean pocket. This configuration orients the cover module in the correct direction to enable the display of promotional adornments which have been affixed upon the cover module, wherein the promotional adornment includes any type of printed matter of any one of logos, images, trademarks, tradenames, or decorative embellishments including any one of colors, ink, paint, puff paint, sequins, leather, jewelry, precious metals, suds, embroidery, ribbons or buttons or combinations thereof, such as indicium, logos, embellishments or inspirational or motivational slogan, ribbon, button, mascot, team logo, team colors, image, names, symbols, embroidery, or other decorations, or promotional images or messages, or special timely messages, or any promotional adornments, as noted above, which are identifiable to a least one particular cause, charitable organization, or non-profit organization, or for-profit organization, or sports team, or sports league, or amateur sports team, or sports affiliation, NASCAR ®, or medical needs group, or commercial entity, or a special needs group, or military organization, or public figure, or personal figure, or a media event, or publicity event, or public event, or personal event, or animal, or holiday, or college, or university, or high school, or automobile racing series, or automobile racing team, or church, or club, or company, or department, or political party, or candidate, or issues, or interest group, or any specific cause, as mentioned above.

Up to now, the only markings on garment pockets are generally stitching, buttons, grommets, studs, designer names, initials of designers, or indicia of a specific designer, or labels or imprints identifying the manufacturer or distributer of the garment. No one has previously conceived of the idea of using garment pockets or garment flaps for displaying a removably attachable promotional pocket cover wherein is affixed a logo, mark, indicium, embellishments, or inspirational or motivational slogan, ribbon, button, mascot, team logo, team colors, image, names, symbols, embroidery, or decorations, or embellishments or promotional images or messages, or special timely messages, or promotional adornments, which are associated and identified with a specific cause, charitable organization, or non-profit organization, or sports team, or any specific cause.

No one has previously conceived of the idea of using removably attachable promotional pocket covers with pre-existing jean pockets, as a means for displaying logos, marks, or any promotional adornments that are unrelated to the intended use of the garment pocket as a receptacle for containing articles, items, objects, keys, money, cosmetics, food, receipts, etc. and any item or article, that may fit. Therefore, an object of the present invention, is to provide an article of manufacture to support and display logos, marks, indicium, or any promotional adornments, as stated above, and to provide such a promotional use to a pre-existing jean pocket, or any pocket of a garment, or pocket of apparel, and/or any pocket or slit, and thereby to provide a new platform for promotion.

Another object of the present invention is to provide a novel and useful method of construction and display of the promotional pocket covers incorporating the invention.

Another object of the present invention is to provide a novel and useful method of fundraising for a charitable cause, non-profit organization, sports booster program, or any specific cause, which obviates or mitigates the disadvantages of the prior art, and which is directed in an opposed direction so as to be the antithesis of the prior art.

An important benefit of the present invention is to provide the wearer a selection of a plurality of choices of promotional pocket covers affixed with promotional adornments associated with a specific sport team, or charitable cause, or non-profit organization, or for-profit organization, or any specific cause, to be removably attached with a pre-existing garment or pre-existing pair of jeans, and easily interchangeable and transferred among the pockets of the same garment or any other garment; or easily interchangeable among the pockets of the same pair of jeans or any other pairs of jeans, but does not comprise the garment, or the jeans, or the promotional pocket cover, therefore, maintaining the original integrity of the garment or jeans and overcoming the burden of acquiring a plurality of varied garments or jeans which display a plurality of different logos, or team colors, or colored ribbons, or decorations, or any other promotional adornments of an individual's favorite sports team or charitable organizations, or any specific cause.

Accordingly, another advantage of the present invention is to enable an infinite variety of promotional pocket covers to be used in connection with any given pair of jeans with pockets or any garment with pockets. For example, a ribbon associated with a special cause, or rhinestones, or a monogrammed design with one's initials, or initials of a loved one, or a favorite sports athlete, or favorite charity, using a print transfer medium, such as heat transfer or silk-screen, or by using puff paint, may be affixed to the obverse side of the display cover of the promotional pocket cover in the present invention. Slight variations in design of any nature and any configuration and origin can be used on the promotional pocket cover according to the embodiment of the invention, such that the promotional pocket cover inserted into a jean pocket and the designs affixed to those promotional pocket covers, can be varied by need or desire. In addition, the sewn marginal border around the edges of the promotional pocket cover, according to the present invention, can be varied with wide stitches, broken line stitches, zigzag stitches, and the like. More particularly, the sewn marginal border around the edges of the promotional pocket cover, can be varied with colors, textures, and designs identifiable with a specific charity, or non-profit, or for-profit organization, or sports team, or any specific cause, and thereby, provide additional promotional enhancement to the promotional pocket cover.

It is another object of the present invention to provide a promotional pocket cover to be used as a means to display adornments that are not necessarily readily identifiable with a specific cause.

Another feature of the present invention is that the promotional pocket cover may be inserted into a garment pocket without fear of the promotional pocket cover falling out because the insert module of the promotional pocket cover provides an anchoring mechanism for the cover module; and a tack pin fastening means provides a fastening means which allows for removably attaching the promotional pocket cover to a preexisting garment pocket.

Another advantage of the present invention is that the promotional pocket cover, unlike the traditional sewn on flap affixed to a jean pocket, may be affixed with a vast array of indicia, logos, symbols, images, promotional images and messages, or promotional adornments, as mentioned above, or the promotional pocket cover can be constructed with materials, or fabrics, or cloths, etc. wherein a vast array of prints, artwork, embroidery, photography, and virtually any other design which is woven into the selected material or fabric that is identifiable with a specific cause, and thereby, the material in the construct of the promotional pocket cover, provides a promotional adornment. Accordingly, this present invention enables infinitely greater variability over a conventional, traditional sewn on flap on a jean pocket, by creating a multitude of very wearer selectable personalized looks from a single pre-existing pair of jeans. For example, a wearer can select promotional pocket cover affixed with a decoration, or fabric to use with jeans for a day style; and similarly the wearer can select promotional pocket covers affixed with a decoration, or fabric, for an evening style to use with the same pair of jeans or with a different pair of jeans. Unlike the conventional sewn on flap seen on a pair of jeans that does not already include a pocket with a flap, a wearer can select his or her own style having more visual appeal than the conventional jean pocket. A variety of wearer selected materials and designs of fabrics, materials, cloth, and the like, utilized in accordance of the present invention, can be of like materials and colors as, or in contrast to, the wearer's underlying outfit or wearer selected to identify a particular sports team, charitable organization, not-for profit organization, for-profit organization, or any specific cause.

In one embodiment of the present invention, at least one, or more promotional images or indicia, or promotional adornments can be displayed on one or more promotional pocket covers to be used to promote team pride or team spirit, as for example, for a professional sports team or for a school sports team. Such teams can include professional sports such as NASCAR®, football, baseball, basketball, soccer, golf, etc., high school, college, and university teams, community teams, and international teams. The promotional image might include team colors, names, mascots, logos, slogans, images of team members, numbers, letters, initials, or images, related to the sport, and special timely messages, (e.g., "STADIUM", or an image of a "Cougar"). For example, in a particular embodiment of the present invention the wearer may select one mascot and color for one promotional pocket cover to be inserted in and displayed on a right rear jean pocket and then select a school name and school color for a second promotional pocket cover to be inserted and displayed on the left rear jean pocket.

In another embodiment of the present invention, the wearer may display the promotional pocket covers promoting school spirit in the front right and left pant pockets.

Among other advantages, the promotional pocket cover allows a user to select a wearer-selectable promotional pocket cover for one pocket affixed with indicia, logo, message, or promotional adornment associated with one cause, charitable organization, or sports team, or any specific cause, as noted above, and to select a second, wearer-selectable promotional pocket cover affixed with indicia, logo, or promotional adornments, associated with a different cause, charitable organization, not-for-profit, or for-profit organization, or sports team, celebrity, or any specific cause for another pocket, and therefore, may be worn at the same time. The pair of promotional pocket covers is transposable or may complement each other. In addition, the promotional pocket covers may be configured to be reversible.

In another embodiment, the promotional image, name, message, indicia, or promotional adornment, displayed on the promotional pocket cover is used to promote a political candidate, campaign, party, or message. Any of the information that might be displayed on a lawn sign, poster, bumper sticker, or button, commercial, during a political campaign can also be so dimensioned and configured to be affixed upon the cover module of a promotional pocket cover according to the embodiment of the present invention.

In another embodiment, the promotional adornment affixed on the cover module of the promotional pocket cover is used to promote pride among members of an identified club or association. Examples of such clubs or associations include book clubs, school clubs, and groups (music groups, game clubs, theater groups, interscholastic academic teams, etc.) and community interest groups, motor cycle bike groups, and groups of all types.

In another embodiment, the promotional adornment affixed to the cover module of the promotional pocket cover is used to promote pride among an identified interest group. Examples of such interests include shared common heritage or ethnicity, shared religious affiliation, shared employer, or department, or hobby, and the like.

In another embodiment, the promotional adornment affixed to the cover module of the promotional pocket cover is used to advertise products and/or services or market a company. Such products and services might include, but are not limited to food, drinks, amusement parks, theme parks, restaurants, manufactured goods, professional services, movies, musical groups, vocal groups, theatrical entertainment, musical performances, and the like.

In another embodiment, the promotional adornment affixed to the cover module of the promotional pocket cover, logo, slogan, indicia, name, picture, lyrics, lines from a movie, etc. and the like, is used to support fan interest in celebrities, both real and fictional. Examples, of such celebrities include, but are not limited to sports heroes, movie stars, TV and radio stars, theme park characters, super heroes, internet stars, virtual characters, computer game characters, cartoon characters, war heroes, characters in books, movies, and TV shows, famous musicians, politicians, and public figures.

In another embodiment, the promotional adornment affixed to the cover module of the promotional pocket cover is used to show pride in one's family. Examples of adornments that could be displayed include, but are not limited to pictures of family members, pets, family crest, family indicia, names, dates, birthdays, anniversaries, graduations, birthdates, etc. and the like.

In another embodiment of the present invention, the promotional adornment affixed to the cover module of the promotional pocket cover, is used to celebrate a special day in the year, a special holiday, or seasonal event, or special event or day. Examples of special days are, but not limited to, Thanksgiving, Christmas, Chanukah, New Year's Day, Easter, Halloween, Valentines Day, St. Patrick's Day, Veteran's Day, Memorial Day, etc. Examples of images that could be displayed but not limited to, Christmas trees, Menorah, colored eggs, pumpkins, red hearts, four-leaf clovers, red poppies, etc. and the like.

In another embodiment of the present invention, the promotional adornment affixed to the cover module of the promotional pocket cover is used to show pride in ones' community, state, or country, or military organization, or military troops. A promotional pocket cover is configured with a material comprising camouflage pattern generally associated with the U.S. military troops, and generally considered appropriate to wear in support of the U.S. troops, or in support of a member of the family or friend who is serving and protecting the U.S. and its people. Examples of images that could be displayed include, but are not limited to flags, seals, local landmarks and symbols, emblems, coat of arms, crests, seals, local landmarks and symbols, indicia related to the community, state, or country.

In another embodiment, the promotional adornment affixed to the cover module of the promotional pocket cover is used to promote a personal message, of which the content and the format can be displayed, as long as it is in harmony with the spirit promulgated by the U.S. Constitution. Therefore, the configuration, content, and format of the promotional message or image, indicia, symbol, logo, slogan, picture, or any promotional adornment is limited only by the user's imagination. For example, a personal message or image may be, but not limited to, a picture of personal artwork, graphics, favorite pet, personal initials, personal business name, loss of a loved one, and/or the like.

Another object of the present invention is to provide a novel and useful method of fundraising for a charitable cause, non-profit organization, sports booster program, or campaign or any specific cause selected by the user. In accordance, with one aspect of the present invention, a method of raising money in any one campaign for single or multiple charitable causes or non-profit organizations, or sports booster programs, and the like, is taught, where the charitable cause or non-profit, or the sports team or amateur sports team, has a well-known logo, indicium, or inspirational or motivational slogan, or promotional image or message, by which it is readily identified. For example, for an autism fundraiser the puzzle ribbon is readily identifiable with the autism cause; or for a breast cancer fundraiser the pink ribbon is readily identifiable with the breast cancer cause. The ribbon or promotional adornment is affixed to the cover module of the promotional pocket cover, and each promotional pocket cover is then exchanged with a donor amount of money, or a pledge of money, or service. Then a predetermined percentage of the amount of the proceeds are presented to the charity, or non-profit organization, or for-profit organization, or booster for the sports team, or the specific cause; and a predetermined percentage of the amount of the proceeds are retained for the for-profit organization, or host, or sponsor, or organizer, or seller, or individual maker of the promotional pocket covers, or the manufacturer of the promotional pocket covers.

It is contemplated that the method of fundraising for a charitable cause, or a non-profit organization, or for-profit organization, or a sports team booster, or any specific cause, of the present invention, is particularly useful for providing the donor or contributor of money, with a tangible, useful, decorative, enjoyable, spirited, and long-lasting reminder from those who may not be able to speak for themselves, by way of a promotional pocket cover, of the commitment and support being given by that donor of the specific charitable cause or non-profit organization being supported, and which is readily identified by the specific indicium, logo, symbol, ribbon, color, pattern, design, name, picture, embellishment, charitable organization indicia, non-profit, promotional image or message, or promotional adornment affixed on the promotional pocket cover.

In another embodiment of the present invention, the obverse side of the display cover module may be displayed without the indicia and be comprised of a wearer-selectable color or fabric complementary to the back side of the display cover and therefore be reversible.

As mentioned, sports fans, or individuals closely affiliated with charitable organizations or non-profit organizations, or sports teams, or any special cause, often wear garments, or apparel, or carry articles, displaying logos, images, numbers, colors, letters, and other promotional adornments associated with their favorite sports teams, charities, or non-profit organizations, holidays, colleges, high school, or other special cause. These garments, or apparel, or articles are commonly athletic jerseys, T-shirts, shorts, bags, hats, mugs, glasses, plates, food containers, bumper stickers, window stickers, buttons, pens, pencils, clocks, coasters, wrist bands, and many more, which commonly indicate an association with the sports team, or charity, or non-profit organization, or special cause, by displaying the promotional adornment readily associated with that specific cause. Additionally, sports fans wear athletic garments with the name and player number of a particular sports fan. Furthermore, an individual may wear a T-shirt with the color and ribbon associated with a particular charity. None of these promotional garments, apparel, or articles is a promotional pocket cover as described and claimed by the present invention. Promotional departments, marketing organizations, and charitable organizations, non-profit organizations, and educational institutions, sports teams, theme parks, amusement parks, movie makers, and others responsible for spirit advertising, and charitable fundraising, and promotion are always looking for new media on which to display their message or promotional adornment and the promotional pocket cover meets this need.

An individual may have more than one favorite sports player, or more than one favorite charity, etc. However, a popular garment typically does not include the sports team, or charity, or specific cause, or sports name, or color, of more than one player, or sport team, or charity on a single garment or single apparel, and therefore the wearer must bear the expense of purchasing several tops, or t-shirts, or hats displaying their favorite teams or charities. In addition, popular garments imprinted with a logo, indicia, slogan, message, or promotional adornment, typically do not include jean pants.

The need is met by the present invention as described and claimed below. These and other objects of the present invention will be best understood when reference is made to the Brief Description of the Drawings and Detailed Description of the Invention which follows herein below.

BRIEF DESCRIPTION OF THE DRAWINGS

These and other features and advantages of the present invention will become more apparent to those skilled in the art when taken into consideration with the following detailed description and claims taken in conjunction with the accompanying drawings, wherein.

FIG. 5 B is a planar rear view of the promotional pocket cover as illustrated in FIG. 5 A, according to the preferred embodiment of the present invention, showing the insert module and a portion of the cover module. The short dashed lines indicate stitching.

FIG. 6 B is a rear planar view of the promotional pocket cover, according to the preferred embodiment of the present invention, as illustrated in FIG. 6 A, showing the insert module and a portion of the folded cover module in phantom long dashed lines for transparency and showing the butterfly clutch which is hidden by the insert module. The short dashed lines indicate stitching.

FIG. 7A shows a promotional pocket cover with the promotional adornment, an image of a cougar, affixed on the cover module. The short dashed lines indicate stitching.

FIG. 8 A is a front planar view of an exemplary embodiment of the present invention showing a pair of corresponding promotional pocket covers, as illustrated in FIGS. 7 A and 7 B in a folded state, with tack pins, one promotional pocket cover shows a "cougar" and the second folded promotional pocket cover shows the word "STADIUM" affixed on the cover module. The short dashed lines indicate stitching.

FIG. 8 B illustrates a front planar view of an exemplary embodiment of the present invention, showing a pair of promotional pocket covers, as illustrated in FIG. 8 A with long dashed lines for transparency. The short dashed lines indicate stitching.

FIG. 12B shows a promotional adornment of a yellow ribbon and the words "A true fighter, our hero" affixed to the cover module of the second promotional pocket cover. The short dashed lines indicate stitching.

FIG. 13 B shows a promotional adornment of the words "Pink Angel" affixed on the cover module of the second promotional pocket cover along with a pink ribbon with an image of a face and a halo. The short dashed lines indicate stitching.

FIG. 14 B shows the word "SLAINTE" affixed on the cover module of the second promotional pocket cover. The short dashed lines indicate stitching.

FIG. 15B shows promotional adornments of gold stars affixed on the cover module on one promotional pocket cover made with camouflage material. The short dashed lines indicate stitching.

FIG. 16B shows and a second promotional pocket cover with a red, white, and blue ribbon and the date 09.11.01 affixed on the cover module, and shown with names also affixed on the cover module of the second promotional pocket cover. The short dashed lines indicate stitching.

FIG. 25 (a')-(d')) is a schematic illustration of a method of installation of a promotional pocket cover, as illustrated in FIG. 23 B, on a left jean pocket, using hook and loop fastener components as an attachment means. The short dashed lines indicate stitching.

FIG. 33 is a chart defining the modifications of pattern illustrated in FIG. 27 and further illustrated in FIGS. 28-32.

DICTIONARY

Figure 1:
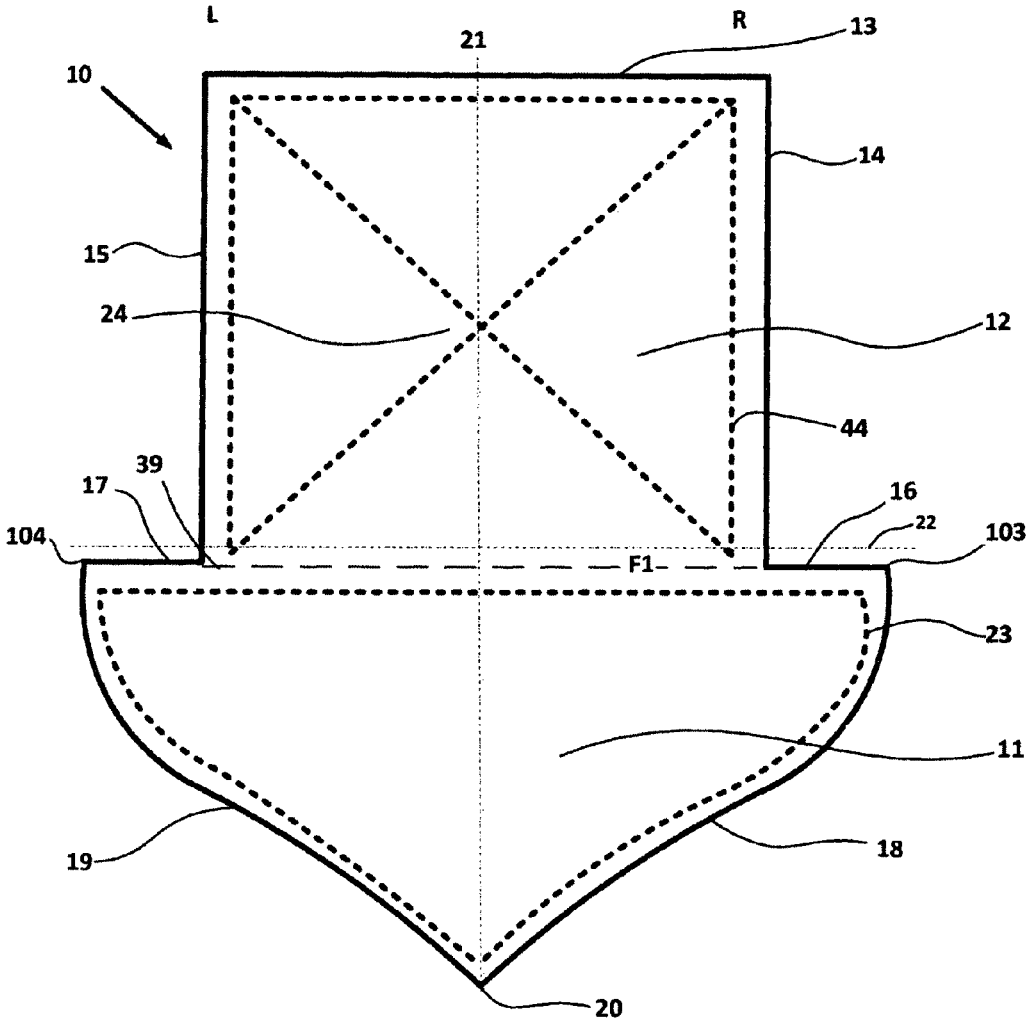
FIG. 1 is a top planar view of the promotional pocket cover, according to the preferred embodiment of the present invention, showing the arrow shaped single body unit including cover module and insert module. The short dashed lines indicate stitching along the marginal edges.

Adornment—includes any one of any type of printed matter of any one of logos, images, trademarks or tradenames or decorative embellishment including any one of colors, ink, paint, puff paint, sequins, leather, jewelry, precious metals, studs, embroidery, ribbons and buttons, decoration, embellishment, beautification, gilding, enhancement, garnish, marks, indicia, inspirational slogans, motivational slogans, marks, buttons, mascot images, team logos, team colors, names, symbols, letters, initials, monograms, monikers, insignia, coat-of-arms, family crest, dates, embroidery, embellishments, or decorations, or promotional images or messages, or special timely messages, or embellishments, or enhancements, picture, lyrics, lines from a movie, rhinestones, gold, silver, copper, platinum, grommets, feathers, pearls, jewels, stickers.

Apex—peak, tip, point where two angled lines meet; the highest vertex in a geometric triangle.

Affixed—securely attached, intended as permanent attachment.

Attaching means; Fastening means—the term refers to attaching means which are removably inserted to another of two corresponding members; to enable temporary attachment and detachment; not permanent attachment; can include a semi-permanent yet detachable means, such is any one of pivotally placed tack pin and butterfly clasp, hook and loop fastener component and corresponding component; buttons and button holes, or pivotally placed hook-and-loop fasteners.

Curvilinear—curved, wavy, shapely, rounded.

Dispose—the term disposed refers to an element being positioned in a particular place or position in a unitary structure with other elements, permanently.

Dorsal and Ventral—the terms refer respectively to the location of an element that is intended to be placed against or toward the body of a wearer/user when the promotional pocket cover is installed on a preexisting jean pocket, according to the preferred embodiment described in the present invention; and the location of an element that is intended to be placed away from the wearer or toward a viewer. Synonyms for "dorsal" and "ventral" are "interior" and "exterior"; and "inner" and "outer"; and "inside" and "outside".

Jeans—one jean pants, typically referred to as pair of jeans, jean, dungarees, denim pants, any garment pants or trousers having a pocket with a cavity.

Lateral—the term refers to a direction running from a longitudinal edge to an opposing longitudinal edge of the promotional pocket cover and generally at a right angle to the longitudinal edge and parallel to the longitudinal axis. Directions within 45 degrees of the lateral direction are considered to be "lateral." The lateral sides run longitudinally.

Lateral axis—passes through the widest points of the promotional pocket cover from the left lateral side to the right lateral side.

Longitudinal—the term refers to a direction running from a lateral side edge to an opposing lateral side edge of the promotional pocket cover and generally perpendicular to the lateral side and parallel to the lateral axis. Directions within 45 degrees of the longitudinal direction are considered to be "longitudinal." The longitudinal linear edge runs laterally.

Longitudinal axis—passes through the promotional pocket cover from longitudinal linear edge to apex.

Pattern—template, blank, form, design which is used to draw and cut out the panels necessary for the construction of the promotional pocket cover.

Phantom—phantom—(not shown) are long or alternately long- and short-dashed thin lines used to represent a feature or component that is not part of the specified part or assembly in the forefront; the feature or component may be hidden behind the specified part in the forefront, used for transparency and scale when viewing the drawing.

Proximal—the term refers respectively to the location of an element relatively near to the center of a structure.

Promotional adornments—includes any one of any type of printed matter of any one of logos, images, trademarks or tradenames or decorative embellishment including any one of colors, ink, paint, puff paint, sequins, leather, jewelry, precious metals, studs, embroidery, ribbons and buttons, marks, indicia, inspirational slogans, motivational slogans, marks, ribbons, buttons, mascot images, team logos, team colors, images, names, symbols, letters, initials, monikers, monograms, family crest, coat-of-arms, dates, embroidery, embellishments, precious metals, gold, silver, copper, platinum, or decorations, or promotional images or messages, or special timely messages, or embellishments, or enhancements, rivets, patches, stitching, ink, paint, sequins, feathers, jewelry, studs, picture, lyrics, lines from a movie, or other adornments including any one of colors, ink, paint, puff paint, sequins, leather, jewelry, precious metals, studs, embroidery, or buttons or combinations thereof.

Proximate—the term refers to the location of an element relatively nearby, or close to a structure.

Removably attached—the term refers to elements being connected and disconnected, or united and disunited, or by fastening and unfastening, or engaging and disengaging, by any method suitable for the elements being attached together temporarily and their constituent material by a fastening means, as needed or desired.

Removably installed—includes the ability to install and reinstall, or to attach and detach the promotional pocket cover temporarily, and at will, not permanent.

Specific cause—charitable organization, or non-profit organization, or for-profit organization, or sports team, or sports league, or amateur sports team, or sports affiliation, or NASCAR®, or medical needs group, or commercial entity, or a special needs group, or foundation, or military organization, or commercial entity, or product, or public figure, publicity event, or personal figure, or a media event, or public event, or publicity event, or personal event, or special event, or personal loss, or animal, or holiday, or college, or university, or high school, or automobile racing series, or automobile racing team, or church, or club, or company, or department, or political party, or candidate, or issues, or interest group, or t.v. show, or movie, or movie character, or super-hero, or animated character, or any specific cause.

Supine—disposed on a flat surface horizontally, flat, prone, prostrate.

Tack pin—similar to a lapel pin and attached by butterfly clutch. One of the most popular modern methods of attaching pins is the butterfly clutch, sometimes called a military clutch. The back of the pin has a small prong attached and when the butterfly clutch is squeezed and pulled up from the prong the pin is released from the clutch. Butterfly clutches may be made out of metal, plastic, or rubber.

Unit—component, portion, section, element, section of a single body unit.

Wearer—user of promotional pocket cover, human being wearing garment, jeans, dungarees, or pet user.

180°—straight line.

NUMERALS

10—Promotional pocket cover
11—Cover Module
12—Insert Module
13—Horizontal longitudinal lower linear edge
14—Right lateral linear side edge
15—Left lateral linear side edge
16—Right longitudinal basal linear edge of cover module
17—Left longitudinal basal linear edge of cover module
18—Right curvilinear side edge of cover module
19—Left curvilinear side edge of cover module
20—Apex
21—Longitudinal Axis
22—Lateral Axis
23—Marginal Stitches
24—Stitched "X"
25—Preexisting Jean(s) pant pocket
26—Jeans, jean or jean pants
27—Top edge of jean pocket
28—Top panel of promotional pocket cover
29—Middle panel promotional pocket cover, pellon panel
30—Back panel of promotional pocket cover
31—Cavity of jean pocket
32—Front right jean pocket
33—Front left jean pocket
34—Rear right jean pocket
35—Rear left jean pocket
36—Autism ribbon
37—Camouflage material
38—Face panel of jean pocket
39—long dashed line(s)
40—Promotional adornment(s)
41—Tack pin
42—Pin element
43—Butterfly clutch
44—Short dashed line(s)
45—Back side of cover module (which is also the obverse surface side of the back panel)
46—Wall of reverse side of face panel jean pocket
47—Front surface side of insert module (which is also the obverse surface side of the top panel); or dorsal side of insert module particularly when in use
48—Ventral side of insert module particularly when in use; or back side of insert module (which is also the obverse side of back panel).
49—Back wall of jean pocket congruent with wearer
50—Wearer's hand

51—Cougar promotional adornment
52—Stadium promotional adornment
53—pink ribbon promotional adornment
54—promotional adornment
55—Rhinestone adornment
56—Hook and loop fastener component
57—Button
58—Back side of button showing stitching
59—Red, white, and blue ribbon
60—Promotional pocket cover pattern
61—Obverse side of pattern
62—Cover unit of pattern
63—Insert unit of pattern
64—Horizontal longitudinal lower straight edge of pattern
65—Right vertical lateral side straight edge of pattern
66—Left vertical lateral side straight edge of pattern
67—Right horizontal longitudinal basal straight edge of pattern of cover unit
68—Left horizontal longitudinal basal straight edge of pattern of cover unit
69—Right side point of pattern
70—Left side point of pattern
71—Right curvilinear side edge of cover unit of pattern
72—Left curvilinear side edge of cover unit of pattern
73—Vertex of pattern
74—Toddler pattern
75—Pre-Kindergarten Pattern
76—Small pattern
77—Medium pattern
78—Large pattern
79—Key
80—Obverse side of top panel
81—Reverse side of top panel
82—Obverse side of back panel
83—Reverse side of back panel
84—Stitched hem
85—Top hem
86—Bottom hem
87—Longitudinal horizontal lower linear edge of top panel
88—Longitudinal horizontal lower linear edge of pellon panel
89—Longitudinal horizontal lower linear edge of back panel
90—Top panel generally rectangular section
91—Top panel generally triangular section
92—Pellon panel generally rectangular section
93—Pellon panel generally triangular section
94—Back panel generally rectangular section
95—Back panel generally triangular section
96—Line of articulation
97—Front side or obverse side of cover module (which is also the obverse surface side of the top panel)
98—Yellow heart
99—Yellow ribbon
100—Star
101—Princess
102—Coach
103—Right side point on promotional pocket cover
104—Left side point on promotional pocket cover
105—Zipper
106—Shamrock promotional adornment
F1=Fold line defined by phantom long dashed line
a—Phantom line measuring distance from longitudinal straight edge to vertex of pattern
b—Phantom line measuring width a distance through widest points of pattern

COPYRIGHT NOTICE

A portion of the disclosure of this patent contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyrights whatsoever.

TRADEMARK NOTICE

A portion of the disclosure of this patent document contains or may contain material which is subject to trademark protection. The trademark owner has no objection to the photocopy reproduction by anyone of the patent document or the patent disclosure in exactly the form it appears in the Patent and Trademark Office patent file or records, but otherwise reserves all trademarks whatsoever.

DETAILED DESCRIPTION

Figure 9:
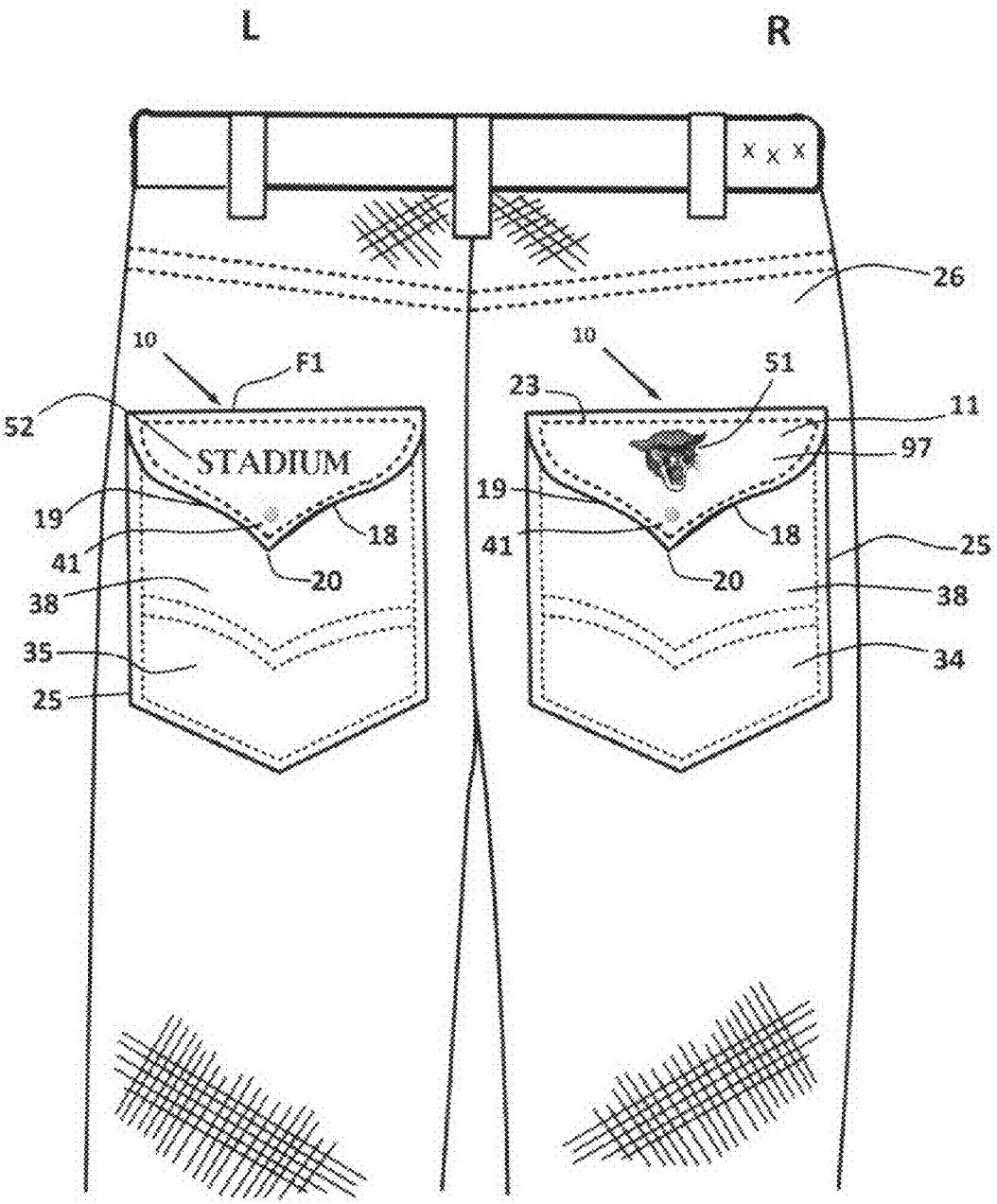
FIG. 9 illustrates a front planar view of an exemplary embodiment of the present invention showing pair of promotional pocket covers, as illustrated in FIGS. 7A and 7B inserted into each of two rear jean pockets worn by a user. The short dashed lines indicate stitching.
Figure 10:
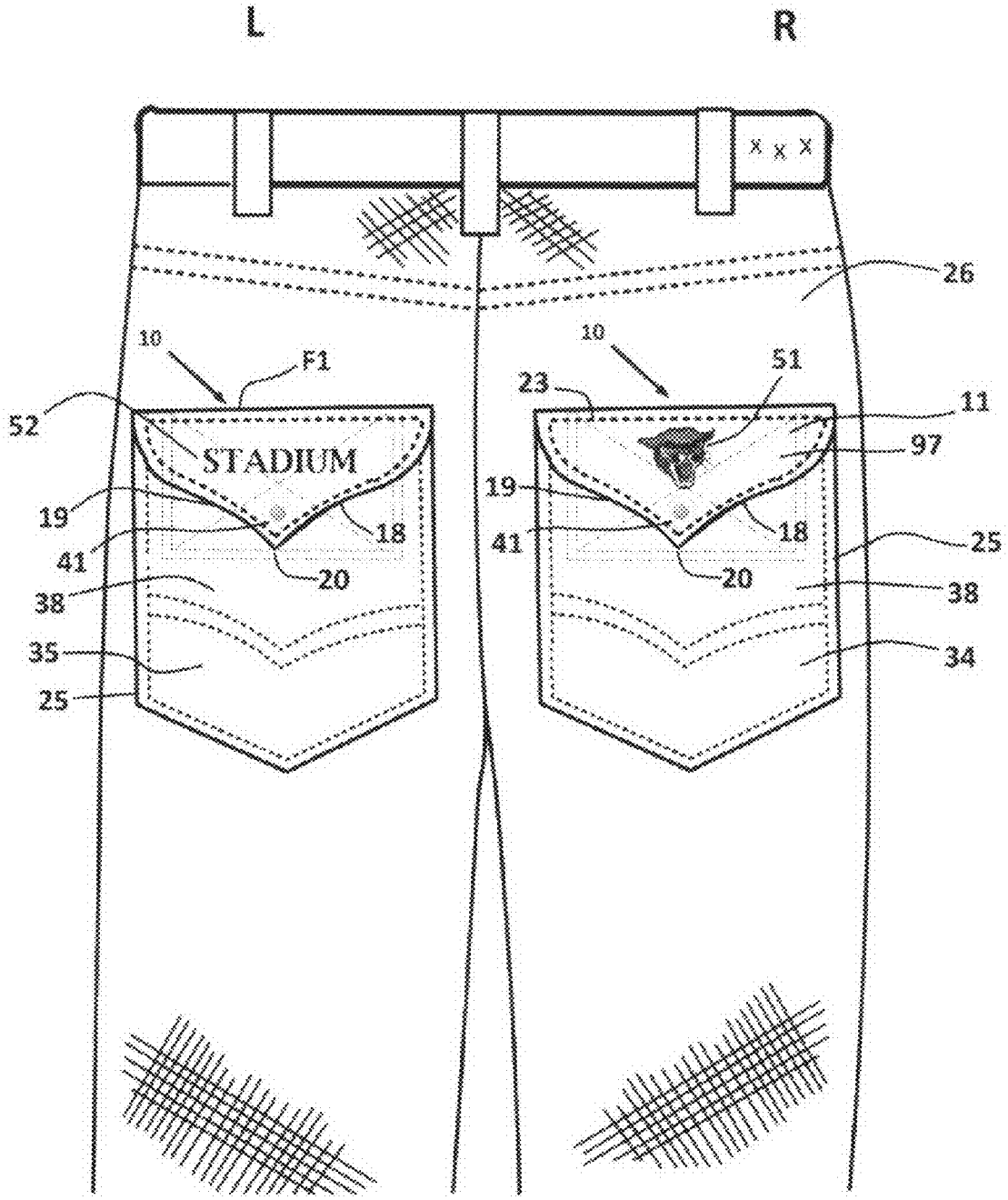
FIG. 10 illustrates a front planar view of an exemplary pair of promotional pocket covers, as illustrated in FIG. 9, inserted into rear jean pockets worn by a user, showing tack pin, and with phantom long dashed lines for transparency, illustrative of the insert module which is concealed by the jean pocket. The short dashed lines indicate stitching.
Figure 11:
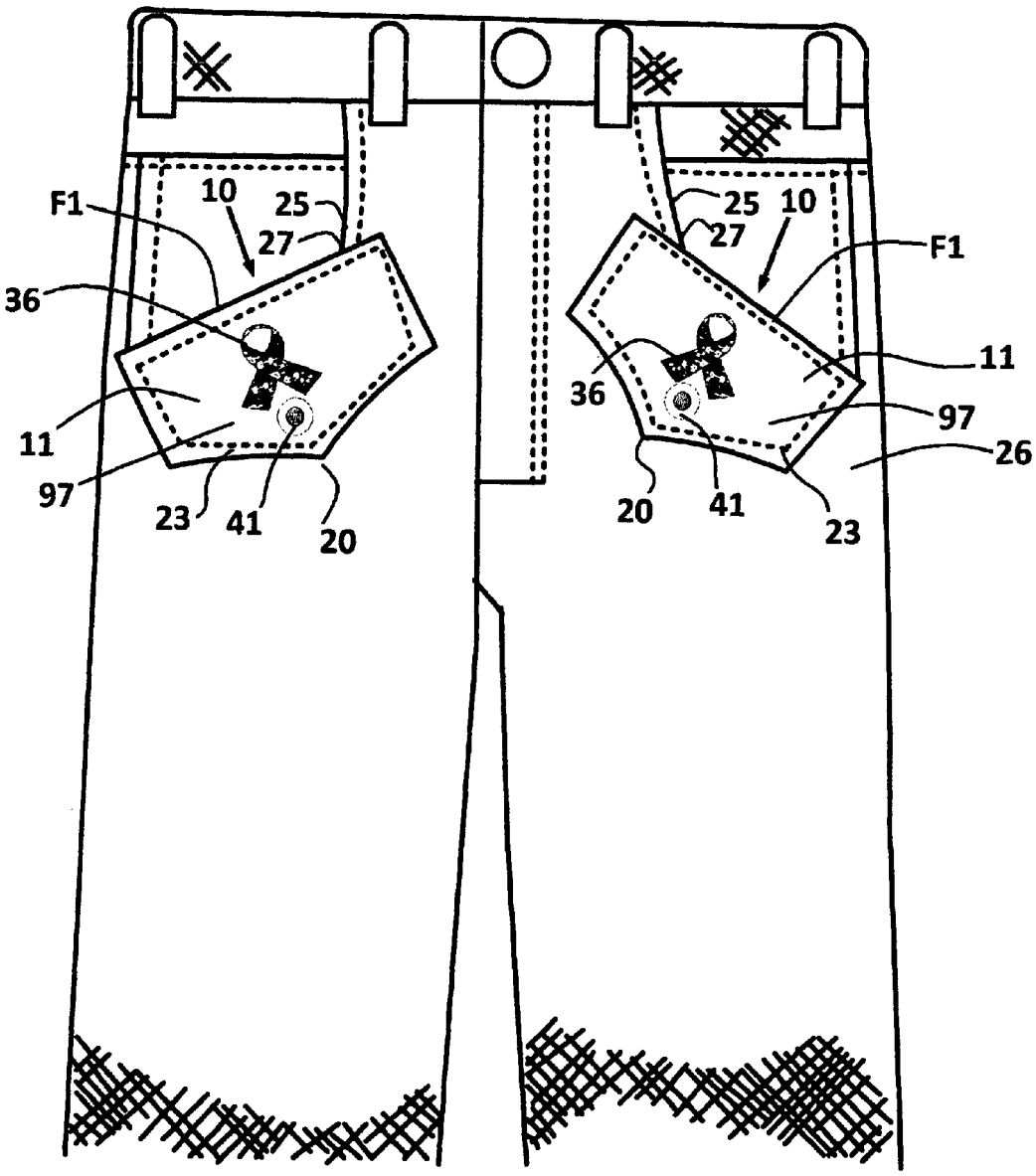
FIG. 11 illustrates a front planar view of an exemplary pair of promotional pocket covers inserted into two front jean pockets as worn by a user showing one promotional adornment ribbon affixed to one promotional pocket cover and a second promotional ribbon affixed on the second promotional pocket cover. The short dashed lines indicate stitching.
Figure 25:
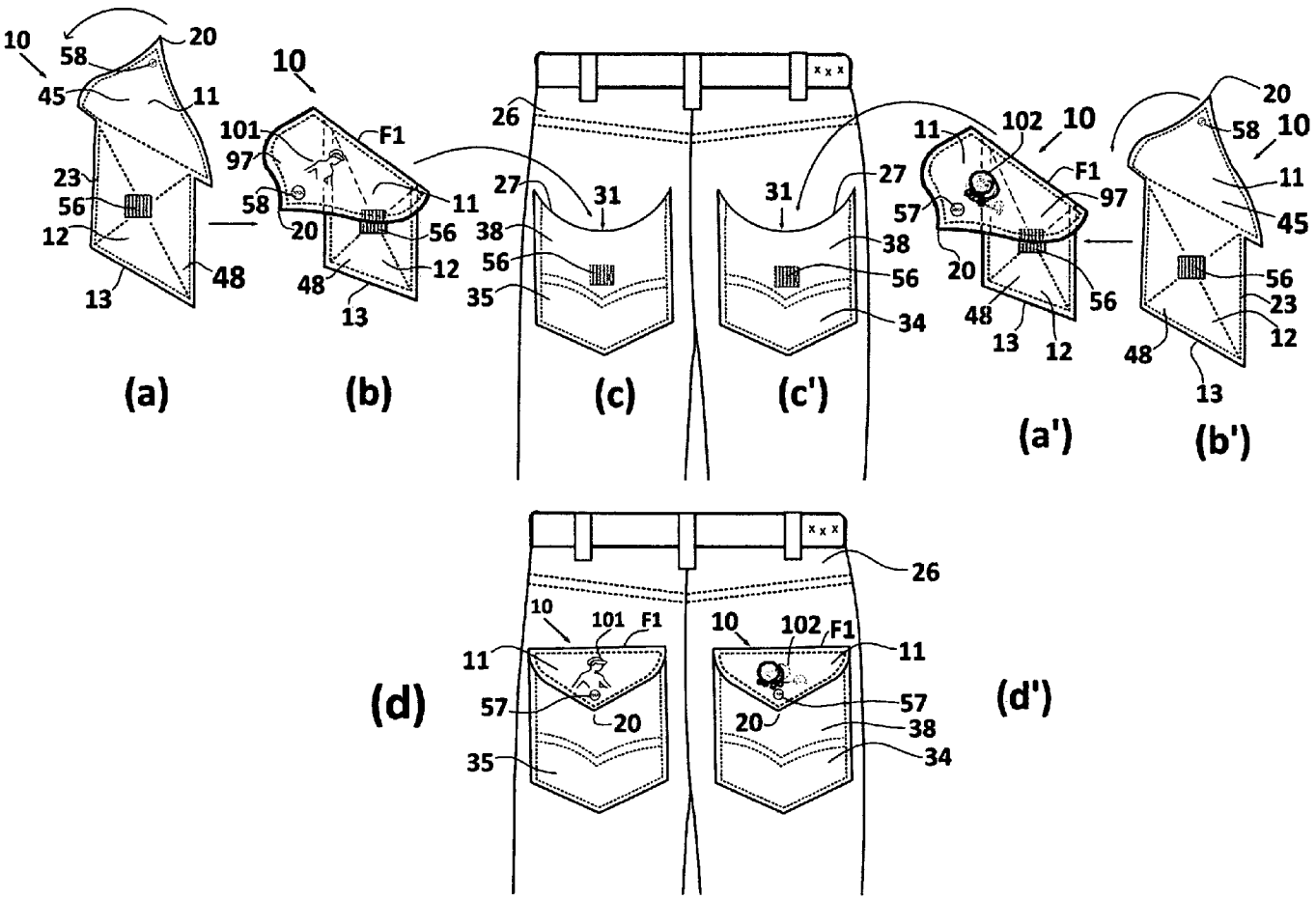
FIG. 25 (a)-(d) is a schematic illustration of a method of installation of a promotional pocket cover, as illustrated in FIG. 23 A, on a left jean pocket, using hook and loop fastener component as an attachment means. The short dashed lines indicate stitching.

The following detailed description will be made illustrating a removably attachable promotional pocket cover, pattern, method of construction and use, according to the preferred embodiment of the present invention, as illustrated in FIG. 1 and generally designated with the numeral 10. With reference to FIGS. 9, 11, and 25 the promotional pocket cover 10 is configured to be used with a garment pocket 25, preferably, a pair of jean pants (hereinafter, "jean(s)") 26, but not exclusive to, worn by children, adolescents, and adults, of various sizes. Therefore, it is well apparent to one skilled in the art, that the following detailed description can be made in the context of a "pair" of promotional pocket covers 10 where each promotional pocket cover 10 is transposable and complementary to each other, as illustrated in FIGS. 7A and 7B, 8A and 8B, 11, 12A and 12B, 13A and 13B, 14A and 14B, 15A and 15B, and 16A and 16B. In addition, the promotional pocket cover 10 can be embodied in the context of being reversible. The jeans 26 are not claimed as the present invention, but are described to assist in the detailed description of the instant invention.

In addition, it is readily apparent, that the promotional pocket cover 10 of the present invention would also be suitable for use as other types of promotional pocket covers 10, paired together or used singularly, such as with other types of garments or apparel, promotional pocket covers, jacket promotional pocket covers, coverall pocket covers, skirt promotional pocket covers, shirt promotional pocket covers, apparel decorative covers, pocket book promotional pocket covers, hat promotional pocket covers, T-shirt promotional pocket cover, uniform promotional pocket covers, computer bag promotional pocket covers, fanny pack, promotional pocket cover, overall promotional pocket cover, back pack promotional pocket covers, luggage promotional pocket cover, iPad™ promotional pocket covers, earing promotional pocket covers, promotional pocket covers used with pet garments, and apparel, and/or the like, and/or any article that includes a pocket, cavity, or deep slit. In addition, the invention will be described in the context of its various configurations. It should be appreciated that alternative arrangements of the invention can comprise any combination of such configurations. When describing the promotional pocket cover 10 in use, directional terms, for example, right pocket and left pocket, are defined from the perspective of the wearer.

Figure 2:
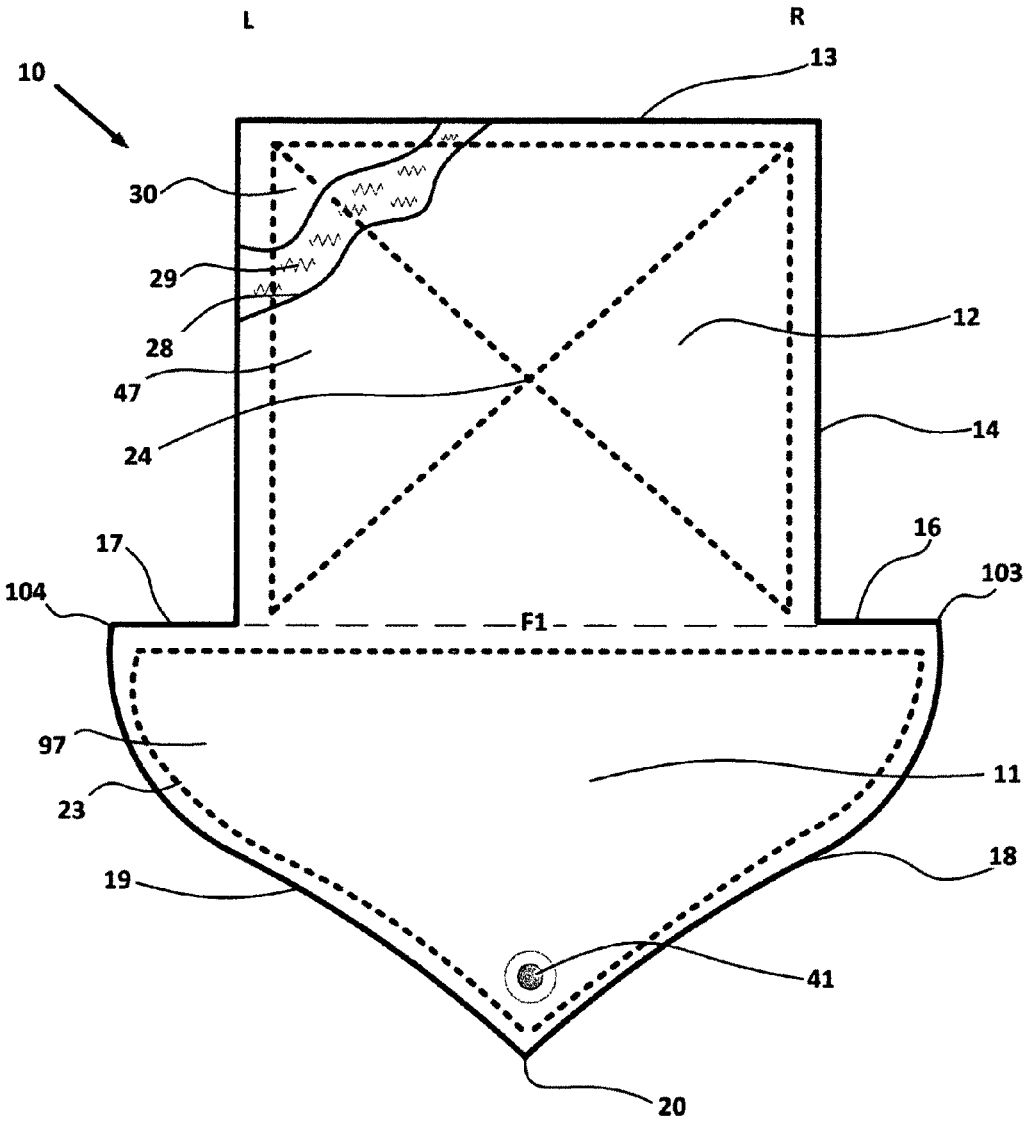
FIG. 2 is a top planar view of the promotional pocket cover, according to the preferred embodiment of the present invention, showing the arrow shaped single body unit including cover module and insert module, and tack pin attached to the cover module. A cutaway at the left top corner illustrates the three panels included in the construction of the promotional pocket cover. The short dashed lines indicate stitching.

Referring to FIG. 1, a promotional pocket cover 10 and more particularly a novel removably attachable promotional pocket cover 10 is shown and designated by numeral 10. In the preferred embodiment shown in FIGS. 1 the promotional pocket cover 10 comprises a single body unit generally in the shape of an arrow including a cover module 11 and an insert module 12 continuously seamlessly connected thereto. The insert module 12 is generally rectangular in shape having a longitudinal horizontal lower linear edge 13 of predetermined width joined by two opposing vertical parallel linear side edges 14 and 15 wherein each vertical linear side edge 14 and 15 extends for a predetermined length ; further wherein vertical linear side edges 14 and 15 at the predetermined length delineate at right angles in opposing directions parallel to the horizontal lower linear edge 13 to form two exterior opposing right angles forming two opposing longitudinal horizontal basal linear edges 16 and 17 of predetermined width of the cover module 11; the cover module 11 generally triangular in shape having two opposing curvilinear side edges 18 and 19 meet at an obtuse angle to form an upper apex 20; and thereby an arrow shaped pocket cover 10 is formed having a longitudinal axis 21 and a lateral axis 22. The cover module 11 generally triangular in shape has a wider base than the width of the insert module 12; wherein said insert module 12 has a rectangular shape that has a length equal to or longer than cover module 11 length. Furthermore, the cover module 11 includes a surface area to affix promotional adornments thereon. As shown in FIG. 2, and explained in more detail below, the promotional pocket cover 10 is formed of three panel layers of material including a top panel layer 28, a middle layer 29, and a back panel layer 30 of wearer selected material wherein said top panel 30 and said bottom panel 28 layers are of decorative complimentary materials, and said middle layer 29 is of a supportive stiffening material. The promotional pocket cover 10 is reinforced with stitches 23 forming a border along the marginal edges of the promotional pocket cover 10 as defined by short dashed lines; and the insert module 12 is reinforced and embellished by a stitched "X" 24 sewn therein the insert module 12. Upon installation on a preexisting garment pocket or preexisting jean pocket 25 the insert module 12 and cover module 11 folds downward along a fold line Fl, defined by phantom line Fl, which is linear with the longitudinal basal linear edges 16 and 17 of the cover module 11; further, line Fl which will run parallel to the top edge 27 of the preexisting jean pocket 25.

In another embodiment of the promotional pocket covers, the curvilinear side edges 18 and 19 may be contoured and configured to any design, or contoured side edges 18 and 19 of any curvilinear shape, for example rounded curvilinear side edges as shown in FIGS. 12 to 16.

As shown in FIG. 2, the upper left corner of the insert module 12 is partially cut away to more clearly show the interior construction of the promotional pocket cover 10; and the top surface of the cover module 11 of the promotional pocket cover 10 which receives the promotional adornments 40 is facing the viewer. With reference to FIGS. 21-26 B, and as shown in FIG. 2, which is described below in more detail, the promotional pocket cover 10 further comprises three panels 28, 29, and 30 disposed superimposed one on top of the other which provides a top panel 28, a middle panel 29, and a bottom panel 30, according to the preferred embodiment of the present invention. As illustrated in FIG. 2, the parts shown consist of a top panel 28 which is constructed to comprise a wearer selected material which is displayed when the cover module 11 is positioned upon the face panel 38 of the jean pocket 25 , as illustrated in FIGS. 9, 10, 11 to 16, 17, 18, 22, 23A-23B, 25, and 43; and the top panel 28 upon which the promotional adornments 40 can be affixed thereupon; and a middle panel 29 which is constructed to comprise a supportive panel, of a foldable and supple supporting material manufactured from any one of a plurality of natural or synthetic fabric materials preferably pellon, or any one of pellon substitutes including any one of silicone, silicone substitutes, resins, foam rubber material, polyurethane foam, or sponge, supportive material which forms the middle layer of the promotional pocket cover 10 which provides a supporting means to enable the promotional pocket cover 10 to retain its form during use, and as a means to prevent puckering and collapse of the promotional pocket cover 10 during use; and a back panel 30, as illustrated in FIGS. 2, 3, 6A, 6B, 24, 34 to 39A-B, 42 and 43, which is constructed to comprise a wearer selected material which complements the top panel 28, or is of a material that is identical to the top panel 28, or any material desired or needed by the wearer. The wearer selected material forming the top panel and the back panel is manufactured from a material including any one of cotton, denim, colored denim, dungaree polyester, linen, leather, corduroy, vinyl, flannel, seersucker, spandex, satine, silk, satin, velvet, felt, velveteen, faux fur, wool, wool blends, rayon, viscose, nylon, banton cashmere or combinations thereof. Furthermore, the wearer selected material forming the top panel includes any promotional adornment woven therein as being of specific promotional color, promotional print, or promotional design with a logo thereon. The cover module 11, as shown in FIGS. 9, 10, 17, 18, 25, and 41*as* described in more detail below, and shown in FIGS. 27-33 is configured of predetermined dimensions to cover a top portion of a face 38 of the preexisting garment pocket or jean pocket 25 of which it is placed thereon; and the insert module 12 is configured of predetermined dimensions less than the dimensions of the pre-existing garment pocket or jean pocket 25 the insert module 12 is placed therein for easy insertion and concealment therein. The utilization of the types of material, fabrics, cloths, broadcloths, pellon, to construct the promotional pocket cover, as mentioned above, allows for the promotional pocket cover to be machine washable.

Figure 3:
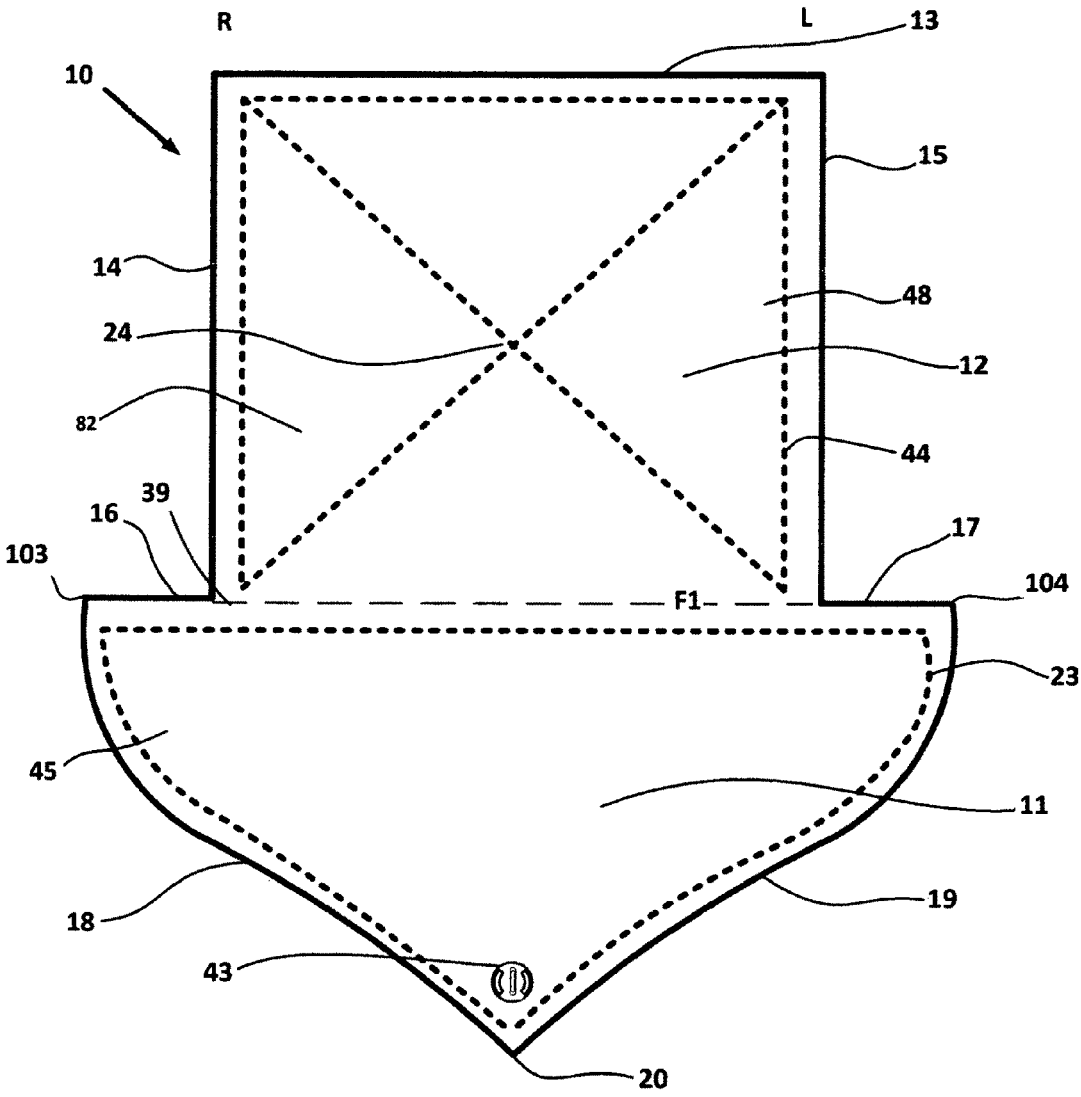
FIG. 3 is a planar view of the of the back side of the promotional pocket cover as illustrated in FIG. 2, showing the cover module and the insert module and showing the butterfly clutch element of the tack pin attached to the cover module, according to the preferred embodiment of the present invention. The short dashed lines indicate stitching.
Figure 4:
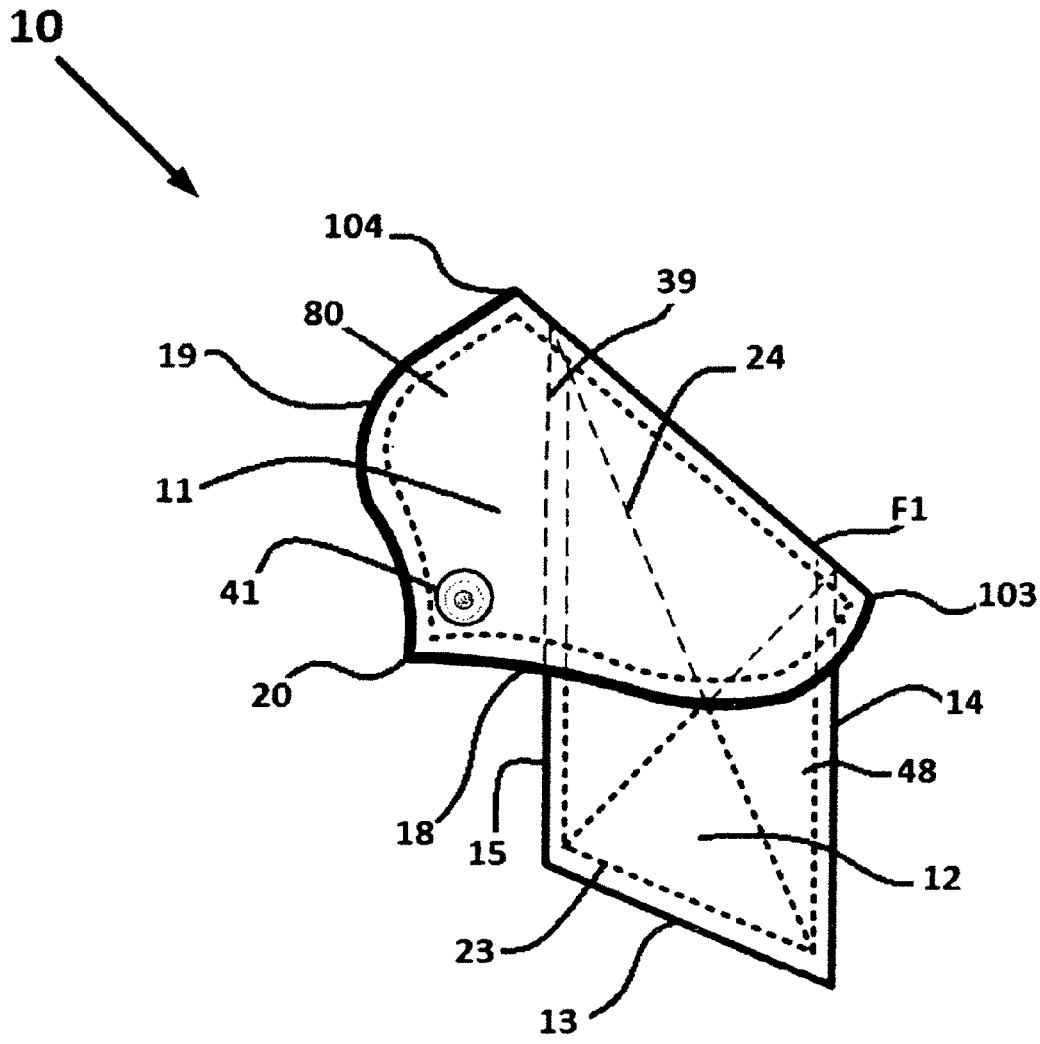
FIG. 4 is a perspective view of the promotional pocket cover, according to the preferred embodiment of the present invention, showing the folding of the cover module with portion of the insert module shown in phantom defined by long dashed lines, for transparency. The short dashed lines indicate stitching.

FIGS. 1, 2, and 3 are representative plan views of the promotional pocket cover 10 in a flat unfolded state. FIG. 4 is representative perspective view of the promotional pocket cover 10 in a folding state showing the cover module 11 bent along the fold line Fl, defined at phantom line Fl, wherein the cover module is shown substantially perpendicular to the insert module 12. A portion of the insert module 12 is illustrated in phantom 39 for transparency which shows a portion of the insert module 12 positioned behind the cover module 11. The promotional pocket cover 10 is reinforced with stitches along the marginal edges 23 forming a border as indicated by short dashed lines 44 at 23. A tack pin 41 is pivotally positioned proximate to the apex 20 of the cover module 11 which enables the removable attachment of the promotional pocket cover 10 to a preexisting jean pocket 25. The method of attachment and installation of the promotional pocket cover 10 to a preexisting garment pocket, for example, a jean pocket 25 utilizing a tack pin 41 is described in more detail below.

As illustrated in FIGS. 1 to 16, 22 -25, 39, 40, 41, 42, and 43, the promotional pocket cover 10 has a border formed along the marginal edges by stitching 23, which can be of any wearer selected color, weight or type. The stitches 44 are added along the marginal edges 23 of the promotional pocket cover 10 to provide further reinforcement to the arrow form of promotional pocket cover 10. More particularly, the stitched marginal edges 23 can be sewn with a wearer-selected thread from a variety of a plurality of colors, textures, designs of any one of sparkle, verigated, hologram, or stripe including indicia which are identifiable with charitable organizations, non-profit organizations, for-profit organizations, or sports teams, to provide an additional promotional enhancement to the promotional pocket cover 10.

Figure 5A:
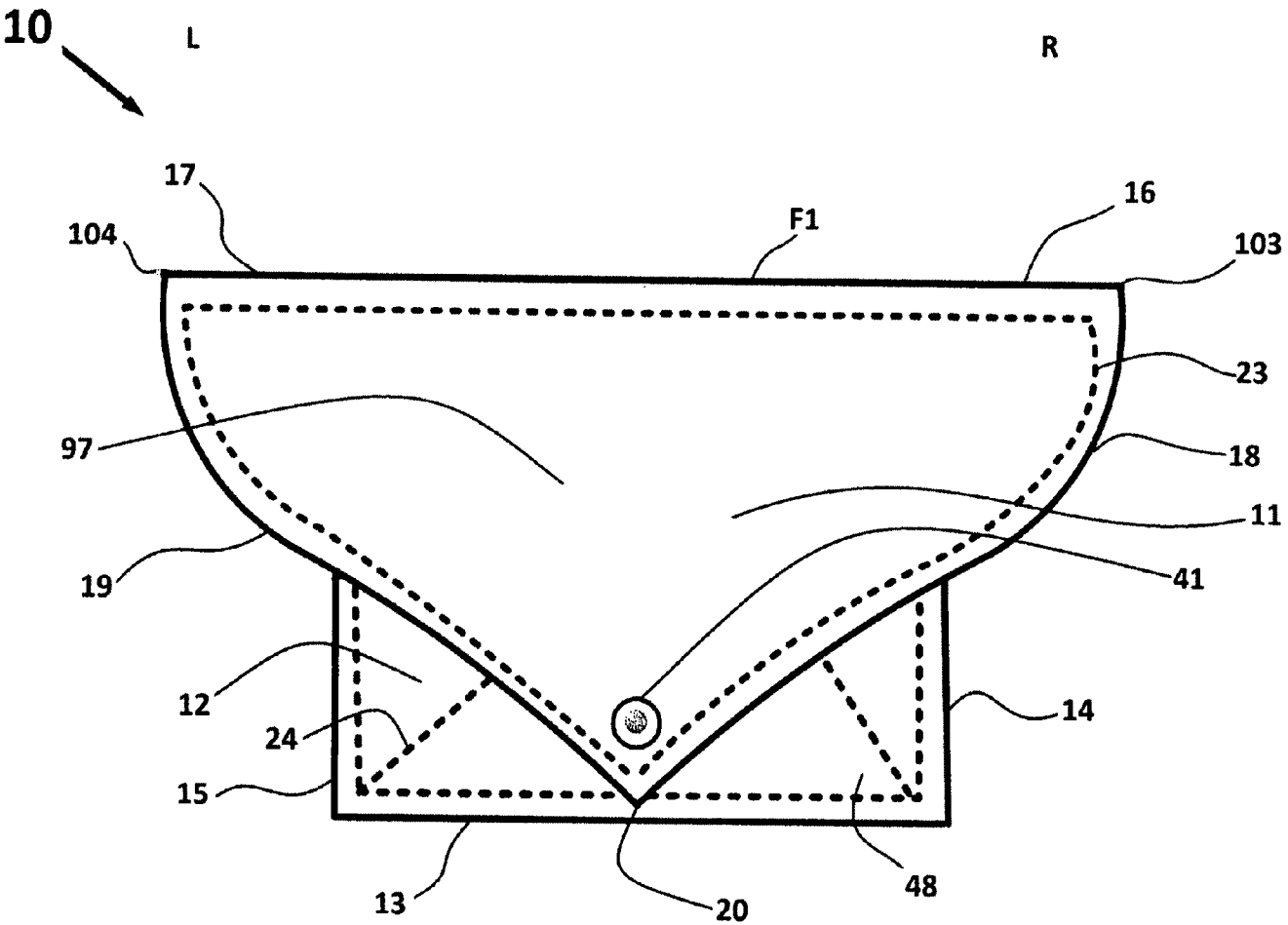
FIG. 5 A is a front planar view of the promotional pocket cover, according to the preferred embodiment of the present invention, showing the cover module folded down covering a portion of the insert module, and showing cover module with tack pin. The short dashed lines indicate stitching.
Figure 5B:
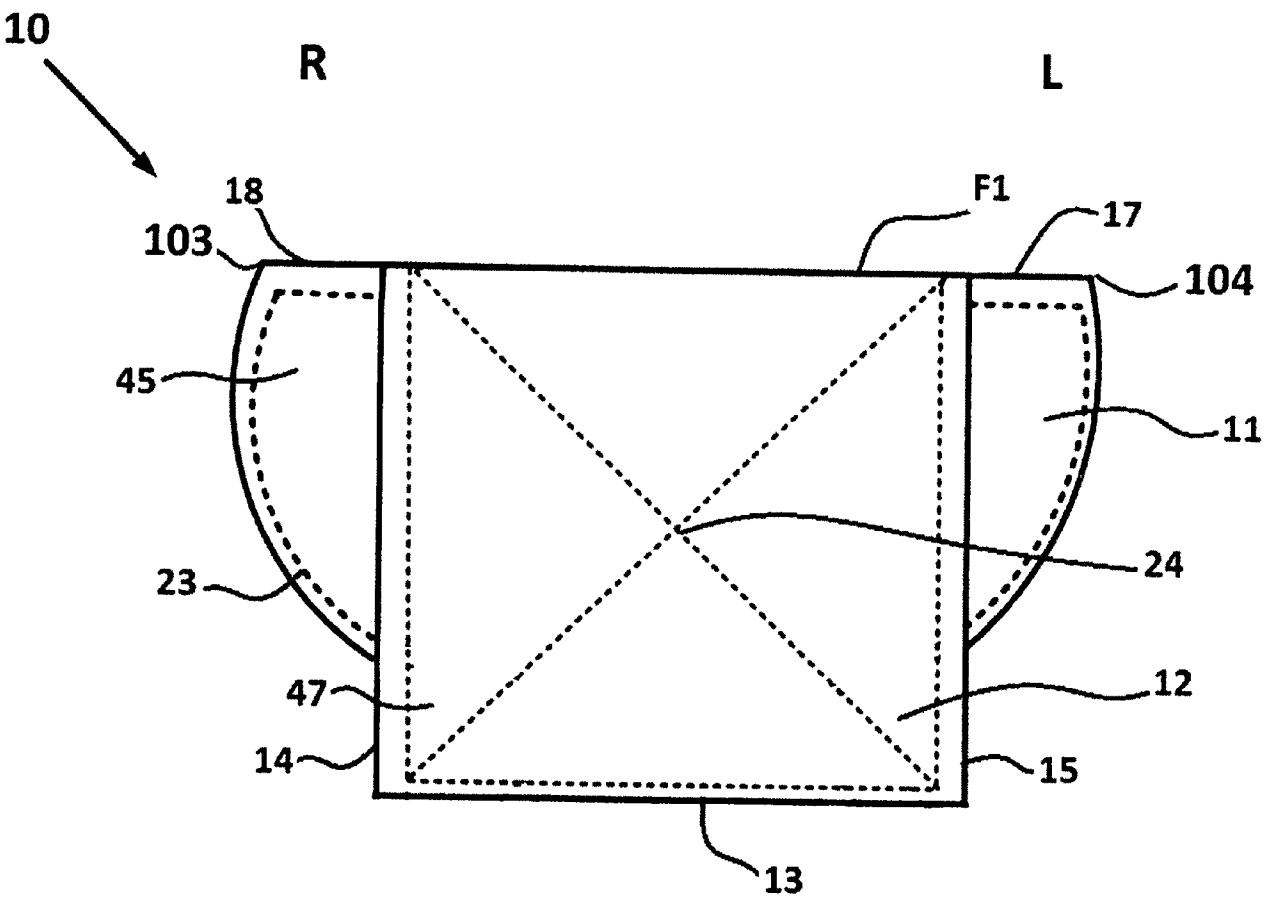
Figure 6A:
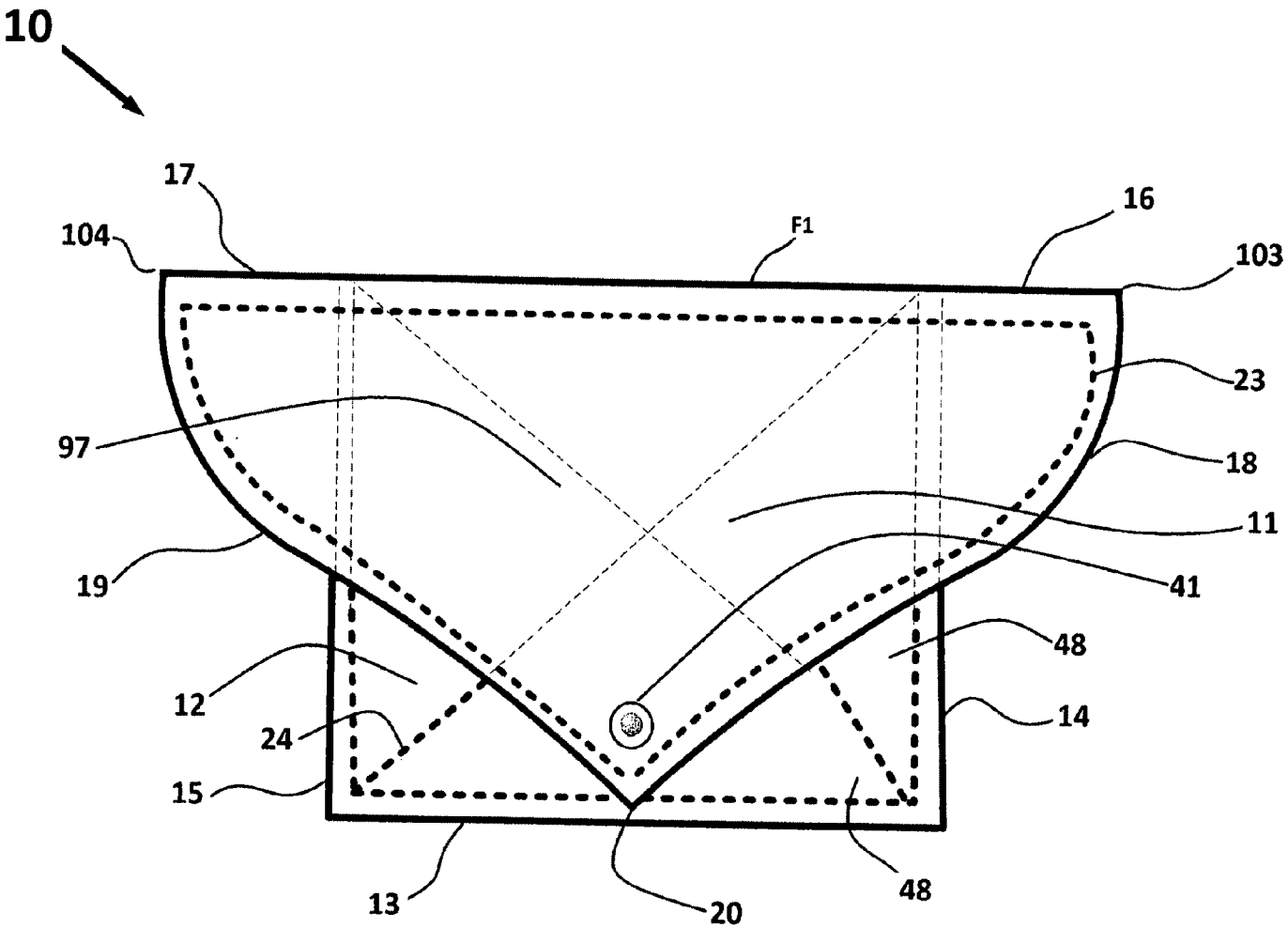
FIG. 6 A is a front planar view of the promotional pocket cover, according to the preferred embodiment of the present invention, showing the cover module folded down covering a portion of the insert module, and showing a portion of the insert module in phantom long dashed lines for transparency. The short dashed lines indicate stitching.
Figure 6B:
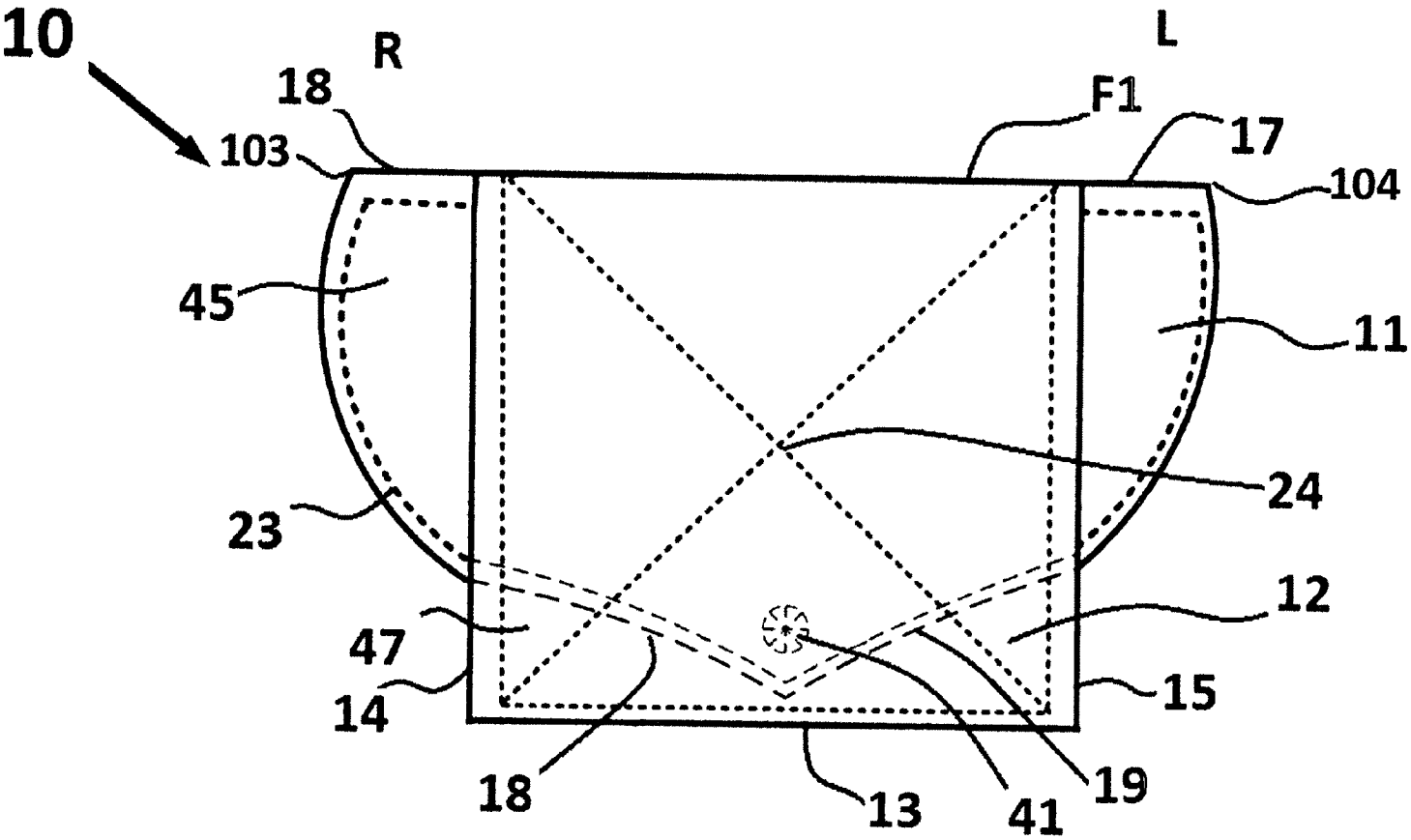
Figure 24:
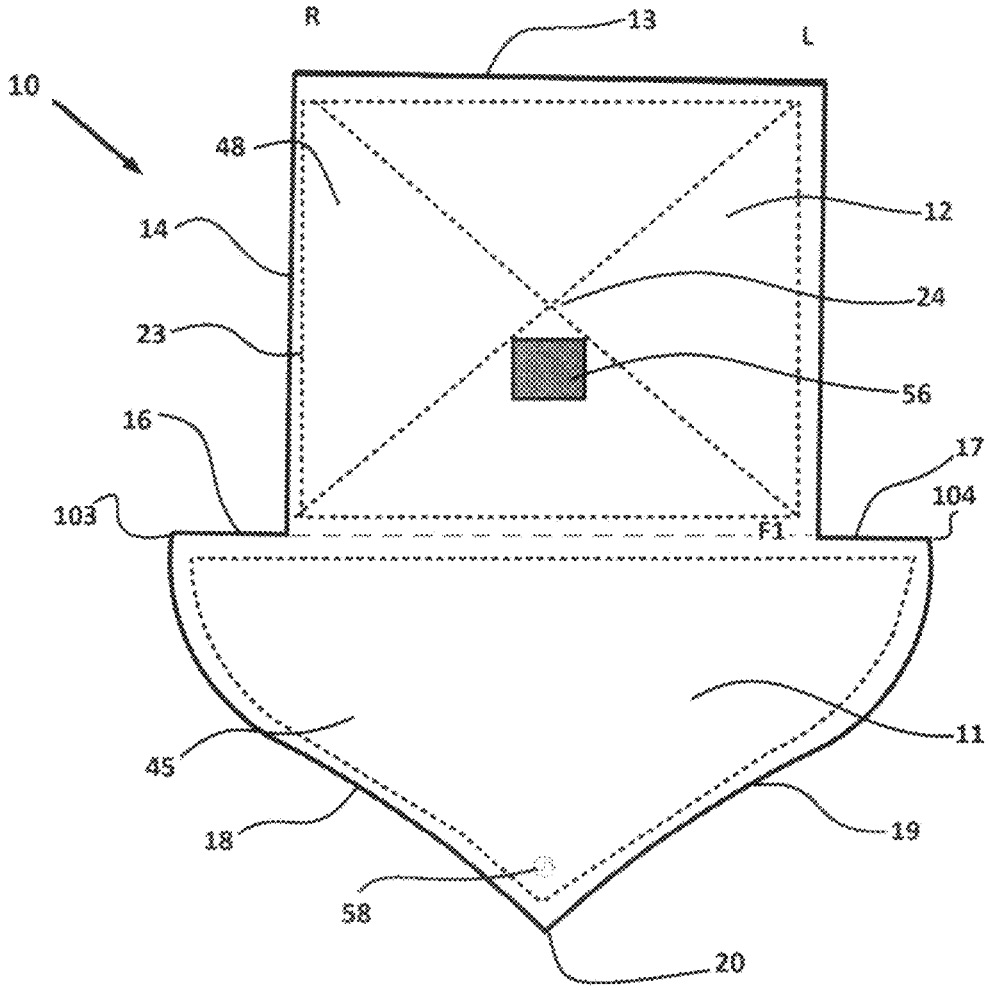
FIG. 24 is an illustration of a rear planar view of promotional pocket covers as illustrated in FIG. 23A and FIG. 23B showing the back stitches of the button and the affixing means hook and loop fastener component affixed on the insert module. The short dashed lines indicate stitching.
Figure 26:
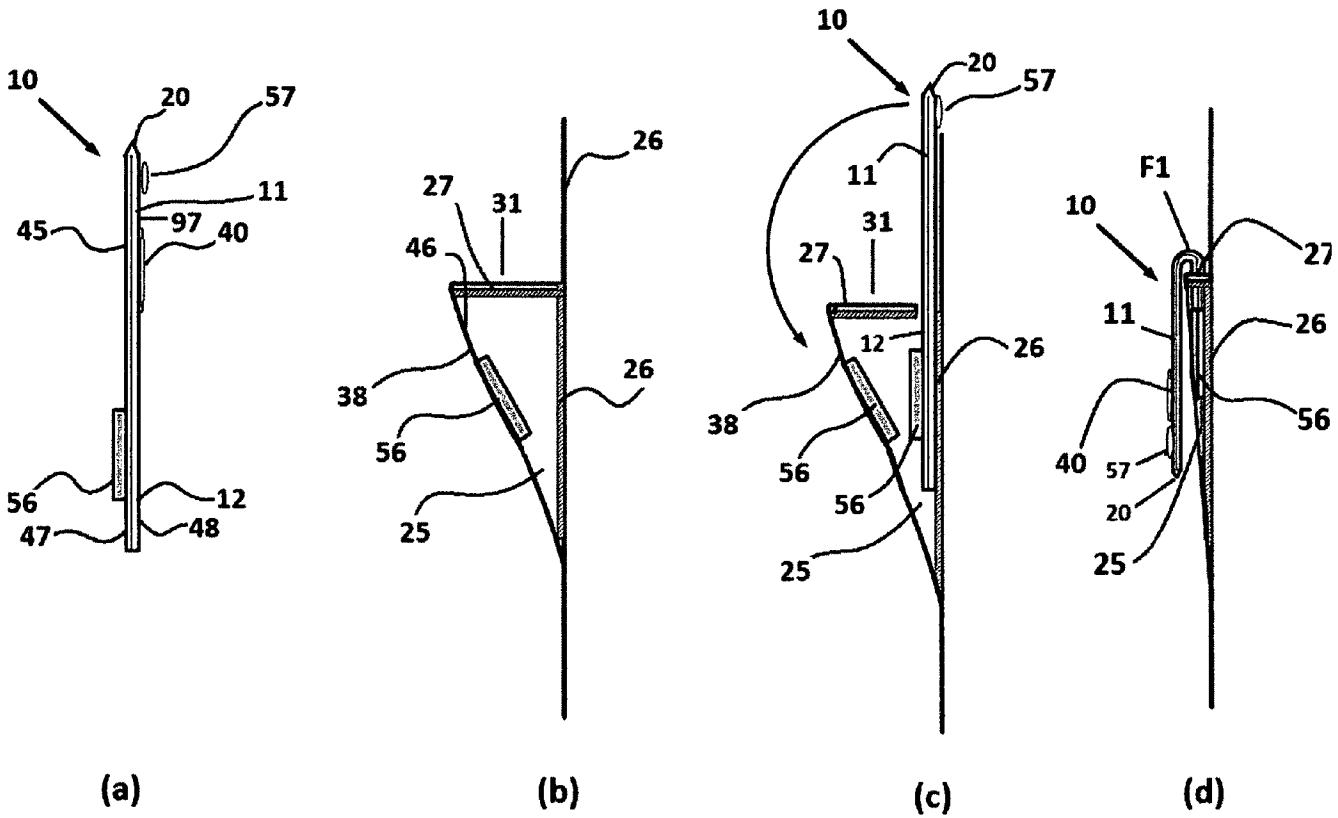
FIG. 26 (a)-(d) is a side perspective view illustrating installation of the promotional pocket cover into a jean pocket with hook and loop fastener components as the attachment means. The short dashed lines indicate stitching.

FIG. 5 A illustrates the promotional pocket cover 10 in a folded state with the cover module 11 folded downward with the apex 20 pointing down; and the cover module 11 covering a portion of the ventral side 48 of the insert module 12. The promotional pocket cover 10 includes at least one attachment means removably attached thereto to removably attach the promotional pocket covers 10 to preexisting garment pocket or jean pocket 25 having at least one face panel 38 including a top edge 27. The attaching means, preferably a tack pin 41 but not limited to, is positioned proximal to the apex 20 and is in view. In another embodiment, as shown in FIGS. 24-26 the attaching means include any one of any type of hook and loop fastener component and complimentary hook and loop fastener component. FIG. 5B shows the promotional pocket cover 10 in a folded state from the perspective of the back of the promotional pocket cover 10 showing the dorsal side 47of the insert module 12. Marginal stitches 23 reinforce the insert module 12 and additional stitches formed in an "X" 24, also, add to the reinforcement of the insert module 12 [.] and embellishment. The marginal stitches 23 also add a decorative embellishment to the promotional pocket 10. More particularly, as mentioned above, threads of various colors, textures, or including indicia identified with [a] any type of particular logos, images, trademarks, tradenames, decorative embellishment, sports team, or charitable cause, or any specific cause, may be used, and therefore provide an additional promotional embellishment to the promotional pocket cover 10. A portion of the cover module 11 can be seen on either side of the insert module 12. FIG. 6A shows the promotional pocket cover 10 in the folded state including the cover module 11 folded over a portion of the ventral side 48 of the insert module 12. A portion of the insert module 12 is shown in phantom for transparency and scale. FIG. 6B shows the promotional pocket cover 10 in the folded state from the perspective of the back of the promotional pocket cover 10 showing the dorsal side 47 of the insert module 11, and a portion of the cover module 11 is shown in phantom for transparency and scale. With reference to FIGS. 1, 2, 3, 4, 9, 10, 17, 25, 27-33, and 41 the cover module 11 is configured of predetermined dimensions to cover a top portion of a face 38 of the preexisting garment pocket or jean pocket 25 of which it is placed thereon. Furthermore, the cover module 11 includes a surface area to affix promotional adornments thereon, as illustrated below in FIGS. 7-16.

With reference to FIGS. 1, 2, 3, 4, 5B, 6A, 7A-B, 8, 10, 17-22, 23-25, and 27-32, 40, 42, and 43 the insert module 12 includes the general portion of the promotional pocket cover 10 which is constructed to be inserted into the cavity 31 of a preexisting jean pocket 25, wherein the insert module 12 is configured of predetermined dimensions less than the dimensions of the preexisting garment pocket or jean pocket 25 so that the insert module 12 is placed therein for easy insertion and concealment therein. Marginal stitches 23 are sewn along the marginal edges of the insert module 12 to reinforce the promotional pocket cover 10 and prevent curling; and further a stitched "X" 24 is sewn within the insert module 12 to reinforce the rectangular shape of the insert module 12 and to prevent curling and buckling of the promotional pocket cover 10 and for embellishment. The purpose of the insert module 12 is to enable the promotional pocket cover 10 to be positioned and supported easily within the cavity 31 of the jean pocket 25, in either of the front pockets 32 and 33 and/ or in either of the back rear pockets 34 and 35, and to prevent the promotional pocket cover 10 from falling out during certain activity. With reference to FIGS. 10, 18, 19, 20, 21 and 22 the insert module 12 extends continuously a predetermined distance adjacent to the cavity 31 or interior of the jean pocket 25. The insert module 12 of the promotional pocket cover 10 is generally rectangular in shape to correspond to the physical shape of the cavity 31 into which the promotional pocket cover 10 is inserted therein which is preferably a cavity 31 of the jean pocket 25. This keeps the total insert module 12 within the cavity 31 of the jean pocket 25 relatively smooth shaped and does not provide for bulkiness to the wearer. It should be noted that these physical shapes and sizes may vary in accordance to the plurality of physical shapes available on garment pockets, preferably jean pockets 25, either front pockets 32 and 33 or rear pockets 34 and 35, and still remain within the spirit and scope of the present invention.

With reference to FIGS. 7 A, 7 B, 8 to 11, 28 and 29, the cover module 11 includes the general portion of the promotional pocket cover 10 which is constructed to provide a surface area sufficiently resilient to affix at least one of any type of printed matter of any one of logos, images, trademarks, trademnames or decorative embellishment including any one of colors, ink, paint, puff paint, sequins, leather, jewelry, precious metals, studs, embroidery, ribbons or buttons or combinations thereof. For example, a variety of specific logos, tradenames or trademarks, or marks, or indicia, or inspirational or motivational slogans, or ribbons, or buttons, or mascots, or team logos, or team colors, or images, or names, or letters, initials, monograms, family, crest, coat-of-arms, or dates, or symbols, or embroidery, or decorations, or promotional images, or inspirational messages, or special timely messages, or embellishments, rhinestones, rivets, patches, stitching, ink, paint, sequins, feathers, jewelry, precious metals, studs, or any promotional adornment, identifiable or associated with specific charitable organizations, or non-profit organizations, or sports teams, or sports leagues, or amateur sports teams, or sports affiliations, or NASCAR®, or international sports teams, or medical needs groups, or cancer groups, or autism groups, or a special needs group, or military organizations, or commercial entities, or products, or public figures, or personal figures, or media events, or publicity events, or public events, or personal events, or personal loss, or animals, or holidays, or colleges, or universities, or high schools, or automobile racing series, or automobile racing teams, or Churches, or clubs, or companies, or products, or law enforcement departments, or government offices, or political parties, or candidates, or issues, or interest groups, or theme parks, or amusement parks, or t.v. shows, or movies, or movie characters, or music groups, or cartoon characters, or super-heroes, enhancement, or any specific cause, or any wearer selected promotional adornment, to enable the display thereof to a viewer. In addition, the cover module 11 includes the general portion of the promotional pocket cover 10 which is constructed to fold over the jean pocket edge 27 and cover a portion of a face panel of jean pocket 25 so orientated to enable display of promotional adornments 40.

Figure 7A:
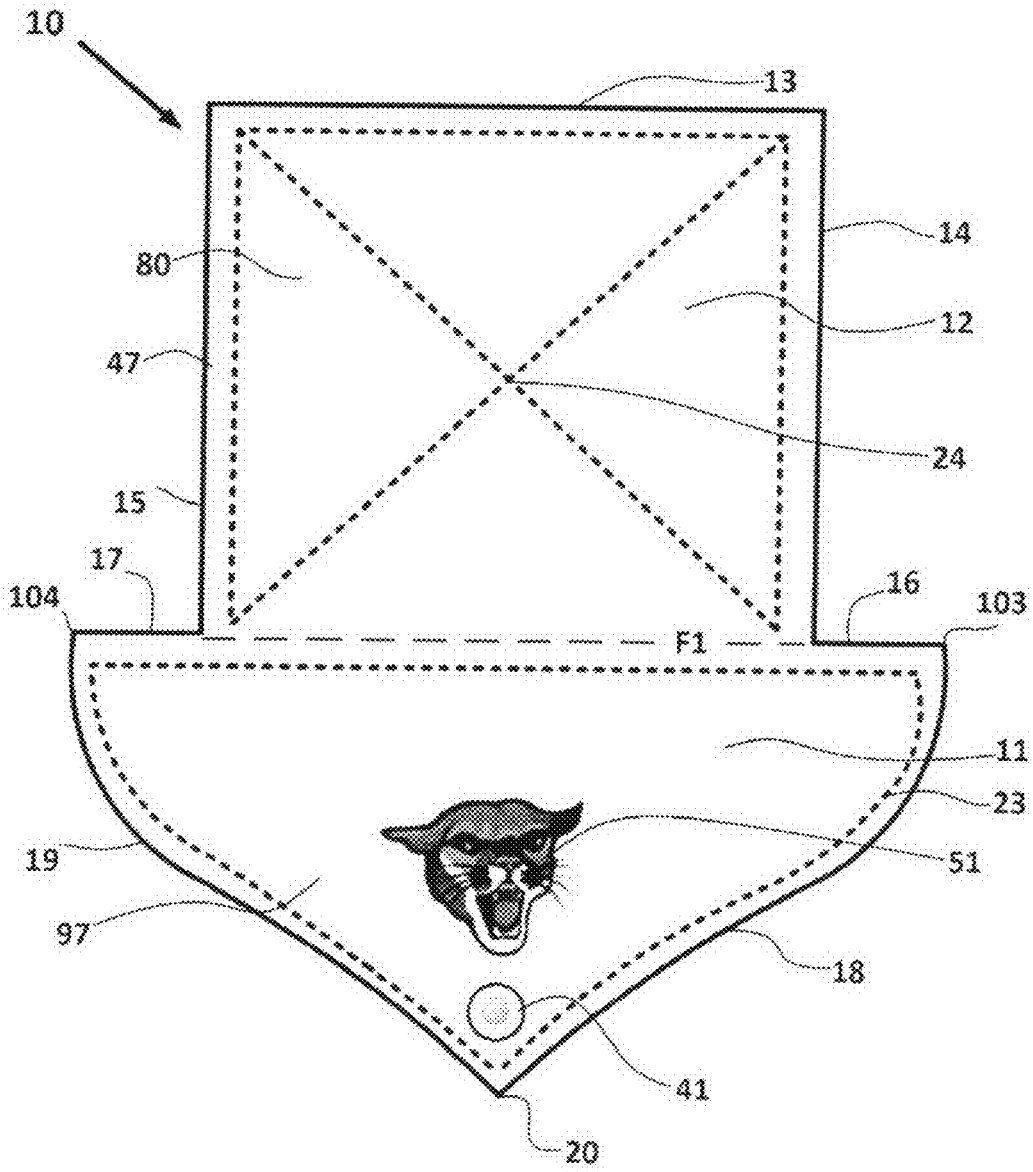
FIG. 7A is a front planar view of an exemplary embodiment of the present invention showing a pair of corresponding promotional pocket covers with tack pins.
Figure 7B:
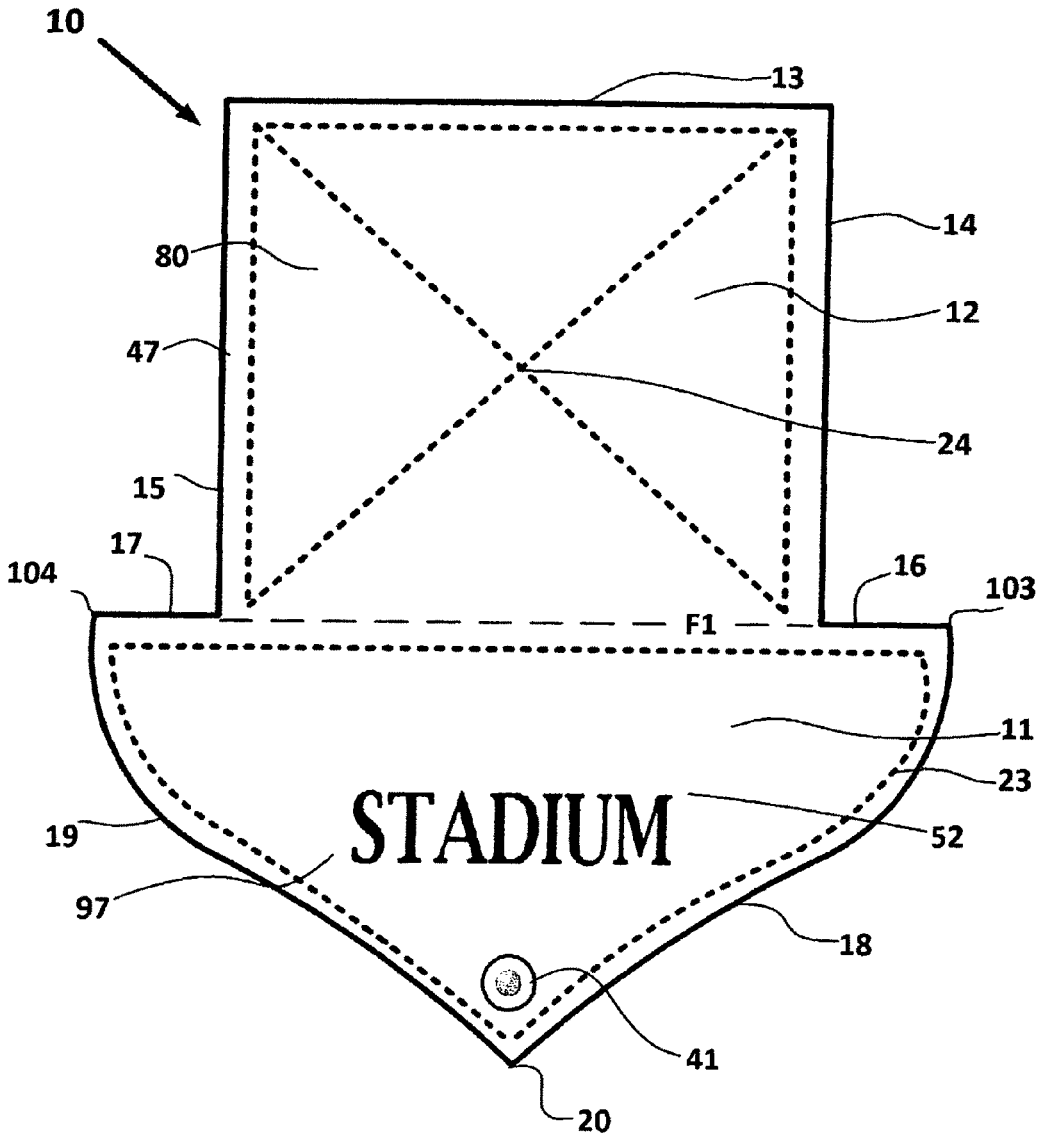
FIG. 7B shows a second decorative cover with a promotional adornment showing the name "STADIUM" affixed to the cover module. The short dashed lines indicate stitching.

FIG. 7A shows a promotional pocket cover 10, in a flat unfolded state, including the insert module 12 and the cover module 11 with a promotional adornment 40 as a cougar 51 affixed upon the obverse surface 97 of the cover module 11. FIG. 7B shows a promotional pocket cover 10 in a flat unfolded state, including the insert module 12 and the cover module 11, including a promotional adornment 40 as the word "STADIUM" affixed on the obverse surface 97 of the cover module. FIG. 8A shows a pair of promotional pocket covers 10, in a folded state, with the cover module 11 folded downward along the fold line F1, defined at phantom line F1, so that the promotional adornment 40, shown as a cougar 51, on one promotional pocket cover 10 is displayed correctly towards a viewer; and the cover module 11 covers a portion of the insert module 12; and further shows a second promotional pocket cover 10 in a folded state with the cover module 11 folded downward along the fold line F1, defined at phantom line F1, so that the promotional adornment 40, shown as the word "STADIUM" 40 is displayed correctly towards a viewer. FIG. 8B illustrates the pair of promotional pocket covers 10 shown in FIG. 8A further by illustrating a portion of the insert modules 12 shown in phantom for transparency and scale. The purpose of the cover module 11, of the present invention, is to enable at least one of a special promotional adornments 40 to be affixed thereon, and thereafter when the promotional pocket cover 10 is installed upon a jean pocket 25 the promotional pocket cover 10 is able to raise recognition, awareness, support, loyalty, passion, and dedication, for a particular charitable organization, or non-profit organization, sports team, sports league, amateur sports team, or any special cause.

Figure 22:
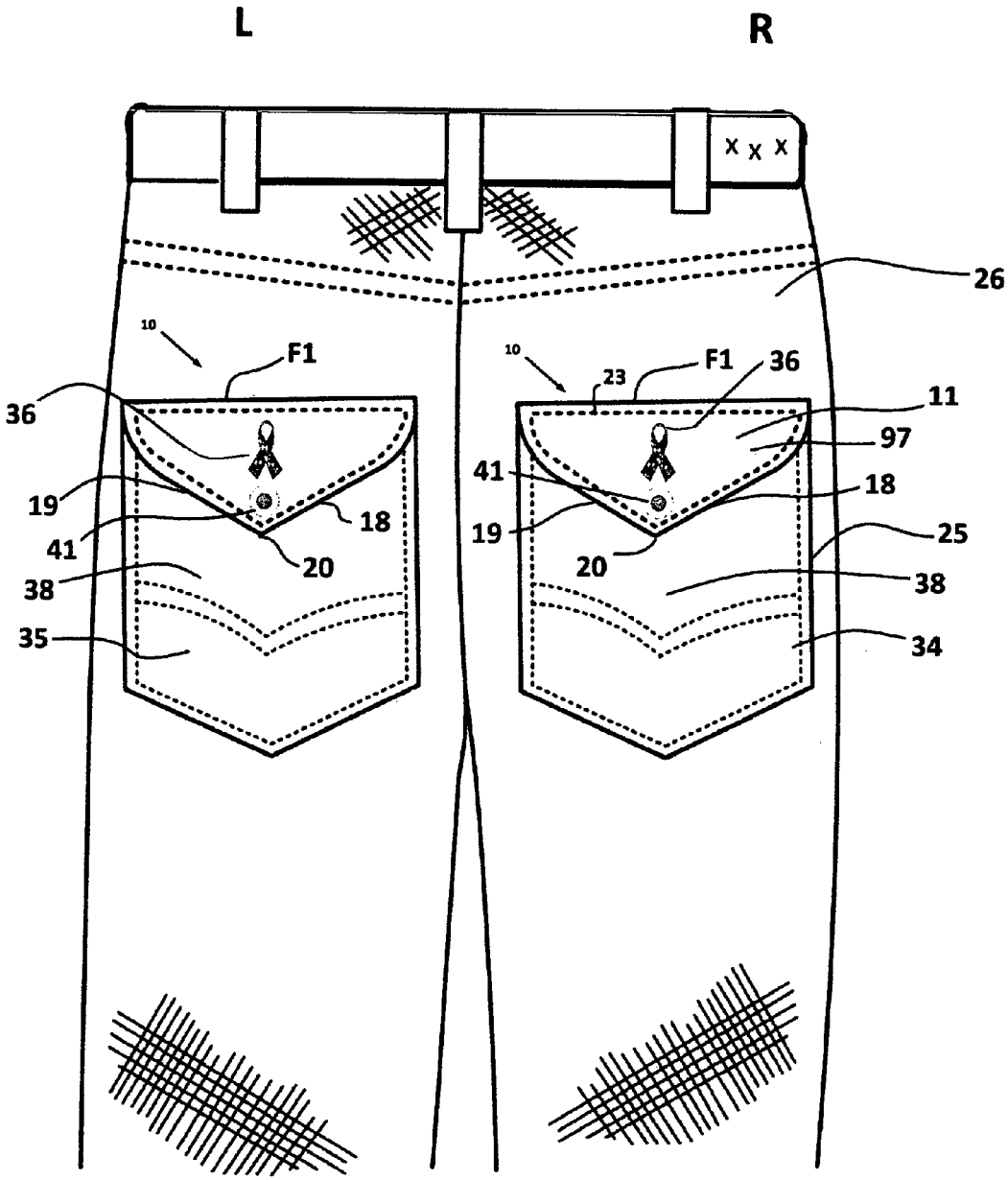
FIG. 22 is a front planar view of the fourth step of installation of a pair of exemplary promotional pocket covers installed upon two rear pockets of preexisting rear jean pockets, with one promotional ribbon affixed on one promotional pocket cover module and a second promotional ribbon affixed on a second promotional pocket cover module. The short dashed lines indicate stitching.

In one embodiment of the present invention, the user may insert a promotional pocket cover 10 comprising only his/her school colors or the user may insert a promotional pocket cover 10 comprising his/her school colors further comprising a mascot during a school sports event, as illustrated in FIGS. 7A, 7B, 8A, 8B, 9 and 10, and therefore promote school spirit, and loyalty to the athletes; and if sold to fans and participants can raise money for a sports booster program. FIG. 9 shows a pair of promotional pocket covers 10 in use removably attached to two rear jean pockets 25. A promotional pocket cover 10 displaying a cougar 51 affixed upon the cover module 11 is shown, and the promotional pocket cover 10 is removably attached with a tack pin 41, where the method of attachment is described in more detail below, to the face 38 of the right rear jean pocket 34; and as shown in phantom in FIG. 10 the insert module 12 of the promotional pocket cover 10 is hidden inside the cavity 31 of the right rear jean pocket 34. Referring back to FIG. 9 a promotional pocket cover 10 displaying the word "STADIUM" 40 is affixed to the cover module 11 of the promotional pocket cover 10; and the promotional pocket cover 10 is removably attached with a tack pin 41, where the method of attachment is described in more detail below, to the left rear jean pocket 35. Again, with reference to FIG. 10 the insert module 12 of the promotional pocket cover 10 is shown in phantom illustrating the insert module 12 hidden inside the cavity 31 of the left rear jean pocket 35. Furthermore, the user may remove the sporty promotional pocket cover 10 from the wearer's jean pocket 25 and replace it with a different promotional pocket cover 10, for example one with an Autism ribbon 36, affixed on the cover module 11, as illustrated in FIG. 22 in the same jean pockets 25, without the burden of purchasing another pair of jeans 26. Or as illustrated in FIG. 11 the promotional pocket covers 10 with the promotional ribbons 36 can be removably attached to the front jean pockets 32 and 33. The promotional pocket cover 10 can then be installed upon a jean pocket 25 of the same pair of jeans 26 or can be transferred to a different pair of jeans 26 by the user during a charitable fund raiser, to raise awareness, knowledge, and contributions. As illustrated in FIGS. 9, 10, 11, 17, 18, 22, 25(*d*), 26(*d*) and 41, the promotional adornment 40 is displayed when the cover module 11 is folded downward over the top edge 27of the jean pocket 25 where the cover module 11 further covers a portion of the face 38 of the jean pocket 25.

Therefore, the promotional pocket covers 10 as shown in FIGS. 7A and 7B, 9, and 11 enables a wearer to display and promote school spirit and loyalty, or dedication to a specific cause dear to the wearer by using the promotional pocket covers 10 installed in jean pockets 25 and promotes recognition, and awareness to viewers.

One of the main objectives of the promotional pocket cover 10 is that the promotional pocket cover 10 can be removably attached to a preexisting jean pocket 25 and detached from a preexisting jean pocket 25 instantaneously and easily as needed or desired by the user and easily transferred and removably attached to another pair of jeans 26 or replace with a different promotional pocket cover 10. Different sports teams can be represented and displayed, or different charitable organizations, or different specific causes can be represented and displayed, or any specific cause, or any design of any nature, and any construction, and origin, can be used on the promotional pocket cover 10 according to the present invention, such that the promotional pocket cover 10 carried on a given jean pocket 25 and the designs of those pockets 25, can be varied at will to satisfy the desires or needs of the user. Examples of various promotional adornments 40 which can be affixed to promotional pocket covers 10 are shown in FIGS. 12 to 16. In addition, the promotional pocket cover 10 can be easily and conveniently disengaged from the jean pocket 25 when it is necessary or desired to wash the promotional pocket cover 10 separately from the jeans 26.

Figure 12B:
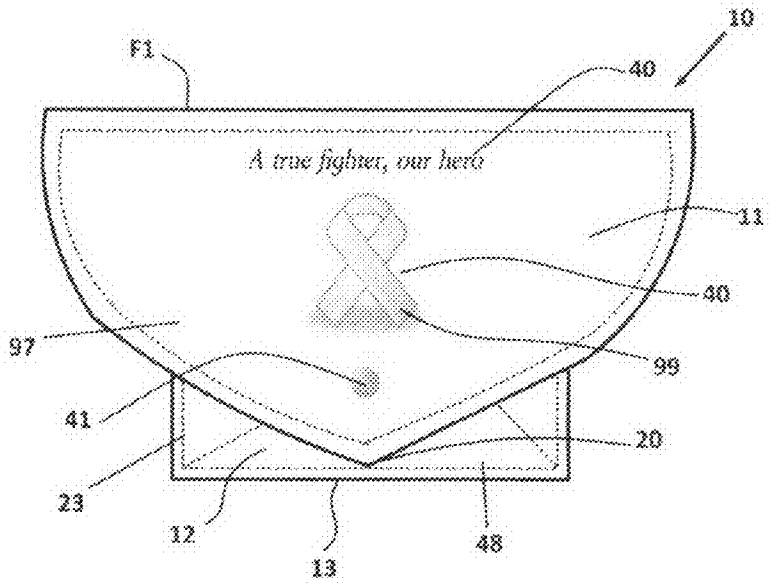
FIG. 12A and FIG. 12B illustrates a pair of exemplary pair of promotional pocket covers with FIG. 12A showing the promotional adornment of a yellow heart affixed on the cover module and the words "Marvelous Matt".
Figure 12A:
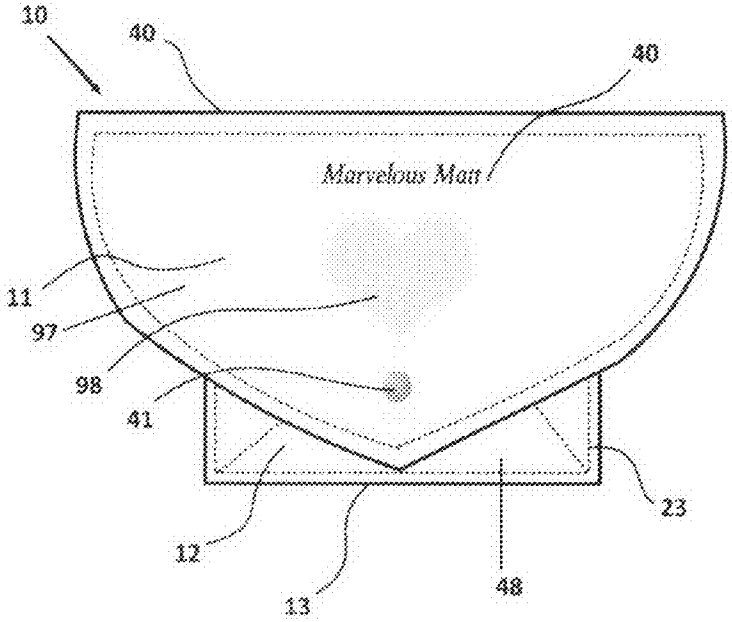

FIGS. 12A and 12B illustrate a pair of exemplary promotional pocket covers 10 with FIG. 12A showing the promotional adornment 40 of a yellow heart 98 affixed on the cover module 11 and the words "Marvelous Matt" 40 and FIG. 12B shows a promotional adornment 40 of a yellow ribbon 99 and the words "A true fighter, our hero" 40 affixed to the cover module 11 of the second promotional pocket cover 10. In addition, FIGS. 12A and 12B shows a modification to the curvilinear side edges 18 and 19 of the cover module 11 of the promotional pocket covers 10, as earlier shown in FIG. 1.

Figure 13B:
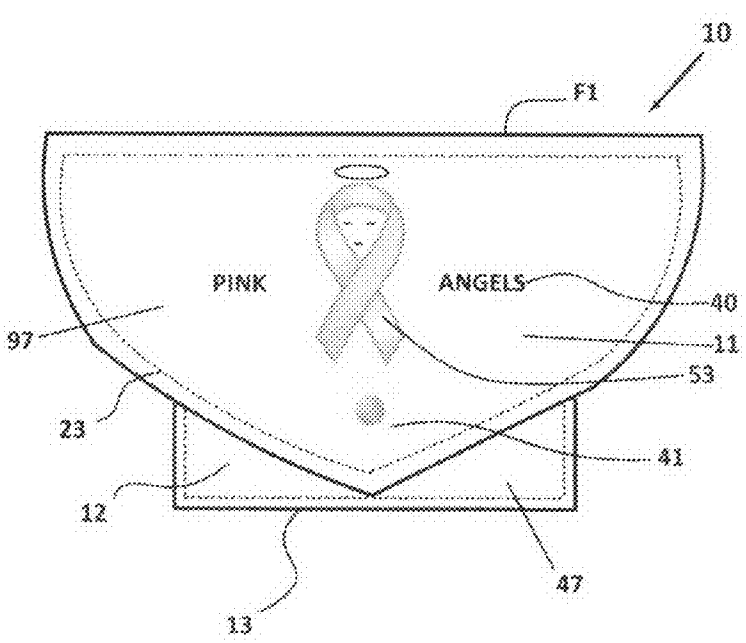
FIG. 13A and FIG. 13B illustrates a front planar view of a pair of exemplary promotional pocket covers with FIG. 13A showing the promotional adornment of a pink ribbon affixed on the cover module on one promotional pocket cover.
Figure 13A:
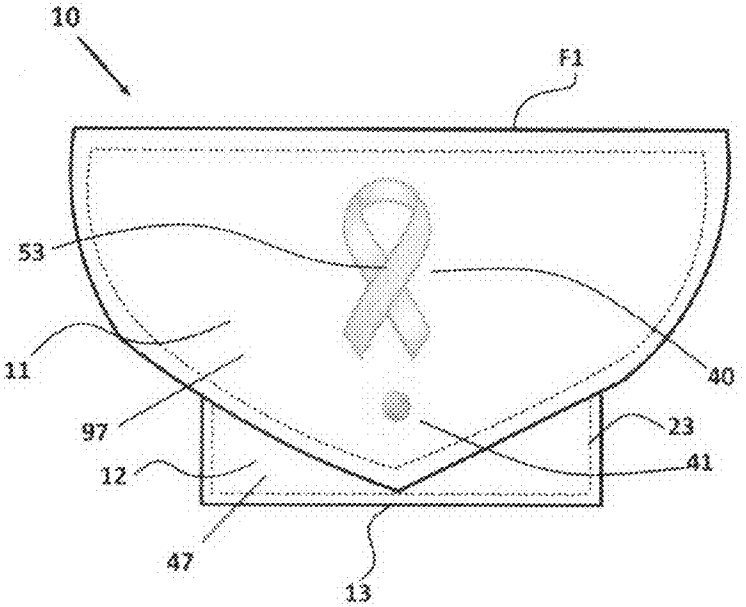

FIG. 13A and FIG. 13B illustrates a front planar view of a pair of exemplary promotional pocket covers 10 with FIG. 13A showing the promotional adornment 40 of a pink ribbon 53 affixed on the obverse side 97 of the cover module 11 on one promotional pocket cover 10. FIG. 13 B shows a promotional adornment 40 of the words "Pink Angel™" affixed on the obverse side 97 of the cover module of the second promotional pocket cover 10 along with a pink ribbon 53 with an image of a face and a halo. In addition, FIGS. 13A and 13B shows a modification to the curvilinear side edges 18 and 19 of the cover module 11 of the promotional pocket covers 10, as earlier shown in FIG. 1.

Figure 14B:
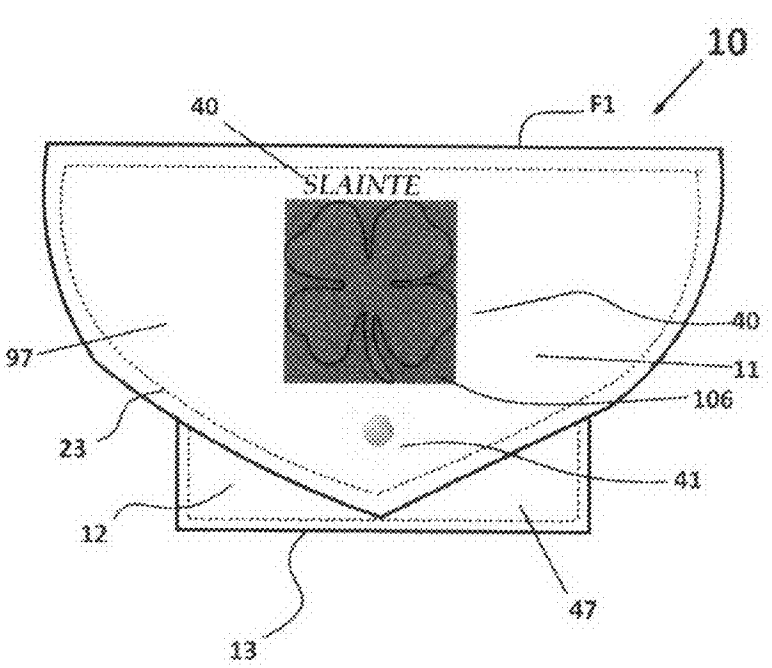
FIG. 14 A and FIG. 14 B illustrates a front planar view of a pair of exemplary pocket covers with FIG. 14 A showing the promotional adornment of a green shamrock affixed on the cover module on one promotional pocket cover.
Figure 14A:
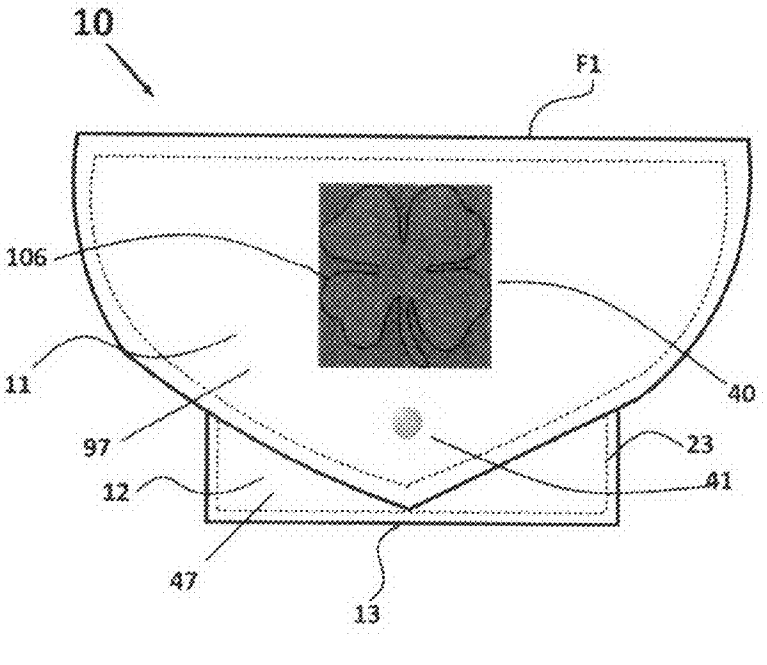

FIG. 14 A and FIG. 14 B illustrates a front planar view of a pair of exemplary pocket covers 10 with FIG. 14 A showing the promotional adornment 40 of a green shamrock 106 affixed on the obverse side 97 of the cover module 11 on one promotional pocket cover 10. FIG. 14 B shows the word "SLAINTE" 40 affixed on the obverse side 97 of the cover module 11 of the second promotional pocket cover 10. In addition, FIGS. 14A and 14B shows a modification to the curvilinear side edges 18 and 19 of the cover module 11 of the promotional pocket covers 10, as earlier shown in FIG. 1.

Figure 15B:
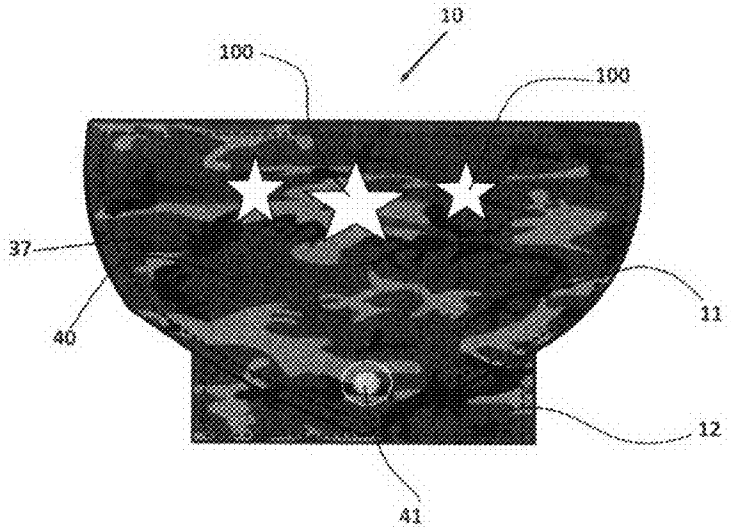
FIG. 15A and FIG. 15B illustrates a front planar view of a pair of exemplary pocket covers with FIG. 15A showing the promotional adornment of a promotional pocket cover made from camouflage material.
Figure 15A:
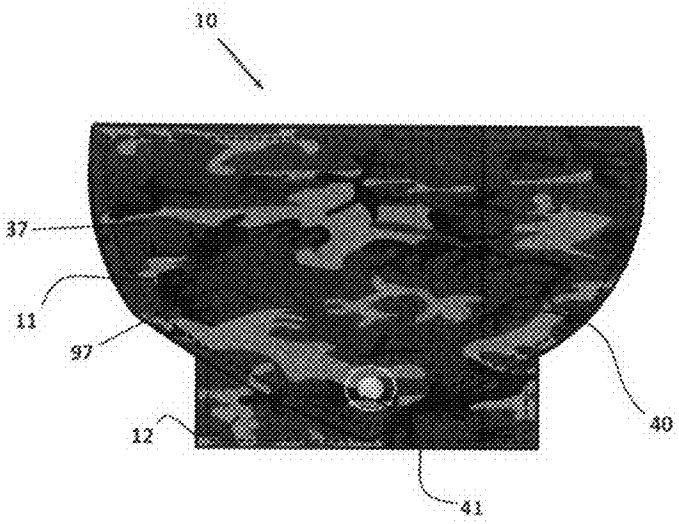

FIG. 15A and FIG. 15B illustrates a front planar view of a pair of exemplary pocket covers 10 with FIG. 15A showing the promotional adornment 40 of a promotional pocket cover 10 made from camouflage material 37. FIG. 15B shows promotional adornments 40 of stars 100 affixed on the obverse side 97 of the cover module 11 on one promotional pocket cover 10 made with camouflage material 37. As shown in FIGS. 15A and 15B, the selected material to manufacture the promotional pocket cover 10 may already include various designs and colors impregnated therein, or painted, or silk screened, and the like, and still remain in the spirit of the present invention, as illustrated in FIGS. 15 A and B, which shows a promotional pocket cover 10 manufactured using camouflage 37 material. In addition, FIG. 15B shows a promotional pocket cover 10 manufactured with camouflage 37 material and further adorned with stars 100. In addition, FIGS. 15A and 15B shows a modification to the curvilinear side edges 18 and 19 of the cover module 11 of the promotional pocket covers 10, as earlier shown in FIG. 1.

Figure 16B:
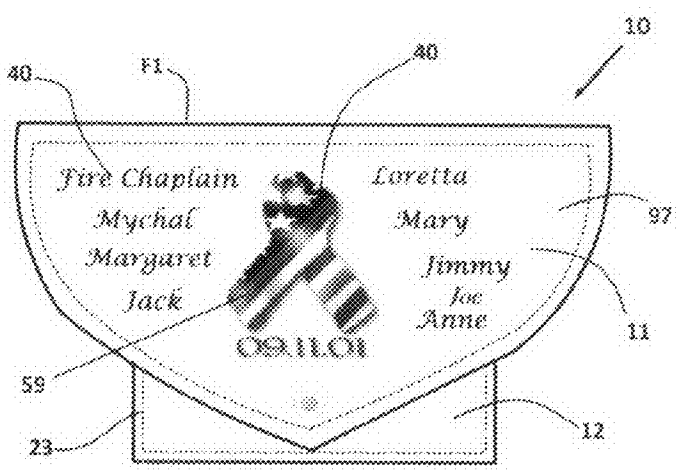
FIG. 16A and FIG. 16B illustrates a front planar view of a pair of exemplary pocket covers with FIG. 16A showing the promotional adornment of a red, white, and blue ribbon and the date "09.11.01 along with the words "FALLEN HERO" affixed on the cover module of the promotional pocket cover.
Figure 16A:
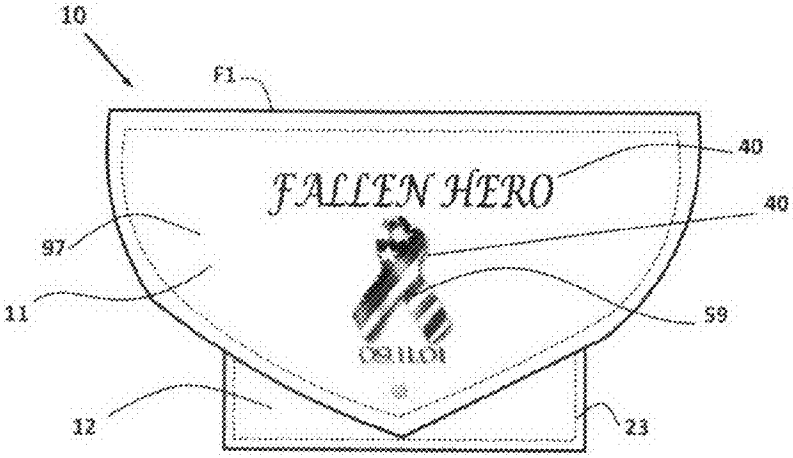

FIG. 16A and FIG. 16B illustrates a front planar view of a pair of exemplary promotional pocket covers 10 with FIG. 16A showing the promotional adornment 40 of a red, white, and blue ribbon 59 and the date "09.11.01" 40 along with the words "FALLEN HERO" 40 affixed on the obverse side 97 of the cover module 11 of the promotional pocket cover 10. FIG. 16B shows and a second promotional pocket cover 10 with a red, white, and blue ribbon 59 and the date "09.11.01" 40 affixed on the obverse side 97 of the cover module 11, and shown with names 40 also affixed on the obverse side 97 of the cover module 11 of the second promotional pocket cover 10. In addition, FIGS. 16A and 16B shows a modification to the curvilinear side edges 18 and 19 of the cover module 11 of the promotional pocket covers 10, as earlier shown in FIG. 1.

Thus, in the preferred embodiment of the present invention, a wearer-selectable promotional pocket cover 10 is utilized as an article of manufacture to prominently display a variety of promotional adornments 40 removably upon a preexisting jean pocket 25, and/or interchangeable among many pairs of jeans 26 or garments, but does not comprise the jean 26 itself, therefore, maintaining the original integrity of the jeans 26 and overcoming the burden of acquiring a variety of jeans 26 which display a promotional adornment 40 of an individual's favorite sport or charitable organization, or special cause, and/or the like.

The cover module 11 of the promotional pocket cover 10, according to the preferred embodiment of the present invention, includes a specific triangular shaped configuration having curvilinear sides, as illustrated in FIGS. 1, 2, 3, 4, 5, 6A, 7A, 7B, 8A, 8B, 9, 10, 11, 12-16, and 23-26, which, itself, is associated with a specific configuration of a cover of a preexisting jean pocket 25. In another embodiment of the present invention, the configuration of the cover module 11 of the promotional pocket cover 10 may be configured and selected to a specific predetermined configuration associated with the needs or desires of the individual wearer, for example, the cover module 11 may be rectangular, trapezoid, or any geometric shape, or heart shapes, or any contoured side, and still remain within the scope and spirit of the present invention. It should be understood that the promotional pocket covers 10, of the present invention, may be constructed using a variety of materials, fabrics, cloths, broadcloths, physical shapes, and sizes, and decorations, and promotional adornments 40, and indicia, as mentioned above, and may vary such that various colors, and designs, and indicia, and words, or absence of words, ranges of angles, and ranges of curves, and contoured edges, may vary in accordance with the needs and desires of the wearer, and still remain within the spirit and scope of this invention and thereby providing a variety of different themes, styles, looks, and shapes to the promotional pocket cover 10.

Examples, of materials that may be used for the promotional pocket cover 10 are, but not limited to any of a plurality of materials, or fabrics, or cloth, or broadcloth, natural or synthetic, which is of sufficient resiliency to allow enhancements to be affixed thereon, and of sufficient suppleness to be folded. The promotional pocket cover 10 can be manufactured from any one of plurality of natural or synthetic fabric materials including any one of cotton, denim, colored denim, dungaree, polyester, linen, leather, corduroy, vinyl, flannel, seersucker, spandex, satine, silk, satin, velvet, felt, velveteen, faux fur, wool, wool blends, rayon, viscose, nylon, banton, cashmere or combinations thereof. Furthermore, the wearer selected material forming the top panel includes any promotional adornment woven therein as being of specific promotional color, promotional print, or promotional design with a logo thereon. The material may include a solid color, or may be of a print, or of a design with a logo or other enhancement imprinted therein. In addition, it would be of a benefit to a sports participant, especially bicyclists and joggers, to manufacture the promotional pocket cover 10 such as ILLUMINATE® which is a retro-reflective technology applied to the surface of the fabric that provides the promotional pocket cover 10 with style in the day and reflectivity at night. In addition, the promotional pocket cover 10 may be made with a glow-in-the dark material, such as a luminous fabric which is provided by LUMIGRAM® which is a fiber optic fabric which would augment a wearer's jeans 26 and heighten a user's fun and lighten up his/her night.

The cover module 11 can also have three-dimensional structure (for example, a three-dimensional seal or medallion). The promotional pocket cover 10 can also comprise an active display device such as graphics display device or digital picture frame, or other incorporated moving or changing elements.

The middle panel 29 of the promotional pocket cover 10 provides a supporting means, preferably pellon. Substitutes for pellon may include any one of silicone, silicone resins, foam rubber material, polyurethane foam, sponges, or any type of material capable of providing staying means and capable of being inserted into a pouch, cavity, receptacle, of a pocket of a garment, or apparel; and capable of being folded.

FIGS. 2, 3, 4, and 17 to 21, illustrate another embodiment of the present invention, which shows an attaching means, preferably a tack pin 23 removably attached proximate to the apex 20 within the cover module 11 which provides an attachment means to removably attach the promotional pocket cover 10 to a preexisting jean pocket 25; and provides an attachment means to prevent the cover module 11 from flipping up or curling or buckling; and provides an attachment means which prevents the promotional pocket cover 10 from falling out of the jean pocket 25 during certain activity. FIG. 3 illustrates the reverse side of the promotional pocket cover 10, as illustrated in FIG. 2, showing the corresponding attachment means of the tack pin 41 which is preferably a butterfly-clutch 43 which provides for an easy and convenient removable attachment means to detach or remove the promotional pocket cover 10 from the jean pocket 25. One of the most popular modern methods of attaching pins is the butterfly clutch 43, sometimes called a military clutch. The back of the tack pin 41 has a pin element 42 attached and when the butterfly clutch 43 is squeezed and pulled up from the pin element 42 the pin element 42 is released from the clutch 43. Butterfly clutches 43 may be made out of metal, plastic, or rubber. In yet further embodiments, the means for removably attaching the promotional pocket cover 10 to a preexisting jean pocket can include any one of pins, snaps, plastic snap strips, hook and eyes, clasps, and hook and loop fastening components. As described below, in FIGS. 24, 25(*a* -*c*), and 25(*a*'-*c*'), hook and loop fastener components 56 are the preferred attachment means for children when attaching the promotional pocket cover 10 to a pocket 25 on a preexisting child's pant garment, preferably a jean pant 26, but not exclusive to.

In addition, the means for affixing promotional adornments 40 to the cover module 11 of the promotional pocket cover 10 can be practiced by using heat transfers, heat press, sewing, embroidery, silk screen, adhesives, hook and loop fastener components, digital photography, computer graphics, photography, glue and/or the like, to the display cover, applied by the wearer, or the manufacturer. Durable adhesives can be used to provide near-permanent attachment.

Method of Installation and Use of Promotional Pocket Cover 10

Figure 17:
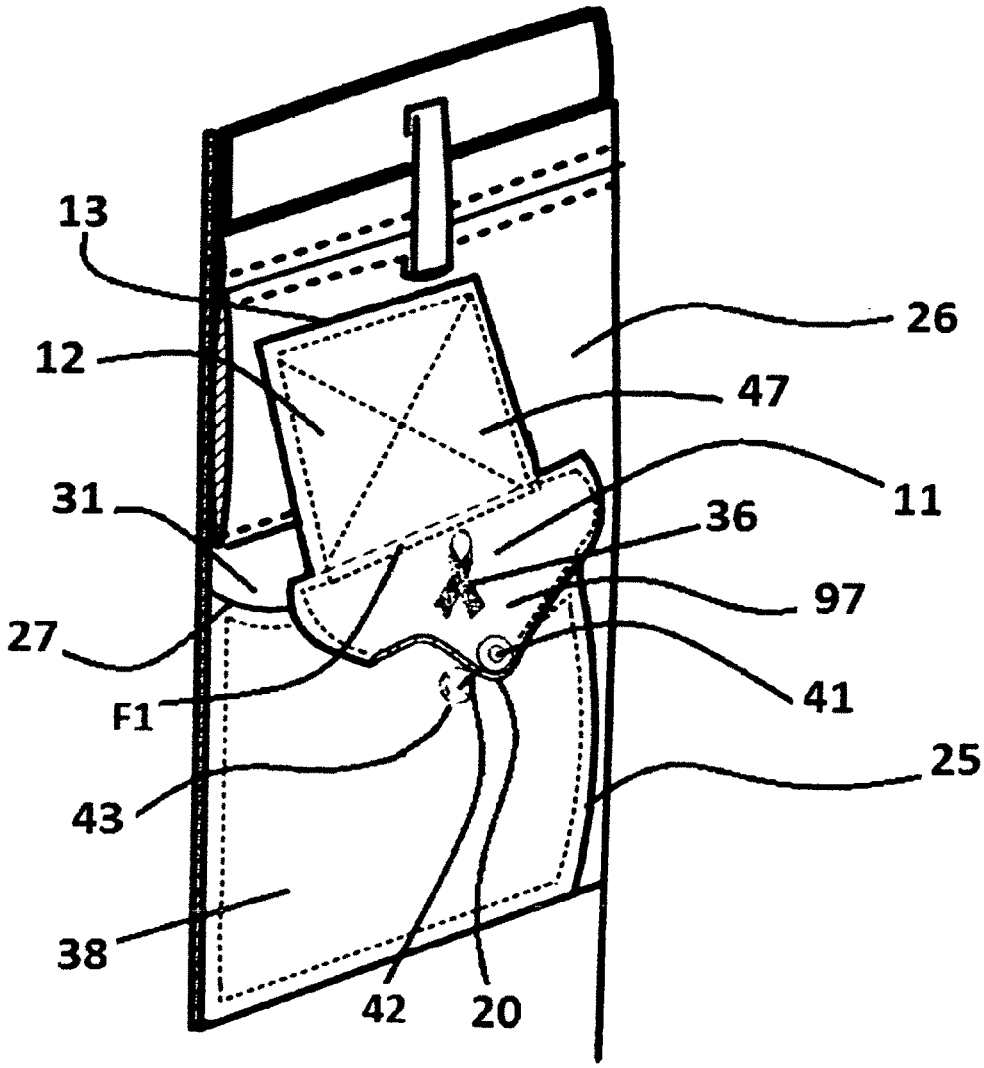
FIG. 17 illustrates a perspective cutaway view of the cover module, showing the first step of installation of a promotional pocket cover on a preexisting rear jean pocket with a tack pin, according to the preferred embodiment of the present invention. The butterfly clutch is positioned behind the front of the jean pocket and is shown in dotted lines for transparency. The short dashed lines indicate stitching.
Figure 18:
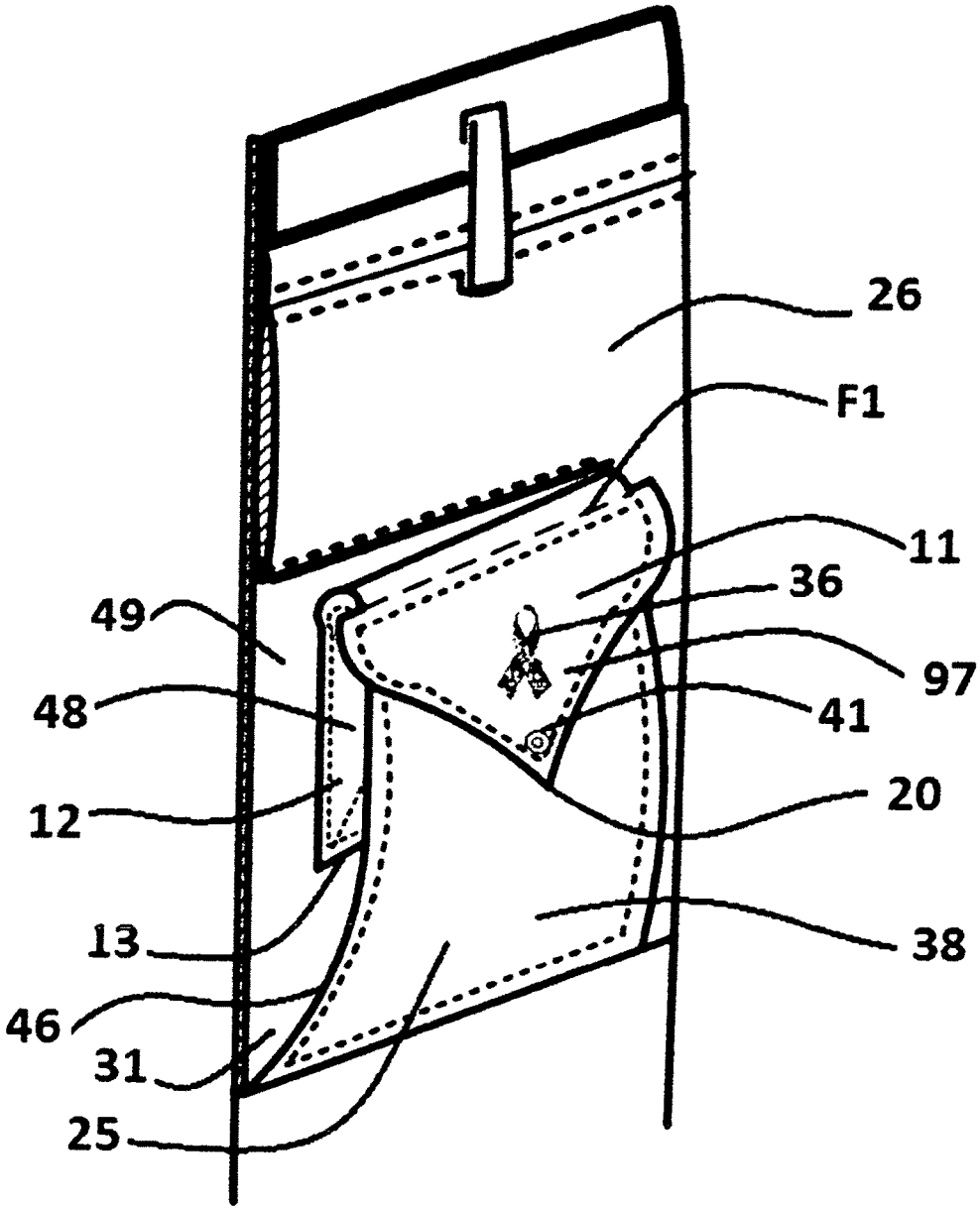
FIG. 18 is a perspective cutaway view of a preexisting rear jean pocket illustrating the second step of installation of the promotional pocket cover, showing the insert module folded and inserted into the interior of a preexisting rear jean pocket. The short dashed lines indicate stitching.

FIGS. 17 to 22 illustrates the method of installation of the promotional pocket cover 10 used with an exemplary preexisting jean pocket 25. For purposes of illustration, the promotional pocket cover 10 is shown in conjunction with a preexisting jean pocket 25 on a pair of jeans 26. The jean pocket 25 and jeans 26 are not claimed as the present invention but are described to assist in the detailed description of the instant invention. Initially at FIG. 17, first step of installation, the promotional pocket cover 10 is maneuvered in a vertical unfolded position having the apex 20 of the cover module 11 pointing downwards and the insert module 12 vertically anterior to the cover module 11. The promotional adornment 40 affixed to the cover module 11 shown is a promotional ribbon 36 which is displayed in the direction of the viewer. Further, as shown in FIG. 17 the cover module 11 is pivotally placed over and upon the outside face 38 of the jean pocket 25 with the cover module 11 aligned to cover a portion of the face 38 of the jean pocket 25 whereon the cover module 11 is desired. The back side 45 of the cover module 11 is positioned against the outside surface of the face 38 of the jean pocket 25. The cover module llis positioned with the apex 20 pointing down and along the face 38 of the jean pocket 25 and maneuvered to cover a portion of the face 38 of the jean pocket 25. The fold line Fl as defined by phantom line Fl is congruent and substantially parallel to the top longitudinal edge 27 of the jean pocket 25, as illustrated in FIGS. 17 and 18.

Figure 19:
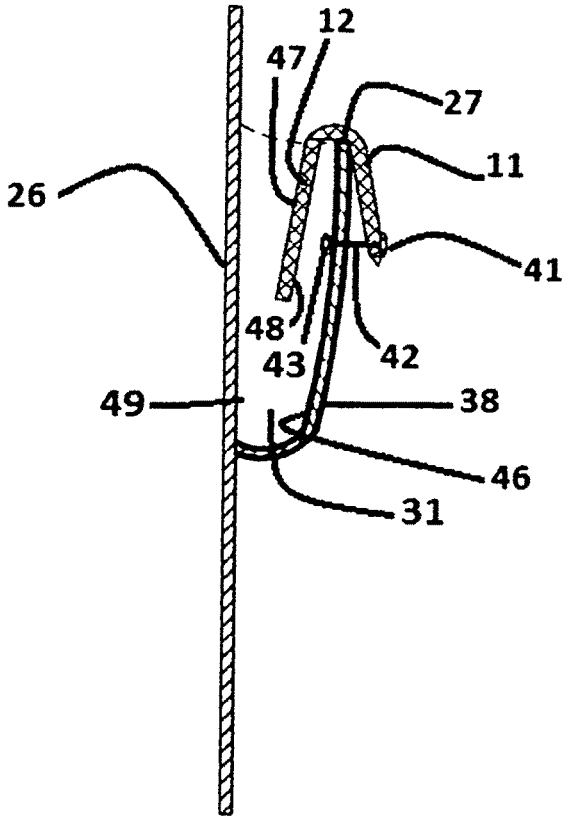
FIG. 19 is a side perspective view as illustrated in FIG. 18 illustrating the second step of installation of the promotional pocket cover into a preexisting rear jean pocket showing the insert module folded and inserted within the cavity of the jean pocket and positioned behind the butterfly clutch; and the cover module extending down over a portion of the face panel of the jean pocket. The short dashed lines indicate stitching.

In order to removably attach the promotional pocket cover 10, and to retain the cover module 11 in the preferred position covering a top portion of the face 38 the jean pocket 25, an attaching means is used, preferably a tack pin 41, as illustrated in FIGS. 1-4, and 17 to 22, and shown more particularly in FIGS. 17 and 19. The tack pin 41 includes a pin element 42 and a corresponding butterfly clutch element 43. Initially, the tack pin 41 is pivotally positioned proximate to the apex 20 of the cover module 11, but not limited to, with the top of the tack pin 41 facing up. The pin element 42 is pierced through the top panel 28 surface of the cover module 11 extending out through to the back side of the back panel 30 surface of the cover module. Thereafter, referring to FIG. 17 the pin element 42 is pushed through the top surface of the face 38 of the jean pocket 25 and referring to FIG. 19 through to reverse side 46 of the jean pocket 25 to removably attach the promotional pocket cover module 11 with the face panel 38 of the jean pocket 25. The tack pin 41 is secured by use of a butterfly clutch 43, one of the most popular modern methods of attaching pins is the butterfly clutch, sometimes called a military clutch. The back of the pin element 42 has a small prong (not shown) attached and when the butterfly clutch 43 is squeezed and pulled up from the prong the pin element 42 is released from the clutch 43. After positioning and removably attaching the cover module 11 to the face 38 of the jean pocket 25 where desired, the butterfly clutch 43, which mates with the pin element 42 of the tack pin 41, is positioned and unaffixed against the inside surface 46 of the jean pocket 25 congruent with the reverse side 46 of the face of the jean pocket 25 ready to receive the corresponding pin element 42 of the tack pin 41. Typically, the wearer holds the butterfly clutch 43 in the needed position to receive the pin element 42 of the tack pin 41 within the interior cavity 31 of the jean pocket 25.

Figure 20:
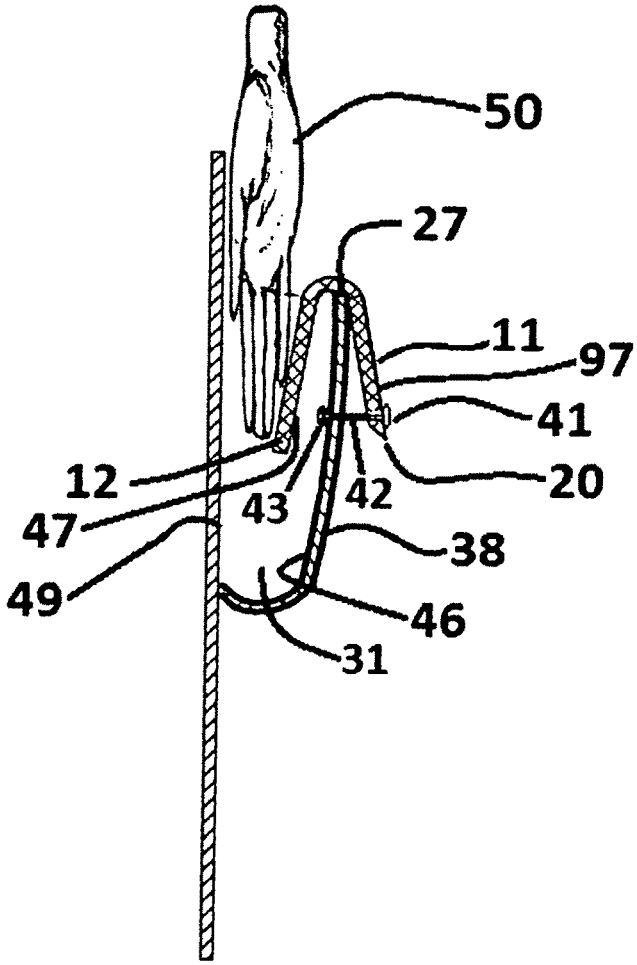
FIG. 20 is a side perspective view of the promotional pocket cover installed upon a preexisting rear jean pocket showing the jean pocket cut away, illustrating a hand inserted into the interior of the jean pocket behind the insert module. The short dashed lines indicate stitching.

FIG. 17, in a cutaway perspective, shows typical placement of the tack pin 41 and butterfly clutch 43 shown in phantom by dotted lines, to illustrate transparently the butterfly clutch 43 positioned behind face 38 of the jean pocket 25 and more particularly, the butterfly clutch 43 is positioned interiorly therein the cavity 31 of the jean pocket 25 congruent to the reverse side of the jean pocket 46, as illustrated in FIGS. 19 and 20. FIG. 17 shows the promotional pocket cover 10 cutaway at the left side of the cover module 11 exposing underlying pin element 42 of the tack pin 41 that has entered through the material of the cover module 11 and the butterfly clutch element 43 ready positioned behind the jean pocket 25 (wearer's hand not shown) to be engaged with the corresponding pin element 42 piercing through the back side of the cover module 11.

Further, upon installation of the insert module 12 of the promotional pocket cover 10 into the cavity 31 of a jean pocket 25, the tack pin 41 provides a means to temporarily removably attach the promotional pocket cover 10 with the pocket 25 of the jeans 26 and retain desired alignment of the promotional pocket cover 10. With such a configuration, almost zero relative movement can occur between the promotional pocket cover 10 and the jean pocket 25, particularly when the user is wearing the jeans 26.

In addition, the tack pin 41 can be wearer-selectable, preferably affixed with the inventor's logo, or manufacturer's logo, or initials, or moniker, or coat-of arms, or can be selected from a variety of colors, designs, and logos, and therefore provides a promotional embellishment to the promotional pocket cover 10. It is understood that while a particular configuration of the placement of the tack pin 41 including the inventor's logo or manufacturer's logo is for exemplary purposes only, and that any configuration of placement of the tack pin 41 with logo that serve to be aesthetic or promotional are considered within the scope of this disclosure and its associated claims.

Other attaching means may be used, such as hook or loop fasteners or pin fasteners, or locking lapel bar pins, or snaps, or plastic snap strips, or buttons, or hook and eyes.

As illustrated in FIG. 18, step 2 of installation of the promotional pocket cover 10, after attaching the cover module 11 to the face 38 of the jean pocket 25 in the preferred position, the insert module 12 is folded 180° downward and inserted into the interior cavity 31 of the jean pocket 25 with the back side 47 of the insert module 12 congruent with the butterfly clutch 43 and with the top side 48 of the insert module 12 congruent with the material of the jean garment which forms the back wall 49 of the jean pocket 25 such that the insert module is between the back wall 49 of the jean pocket 25 and the butterfly clutch 43. Further, FIG. 18 shows a cut away section of jean pocket 25 showing the cover module 11 removably attached to the face 38 of the jean pocket 25 with a tack pin 41; and the insert module 12 is folded 180° downward over the top edge 27 of the jean pocket 25 and inserted into the interior cavity 31 of the jean pocket 25.

The cut away in FIG. 19, step 3 of installation of the promotional pocket cover 10, and 20 illustrates the underlying pin element 42 that has entered throughin the material of the cover module 11 and is now locked into position with the corresponding butterfly clutch 43 which is positioned unaffixed on the reverse side 46 of the jean pocket 25. More particularly, the insert module 11 is placed over the butterfly clutch 43 providing a cushioning means between the material wall 49 of the back of the jean pocket 25 and the butterfly clutch 43; and the insert module 12 provides an anchoring means to correctly orient the cover module 11 upon the jean pocket 25.

FIGS. 19 and 20 illustrates a cross section of a jean pocket 25 and the promotional pocket cover 10 showing the insert module 12 can be inserted into jean pocket 25 with the cover module 12 folded downward flat against the face 38 of the jean pocket 25 where the insert module 12 is hidden from view. Further, as illustrated in FIG. 19, a side perspective view of step 2 of installation of the promotional pocket cover 10, the insert module 12 is folded downward into the interior cavity 31 of the jean pocket 25 behind the butterfly clutch 43 completely engaged with the pin element 42 of the tack pin 41, and further showing butterfly clutch 43 between the insert module 12 and the reverse side 46 of the jean pocket 25. With this configuration, the functionality of the jean pocket 25 is maintained, as shown more particularly in FIG. 20, the wearer is able to reach his/her hand 50 into the cavity 31 of the jean pocket 25 to put in or take out items and without the risk of disturbing the position of the promotional pocket cover 10 or the butterfly clutch 43.

Figure 21:
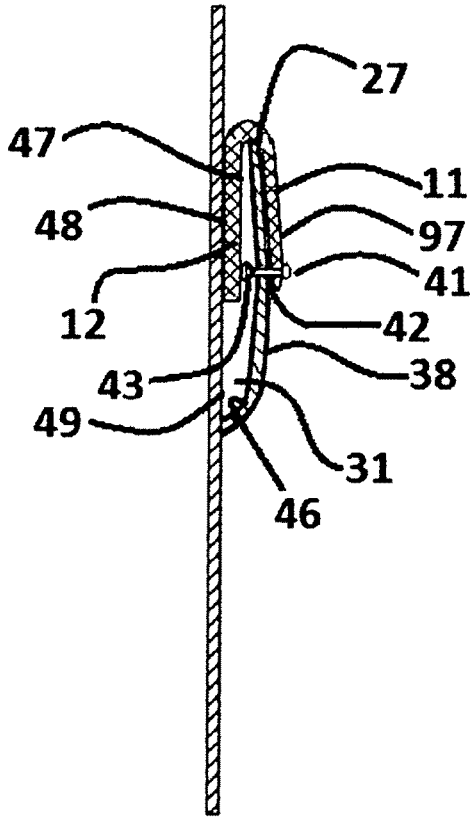
FIG. 21 is a side perspective view of the promotional pocket cover showing the third step of installation of a promotional pocket cover on a preexisting jean pocket showing the insert module inserted in the interior of the jean pocket behind the butterfly clutch; and the cover module folded over the edge of the jean pocket and extending down over a portion of the jean pocket. The short dashed lines indicate stitching.

FIG. 21 illustrates the promotional pocket cover 10 installed on a preexisting jean pocket 25, the final step of installation. The promotional pocket cover 10 can be heat pressed which is desirable because it presses the folded promotional pocket cover 10 along the fold line F1 which rests upon the edge 27 of the jean pocket 25, as illustrated in FIG. 21 and presses the cover module 11 so that it rests flat upon the face panel 38 of the jean pocket 25.

The locking tack pin 41 with butterfly clutch 43 are preferred for use as the attachment device since these are easily removed from the preexisting jean pocket 25 when the wearer needs or desires to revert to using the jean pocket 25 without the present invention, or, more particularly, if the wearer needs or desires to use a different promotional pocket cover 10 having a different promotional adornment 40 affixed on the cover module 12 or if the wearer desires or needs to transfer or interchange the promotional pocket cover 10 to another pair of jeans 26. For example, a promotional pocket cover 10 may have a promotional adornment 40, such as a cougar 51, affixed on the top panel 28 of the cover module 11, as illustrated in FIGS. 7A, 8, 9 and 10, or a promotional pocket cover may have a promotional adornment 40, such as a pink ribbon 53 associated with breast cancer affixed to the cover module 11, as illustrated in FIGS. 13A and 13B. The promotional pocket covers 10 are, therefore, easily and conveniently transposable with each other using the same pair of jeans 26; and the promotional pocket covers 10 are readily interchangeable with other promotional pocket covers 10 having different promotional adornments 40 affixed thereon; and are easily and conveniently removably attachable within pockets 25 of the same pair of jeans 26 or with pockets 25 of other pairs of jeans 26; and therefore can be readily transferred and reattached to a jean pocket 25 on the same pair of jeans 26, or other pairs of jeans 26, and therefore used many times, over, and over again, as needed or desired by the wearer, using the same pair of jeans 26 or other pairs of jeans 26.

Thereafter, as shown in FIG. 22 the cover module 11 is folded revealing the promotional adornment 40, shown represented by a promotional ribbon 36 affixed to the obverse side 97 of the cover module 11 of the promotional pocket cover 10. FIG. 22 shows an exemplary pair of promotional pocket covers 10 in use inserted into two rear jean pockets 34 and 35, and shows the insert module 12 in phantom, defined by long dashed lines 39 for transparency, to demonstrate the insert module 12 which is concealed inside the rear right jean pocket 34 and the left rear jean pocket 35. The insert module 12 of the promotional pocket cover 10 is inserted into the cavity 31 of the right rear jean pocket 34, such that upon folding of the promotional pocket cover 10 along fold line Fl over the top edge 27 of the right rear jean pocket 34, the cover module 11 orients in the correct direction displaying the promotional enhancement 40, shown represented by an promotional ribbon 36. The same steps are repeated for the rear left jean pocket 35 revealing the promotional adornment 40, shown represented by the puzzle promotional ribbon 36.

A wearer-selectable promotional pocket cover 10 can be removably attached to a wearer's jean pocket 25, many times by merely disengaging the tack pin 41 and thereby detaching the cover module 11 from the front wall 55 of the jean pocket 25 and sliding the insert module 12 in and out of the cavity 31 of the jean pocket 25. Furthermore, an additional promotional pocket cover 10 can be removably attached to a second jean pocket 25 on the same jeans 26 to enable a wearer to display a pair of corresponding and transposable promotional pocket covers 10, as illustrated in FIGS. 9, 10, 11, and 22.

In alternative embodiments, attachment means may be affixed to the promotional pocket cover 10 and the preexisting jean pocket 25 by use of other attachment means, for example, sewing, ironing with suitable heat-activated adhesive, safety pins, snaps, hook and eyes, plastic snap strips, or gluing, or by using buttons. Each of these alternative embodiments, however, is more permanent than the use of tack pins 41, and is not as readily removed if it is desired to revert to using the jean pocket 25 without the promotional pocket cover 10 or using a different promotional pocket cover 10 which may be needed or desired by the wearer.

An important benefit of the present invention is to allow an infinite variety of promotional pocket covers 10 to be used in connection with any given preexisting jean pockets 25, or garment pockets, or apparel pockets. Referring to FIGS. 9, 10, 11, 22, and 25(*d*), a promotional pocket cover 10 is shown in use inserted into a left rear jean pocket 35; and a promotional pocket cover 10 is shown, as used, inserted into a rear right jean pocket 34, according to the preferred embodiment of the present invention. The two promotional pocket covers 10 are transposable and complimentary to each other and can constitute a pair of promotional pocket covers 10 typically used by the wearer with one pair of jeans 26, according to the preferred embodiment of the present invention. With reference to FIG. 9 the promotional pocket cover 10 is shown in use, with a promotional adornment 40 affixed within the cover module 11, represented by the word "STADIUM" 52, inserted into a rear left jean pocket 35; and the promotional pocket cover 10 is shown in use inserted into a right rear jean pocket 34 with a promotional adornment 40 affixed represented by an image of a cougar 51. The two promotional pocket covers 10 are transposable and complimentary to each other and can constitute a pair of promotional pocket covers 10. It is noteworthy, that each of the promotional pocket covers 10 within the pair is transposable with each other, and can be inserted into either of the rear jean pockets 34 and 35, or either of the front jean pockets 32 and 33. Therefore, one of the main objectives of the promotional pocket cover 10 is that the promotional pocket cover 10 can be removably attached to a preexisting jean pocket 25 and detached from a preexisting jean pocket 25 instantaneously and easily as needed or desired by the user, and transferred to another pair of jeans 26, or interchanged with a different pair of promotional pocket covers 10. Different sports teams can be represented and displayed, or different charitable organizations, or different special causes can be represented and displayed, or any special cause, or any design of any nature, and any construction, and origin, can be used on the promotional pocket cover 10 according to the present invention, such that the promotional pocket cover 10 carried on a given jean pocket 10 and the designs of those pockets, can be varied at will to satisfy the desires or needs of the user.

In the alternative, FIGS. 4 and 5A illustrates another embodiment of the present invention, showing the cover module 11 of the promotional pocket cover 10 having no promotional adornments 40 affixed, formed, coupled, or applied, thereon. As illustrated in FIG. 15 the promotional adornment 40 is the material used to form the promotional pocket cover 10, for example as shown, camouflage material 37.

In the preferred embodiment, promotional adornments 10 are permanently affixed, or integrated, upon the cover module 11 of the promotional pocket cover 10 and, thereby, upon installing the promotional pocket cover 10 onto the preexisting jean pocket 25 the promotional adornment 40 is displayed towards a viewer to promote recognition, awareness, support, loyalty, passion, and dedication for that specific cause. Such promotional adornments 40 may include indicium, embellishments or inspirational or motivational slogans, ribbons, buttons, mascots, team logos, team colors, images, names, numbers, letters, initials, monograms, monikers, coat-of arms, family crest, publicity, symbols, embroidery, rhinestones, rivets, patches, stitching, ink, paint, sequins, feathers, jewelry, precious metals, studs, or other decorations, or promotional images or messages, or special timely messages, and the like, and which are readily identifiable with, or associated with, at least one specific cause, charitable organization, or non-profit organization, or fund raising campaign, or sports team, or sports league, or amateur sports team, or sports affiliation, or NASCAR®, or medical needs group, or commercial entity, or a special needs group, or military organization, or public figure, or personal figure, or a media event, or public event, or personal event, or animal, or holiday, or college, or university, or high school, or an automobile racing series, or an automobile racing team, or church, or club, or company, or department, or political party, or candidate, or issue, or interest group, or publicity event, or any specific cause.

Figure 41:
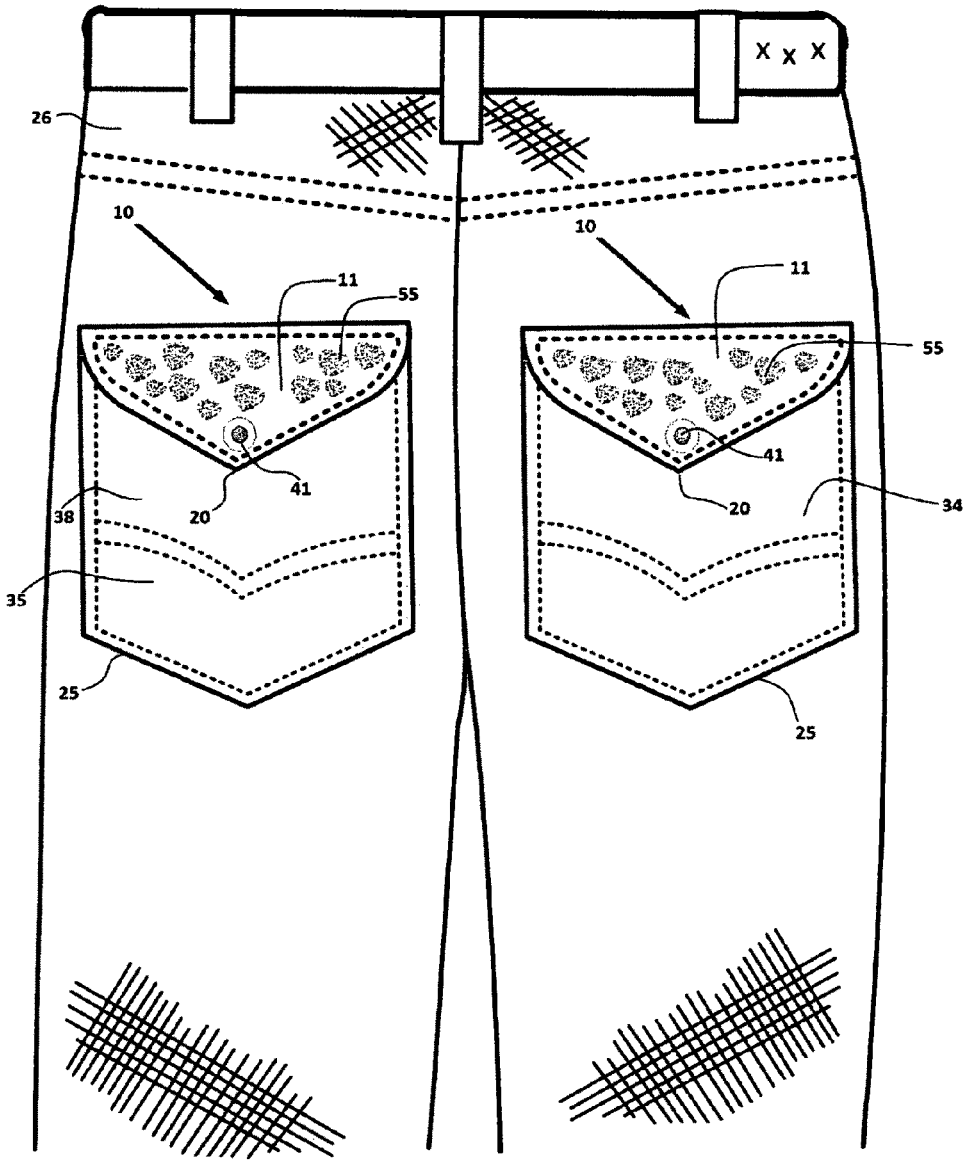
FIG. 41 is a planar view of another embodiment of the present invention illustrating rhinestones as adornments affixed to the cover modules of a pair of promotional pocket covers inserted into rear jean pockets.

In addition, in another embodiment of the present invention, the promotional adornment 40 may merely be one of decorative nature to provide an enhancement or embellishment to a preexisting pair of jeans 26, referring forward to FIG. 41, which illustrates a pair of promotional pocket covers 10 affixed with rhinestones 55 upon the cover module 11.

Figure 23A:
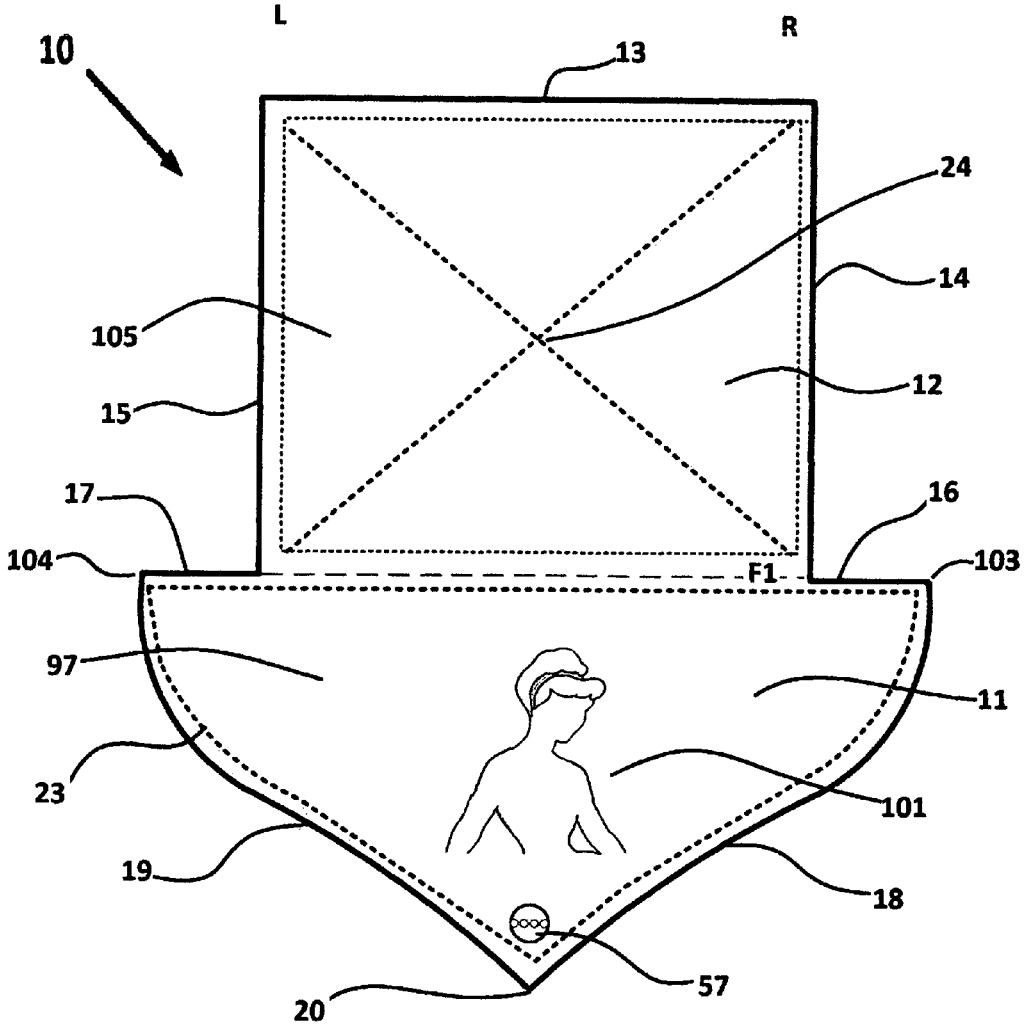
FIG. 23A is a front planar view of an exemplary promotional pocket cover preferably for children, showing an image of a princess affixed on a cover module and showing a button affixed thereon. The short dashed lines indicate stitching.
Figure 23B:
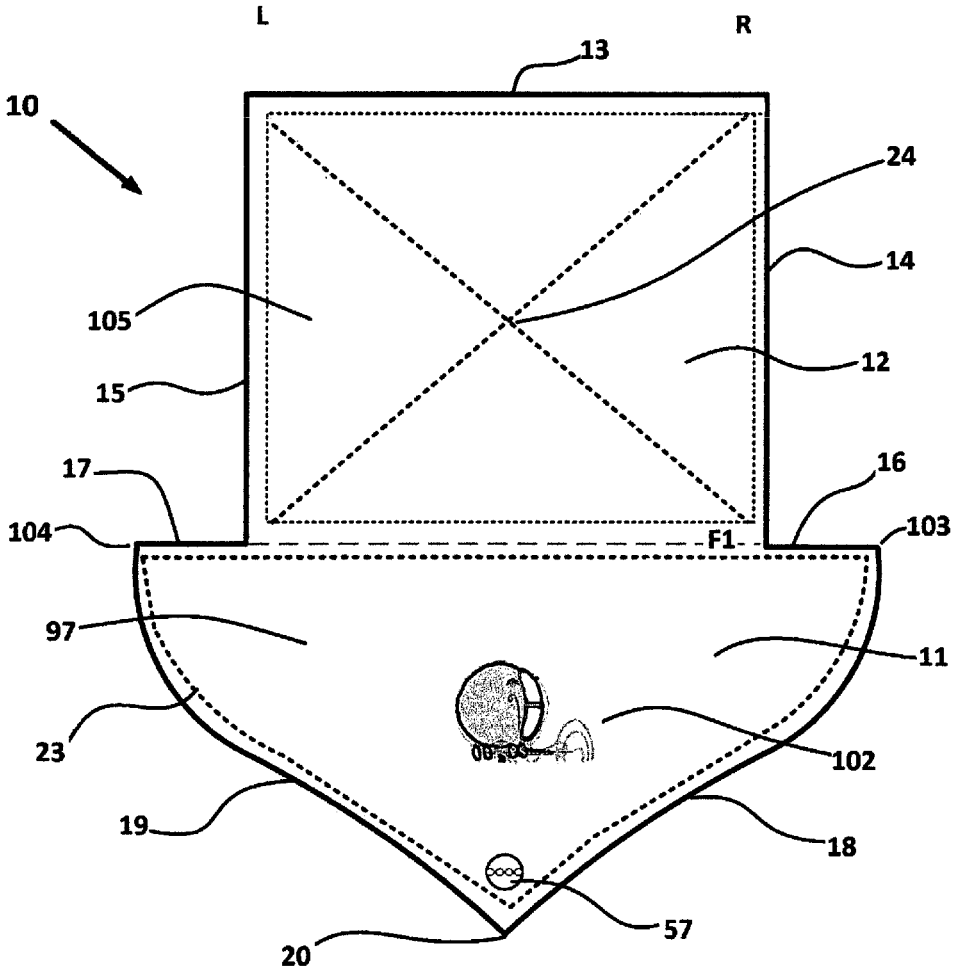
FIG. 23B is a front planar view of an exemplary promotional pocket cover complementary and transposable with the promotional pocket cover as illustrated in FIG. 23 A showing a an image of a coach. The short dashed lines indicate stitching.

In another embodiment of the present invention, preferably modified for children, as shown in FIGS. 23 and 24, the attachment means can be hook and loop fastener components 56 as illustrated in FIGS. 24, 25(*a*)-(*d*), 25(*a*'-*d*'), and 26(*a*)-(*d*). As shown in FIGS. 23A and 23B, a button 57 is affixed proximal to the apex 20 of the cover module 11, in place of the tack pin 41, as described above. The button 57 is used as an embellishment or decoration, and not as an attachment means, because of the risk of the tack pin 41 compromising the child wearer. The button 57 is attached to the obverse surface side 97 of the cover module 11 with thread and sewn proximal to the apex 20 of the cover module 11 throughin the three layers 28, 29, and 30 of the promotional pocket cover where the affixing stitches 58 to the button 57 are revealed on the surface side of the back panel 30 of the promotional pocket cover 10, as shown in FIG. 24. Further, as shown in FIG. 24, a hook and loop fastener component 56 is permanently attached to the ventral side 48 of the insert module 12 of the promotional pocket cover 10, and further shown in FIGS. 25 (*a*-*b*) and 25 (*a*'-*b*'). More particularly, as shown in a side perspective view illustrated in FIG. 26(*a*)-(*d*), a piece of hook and loop fastener component 56 is adhesively attached to the ventral side 48 of the insert module 12 and a corresponding piece of hook and loop fastener component 56 is attached to the reverse side wall 46 of the preexisting jean pocket 25 face panel 38; and shown in phantom in FIG. 25 (c). The method of installation of the promotional pocket cover 10, particularly for children, comprise the following steps, as illustrated in FIG. 25(*a*)-(*d*) for a left jean pocket 35; and FIG. 25(*a*')-(*d*') for a right 34 jean pocket; and shown in FIG. 26(*a*)-(*d*) in a side perspective view for further clarity. Initially, upon removably attaching the promotional pocket cover 10 with the preexisting jean pocket 25, the first step, as shown in FIG. 25(*a*) and FIG. 25(*a*') and in a side perspective view in FIG. 26(*a*), where the promotional pocket cover 10 is unfolded and maneuvered in a vertical position with the apex 20 of the cover module 11 pointing up, and the insert module 12 vertically posterior therewith, and with the piece of hook and loop fastening component 56 facing out. FIG. 25(*b*) and FIG. 25(*b*') illustrates the partial folding of the promotional pocket cover 10 showing the promotional adornment 40 of the princess 101 character affixed to the cover module 11 facing out towards the viewer. FIGS. 25(*c*), 25(*c*') and 26(*b*) shows the second step where the jean pocket 25 having a piece of corresponding hook and loop fastener component 56 affixed to the wall of the reverse side 46 of the face panel 38 of the jean pocket 25. Thereafter, the third step of installation, as shown in FIGS. 25(*c*) and 25(*c*') and more illustratively in FIG. 26(*c*) the insert module 12 of the promotional pocket cover 10 is inserted therein the cavity 31 of the jean pocket 25 positioned with the piece of hook and loop fastener component 56 facing the corresponding piece of hook and loop fastener component 56 which is attached to the wall of the reverse side 46 of the face panel 38 of the jean pocket 25. FIG. 26(*c*) further shows the cover module 11 in a vertical unfolded position with the apex 20 pointing up, and where the top surface of the top panel 28 of the promotional pocket cover 10 is facing the surface of the jean 26 material with the promotional adornment 40 and button 57 facing the jean 26 material. Thereafter, the fourth step, as shown in FIGS. 25(*d*), 25(*d*') and 26(*d*) the piece of hook and loop fastener component 56 affixed to the interior wall of the reverse side 46 of the face panel 38 of the jean pocket 25 is pressed against the piece of hook and loop fastener component 56 affixed to the insert module 12 of the promotional pocket cover 10 where the two pieces of hook and loop fastener components 56 become engaged to removably attach the promotional pocket cover 10 to the preexisting jean pocket 25. Further, as shown in FIGS. 25(*d*), 25(*d*'), and 26(*d*), the cover module 11 is then folded forward and downwardly 180° along the fold line F1 and over the top edge of the jean pocket 25 where the cover module 11 covers a portion of the top of the face panel 38 of the jean pocket 25. Upon folding of the cover module 11 the promotional adornment 40 and button 57 are displayed correctly towards a viewer. The promotional pocket cover 10 is heat pressed to reinforce the crease in the folded cover module 11 formed along the fold line Fl and to liquefy the adhesive in the pieces of hook and loop fasteners 56 to reinforce the attachment between the piece of hook and loop fastener 56 attached to the insert module 12 and the corresponding piece of hook and loop fastener 56 attached to the interior wall 46 of the jean pocket 25.

In an alternative embodiment, the hook and loop fastener component 56 may be sewn onto the insert module 12, and a corresponding hook and loop fastener component may be sewn onto the interior wall of the reverse side 46 of the face panel 38 of the jean pocket 25 for a more secure means to attach the promotional pocket cover 10 to a preexisting jean pocket 25, preferably when the jeans are worn by a child.

METHOD OF CONSTRUCTION OF PROMOTIONAL POCKET COVER 10

In accordance with more specific aspects of the present invention, a method of constructing the promotional pocket cover 10 begins with the provision of a decorative pocket pattern, or template, or pattern, (hereinafter, "pattern") generally designated 60. In addition, the method of construction of the promotional pocket cover 10 begins with the provision of a plurality of materials including any one of cotton, denim, colored denim, dungaree polyester, linen, leather, corduroy, vinyl, flannel, seersucker, spandex, satine, silk, satin, velvet, felt, velveteen, faux fur, wool, wool blends, rayon, viscose, nylon, bamboo, cashmere or any combinations thereof, including any one of colors, patterns, textures, grades, weights, including any one of logos, images, trademarks, tradenames, or combinations thereof, wherein said materials are resilient and flexible for folding; obtaining a plurality of threads including any one of colors, patterns, textures, grades, weights, or any combinations thereof; obtaining a plurality of any one of stiffening material, pellon, pellon substitutes, silicone, silicone resins, foam rubber, polyurethane foam, sponge, or supportive material; obtaining a plurality of promotional adornments; obtaining any one of scissors, cutting means, or cutting apparatus; obtaining any one of sewing needle, sewing machine or sewing means; obtaining any one of heated iron, steam iron, heating means; obtaining a dowel stick.

Figure 27:
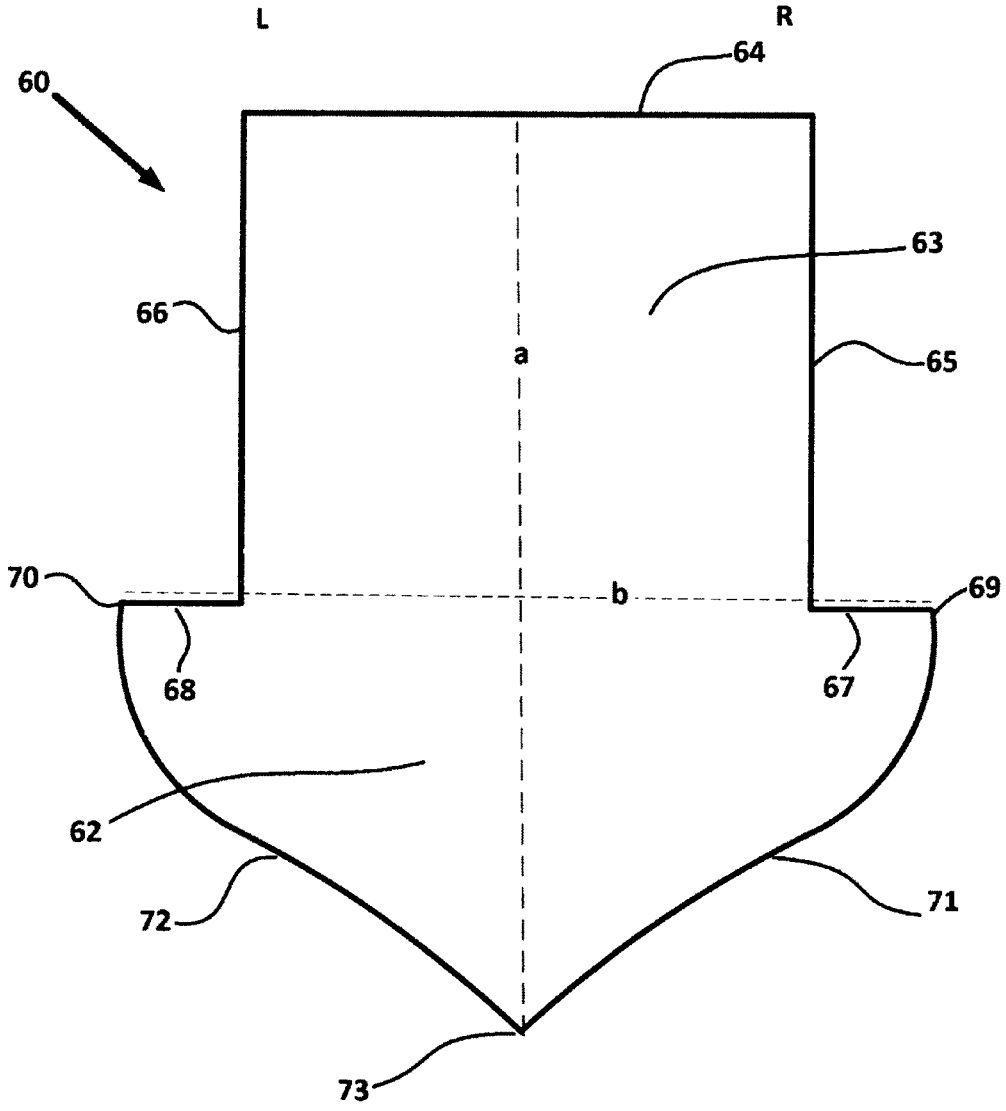
FIG. 27 is top planar view of one side of a promotional pocket cover pattern useful in the practice of the invention, according to the preferred embodiment of the present invention.

Referring to FIG. 27 there is shown a pattern 60 which is used in the practice of the present invention. The pattern 60 may be formed from semi-rigid plastic which may be cut by conventional means, or may be cut by an industrial means; and having sufficient durability to be used many times as a pattern 60 to form the top panel 28, middle panel 29, and back panel 30, which are configured together, as described below, to form the promotional pocket cover 10, preferred by the present invention. The method reduces multiple promotional pocket covers 10 constructed with inconsistent shapes and sizes and promotes promotional pocket cover 10 construction of good consistent looking appearance.

The method of the construction of the invention can be advantageously employed in the manufacture of promotional pocket covers 10 for pant garments, preferably jean pants 26, or other garments, pants, shirts, overalls, jackets, and non-garment articles including any one of apparel, luggage, back packs, fanny packs, computer bags, gym bags, pocket books, purses, pet carriers, or any article that includes at least one pocket having a face panel, top edge, and cavity. The method utilizes a small amount of material, thread, and fastening means, and results in a durable promotional pocket cover 10 including cover module 11 and insert module 12 construction of good looking appearance.

Examples, of materials that may be used for the promotional pocket covers 10 are, but not limited to any of a plurality of materials, or fabrics, or cloth, or broadcloth, or natural or synthetic, which is of sufficient resiliency to allow enhancements to be affixed thereon, and of sufficient suppleness to be folded.

The promotional pocket covers 10 can be manufactured from cotton, denim, denim different color than the jeans, dungaree, polyester, linen, leather, corduroy, vinyl, flannel, seersucker, spandex, satine, silk, satin, velvet, felt, velvet, corduroy, leather, faux fur, wool, wool blends, rayon, viscose, nylon, bamboo, cashmere, recycled materials. The material may include a solid color, or may be of a print, or of a design with a logo or other enhancement imprinted therein. In addition, it would be of a benefit to a sports participant, especially bicyclists and joggers to manufacture the promotional pocket cover 10 such as ILLUMINATE® which is a retro-reflective technology applied to the surface of the fabric that provides the promotional pocket cover 10 with style in the day and reflectivity at night. In addition, the promotional pocket cover 10 may be made with a glow-in-the dark material, such as a luminous fabric which is provided by LUMIGRAM® which is a fiber optic fabric which would augment a wearer's jeans and heighten a user's fun and lighten up his/her night, particularly when present in a club with blue lights.

A plurality of threads comprising a variety of different colors, patterns, textures, grades, and weights can be used in the construction of the promotional pocket covers 10. Each of the threads may compliment the material selected; and is of a sufficient size, weight, thickness, and grade, capable of being sewn into the three panels 28, 29 and 30 of the promotional pocket cover 10 to affix the three panels 28, 29, 30, together and to permit folding; and is of a size, weight, thickness, grade, capable of being sewn to form a stitched marginal edge 23, and can thereby be selected from any of a plurality of threads natural or synthetic, which is of sufficient resiliency to retain its form and strength during use. In addition, the threads may include colors, texture, indicia, which identify a specific charitable organization, non-profit organization, for-profit organization, sports team, of any specific cause and add to the promotional objectives of the present invention.

A plurality of specific promotional adornments 40 can be used in the construction of the promotional pocket cover 10 where the promotional adornment 40 is any one of adornments including any type of printed matter of any one of logos, images, trademarks or tradenames or decorative embellishment including any one of colors, ink, paint, puff paint, sequins, leather, jewelry, precious metals, studs, embroidery, ribbons and buttons. In addition, adornments may include any one of images, tradenames, or trademarks, which are used by a specific sport team, or sport player, or school, or charitable organization, or non-profit organization, or for-profit organization, or publicity event, or any specific cause, so as to readily identify or associate that specific sport team, sport player, celebrity, school, charitable organization, non-profit organization, for-profit organization, or publicity event, or any specific cause. Each, promotional adornment 40 is of a size and flexibility that permits it to be affixed to the obverse side within the surface area of the cover module 11 of the promotional pocket cover 10 such that the particular indicium, logo, or color, ribbon, button, mascot, or inspirational or motivational slogan, or promotional adornment is properly displayed when the promotional pocket cover 10 is removably affixed to a preexisting jean pocket 25 and easily recognized as being the promotional adornment 40 associated with that single and specific sport's team, sport player, celebrity, name, charitable cause or non-profit organization, or special cause.

FIG. 27 illustrates a promotional pocket cover pattern 60 which is generally in the shape of an arrow is used in the construction practice to form the promotional pocket cover 10, according to the preferred embodiment of the present invention. The promotional pocket cover pattern 60 is shown in FIG. 27 with the obverse side 61 up; the reverse side is identical to the obverse side. It is well understood that this particular shape can be modified and the method of the present invention applies equally well to promotional pocket covers 10 with other peripheral shapes, such as those having bottom arcuate corner edges, triangular shaped insert module 12, or any geometric shape; and contoured peripheral shapes configured to form the cover module 11 profiling promotional adornments 40, such as ribbons, sports images, sport equipment, soccer balls, basketballs, baseballs, cartoon characters, buildings, people, and/or the like, or any geometric shape.

As mentioned above, the pattern 60, productive in the present invention, can be formed from a suitable piece of semi-rigid material, for example, plastic, hardboard, and the like, which is pliable enough to be cut by conventional means, for example, scissors, and which is a suitable piece of semi-rigid material of sufficient size to permit construction of a pattern 60 of the desired promotional pocket cover panels 28, 29, and 30 incorporated in the present invention; and durable sufficient to be used many times as a pattern 60 to form the panels 28, 29, and 30 which is important to the practice of the present invention. The method reduces multiple promotional pocket covers 10 constructed with inconsistent shapes and sizes and promotes promotional pocket cover 10 construction of good consistent looking appearance. The pattern 60 is illustrated in FIG. 27 showing one side; the reverse side is identical.

The pattern 60 is a single body unit generally arrow in shape which will be used as the pattern 60 to cut the three panels of material 28, 29, and 30 which are constructed to form the three panels, the top panel 28, the pellon panel 29, and the back panel 30, of the promotional pocket cover 10. The pattern 60 is placed over the wearer selected material which will form the top panel 28; and the arrow shaped top panel 28 is formed and cut from the material by a rolling a cutting means along the entire peripheral exterior edges of the pattern 60. The cutting means is preferably a round rolling cutter, but not limited to; a scissors may be used, or a computerized cutting machine may be used. Similarly, the pattern 60 is placed over the wearer selected material which will form the back panel 30; and the arrow shaped back panel 30 is formed and cut from the material by rolling a cutting means along the exterior peripheral edges of the pattern 60. Similarly, the pattern 60 is place over the pellon material 29 which will form the middle pellon panel 29 of the promotional pocket cover 10; and the pellon panel 29 is formed and cut from the pellon material by rolling a cutting means along the exterior peripheral edges of the pattern 60.

The pattern 60 is a single body unit generally in the shape of an arrow which will be used as the pattern 60 to cut the three panels of material 28, 29, and 30 which are constructed to form the three panels, the top panel 28, the middle panel 29, and the back panel 30, of the promotional pocket cover 10. The pattern 60 is placed over the wearer selected material which will form the top panel 28; and the arrow shaped top panel 28 is formed and cut from the material by a rolling a cutting means along the entire peripheral exterior edges of the pattern 60. The cutting means is preferably a round rolling cutter, but not limited to; a scissors may be used, or a computerized cutting machine may be used. Similarly, the pattern 60 is placed over the wearer selected material which will form the back panel 30; and the arrow shaped back panel 30 is formed and cut from the material by rolling a cutting means along the exterior peripheral edges of the pattern 60. Similarly, the pattern 60 is place over the pellon material 29 or pellon substitute material which will form the middle panel 29 of the promotional pocket cover 10; and the middle panel 29 is formed and cut from the pellon material or pellon substitute by rolling a cutting means along the exterior peripheral edges of the pattern 60. The pattern 60 is a single body unit, generally in the shape of an arrow, comprising two units; a generally triangular cover unit 62 configured to construct the cover module 11 of the promotional pocket cover 10; and a generally rectangular insert unit 63 configured to construct the insert module 12 of the promotional pocket cover 10. The cover unit 62 and the insert unit 63 are continuously seamlessly joined together to form the single body unit of the pattern, generally in the shape of an arrow 60; having a longitudinal line a, defined by phantom line a; and a lateral line b, defined at phantom line b. The rectangular insert unit 63 of the pattern 60 is configured in sufficient size and shape to form an insert module 12 amenable to a corresponding preexisting jean pocket 25 to allow the insertion of the insert module 12 therein, easily and reasonably secure, but not permanently. The rectangular insert unit 63 includes a longitudinal horizontal lower linear straight edge 64 of predetermined width joined by two opposing generally parallel vertical lateral side straight edges 65 and 66 which extend a predetermined length; wherein said two vertical side edges 65 and 66 delineate at said predetermined length at right angles in opposing directions parallel to said horizontal lower linear straight edge 64 form two exterior opposing right angles forming two opposing longitudinal horizontal basal linear edges 67 and 68 of the triangular cover unit 62 and thereby creating a predetermined width extending a distance from point 69 to point 70 along the lateral line b, defined at phantom line b. The width from point 69 to 70 of the cover unit 62 spanning a width at its widest is wider than the insert unit 63. The cover unit 62 includes two opposing curvilinear side edges 71 and 72 meeting at a vertex 73 forming an obtuse angle. The generally triangular cover unit 62 is of a sufficient size and shape, and at its widest width, sufficient to extend across the width of a corresponding preexisting jean pocket 25 face panel 38, as illustrated in FIGS. 9, 10, 22, and 41. The pattern 60 includes a predetermined length from the longitudinal horizontal lower straight edge 64 to the vertex 73 extending along the longitudinal line a, as defined by phantom line a of the pattern 60. This length, defined at a, is so dimensioned to provide sufficient length to the promotional pocket cover 10 in use, where the formed insert module 12 is inserted within a preexisting cavity 31 of a jean pocket 25 there is sufficient length to allow the formed cover module 11 to be folded over the top edge 27of the jean pocket 25 and cover the top portion of the face panel 38 of the jean pocket 25. The generally triangular shape of the cover unit 62 of the pattern 60 is a popular shape for pocket flaps. It will be understood that this particular shape, while preferred, is not exclusive, and that the method of the present invention applies equally to promotional pocket covers 10 of other contoured shapes, geometric shapes, or shapes which shape an animal or person, or product.

To accommodate a plurality of users, modifications are made to the promotional pocket cover pattern 60, as illustrated in FIG. 27 to create different sizes of promotional pocket covers 10. The patterns 60 are dimensioned and defined as toddler pattern 74, pre-kindergarten 75, small pattern 76, medium pattern 77, and large pattern 78, and are represented in the plan views of the promotional pocket cover patterns 60 in FIGS. 27 to 32 and will be described below and organized in Chart 1, as shown in FIG. 33 for conciseness. It should be appreciated that the method of construction of the promotional pocket cover 10 can comprise any modifications as defined in the size representations toddler 74, pre-kindergarten 75, small 76, medium 77, and large 78, as in the chart below, or any modifications as, desired or needed by the user. The modified patterns, 74, 75, 76, 77, and 78, are described using the same numerals identifying those corresponding parts of the pattern 60 described and designated by numeral 60 for clarity and consistency.

CHART 1

Modified Patterns Useful in the Construction of Promotional Pocket Flaps 10 Including Various Sizes: Toddler 74; Pre-Kindergarten 75; Small 76; Medium 77; Large 78

Figure 28:
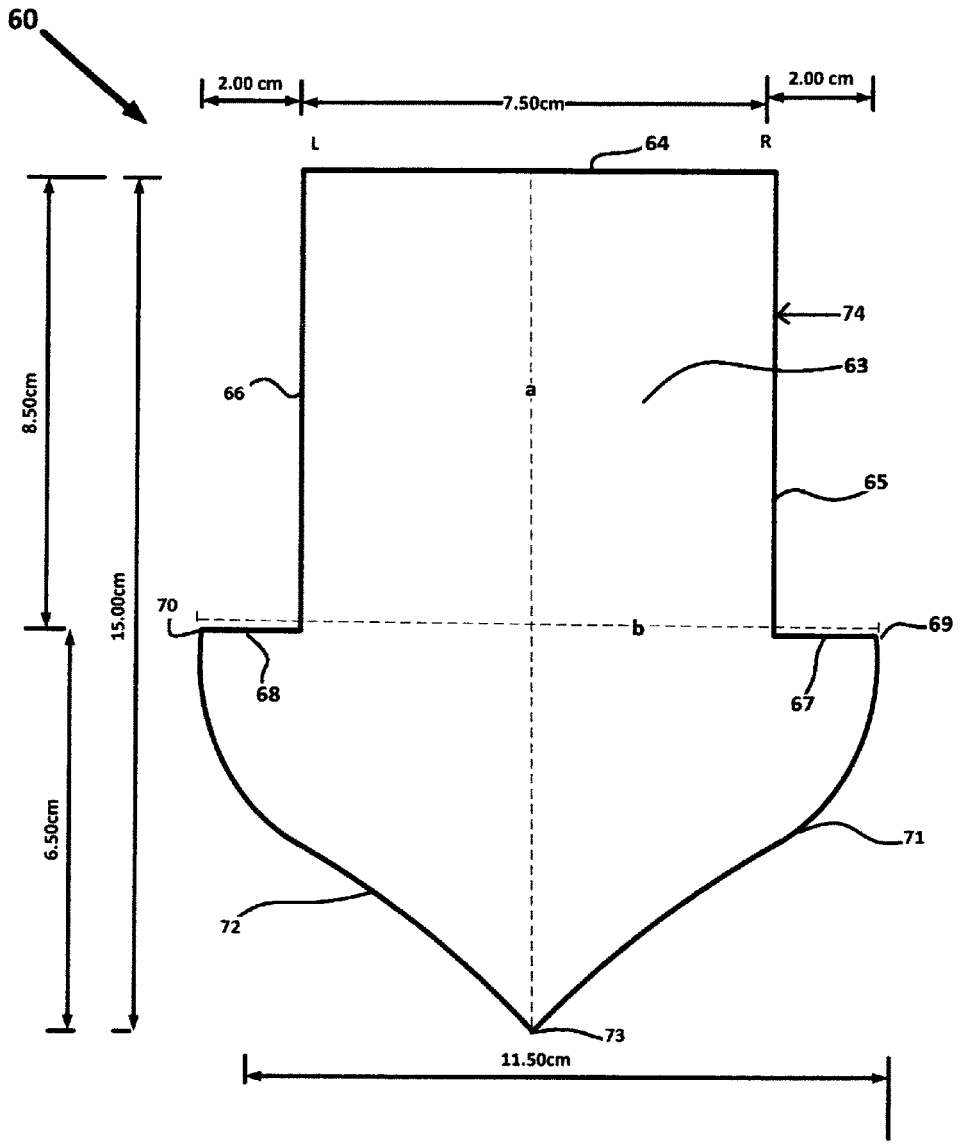
FIG. 28 is a top planar view of one side of a promotional pocket cover pattern of a modification of the promotional pocket cover pattern in FIG. 15 showing dimensions demonstrative of a toddler size promotional pocket cover.
Figure 29:
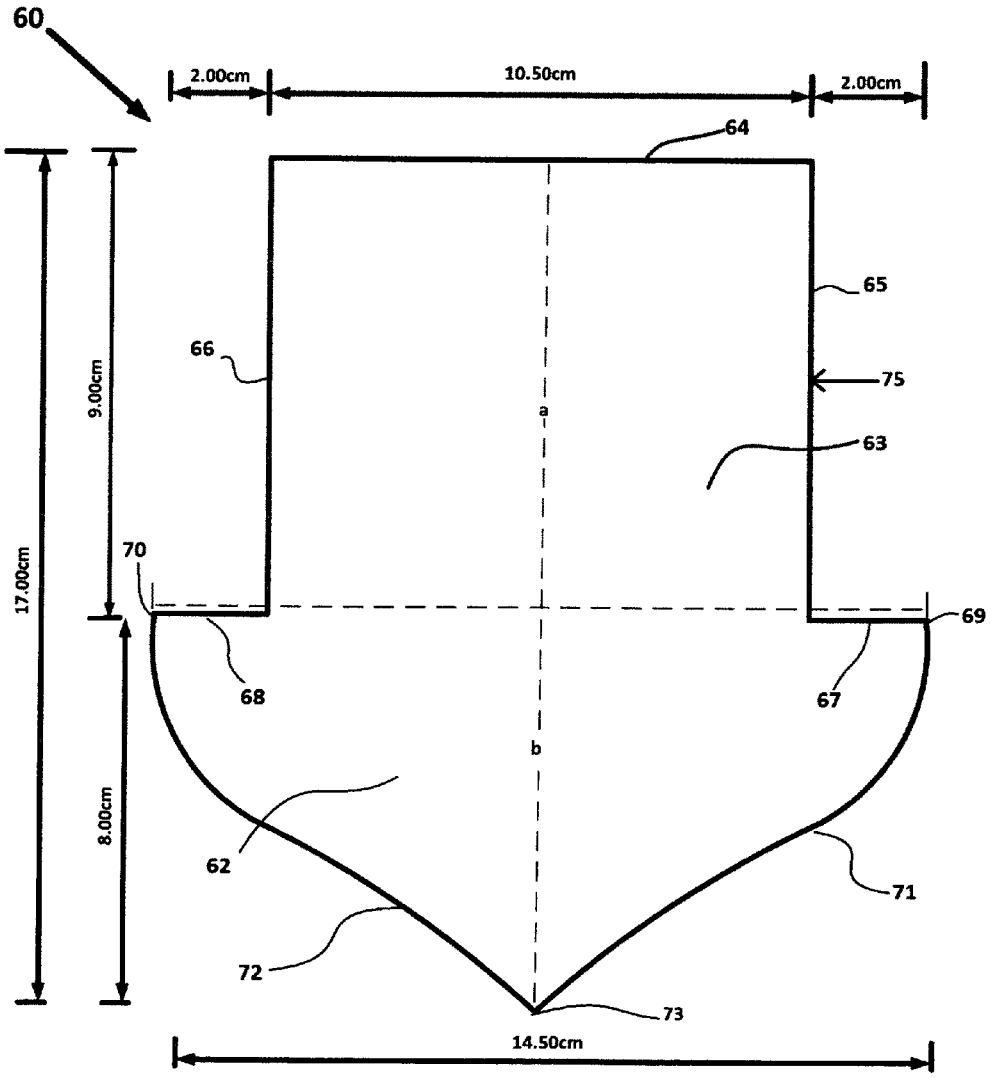
FIG. 29 is a top planar view of one side of a promotional pocket cover pattern of a modification of the promotional pocket cover pattern in FIG. 15 showing dimensions demonstrative of a pre-kindergarten size promotional pocket cover.
Figure 30:
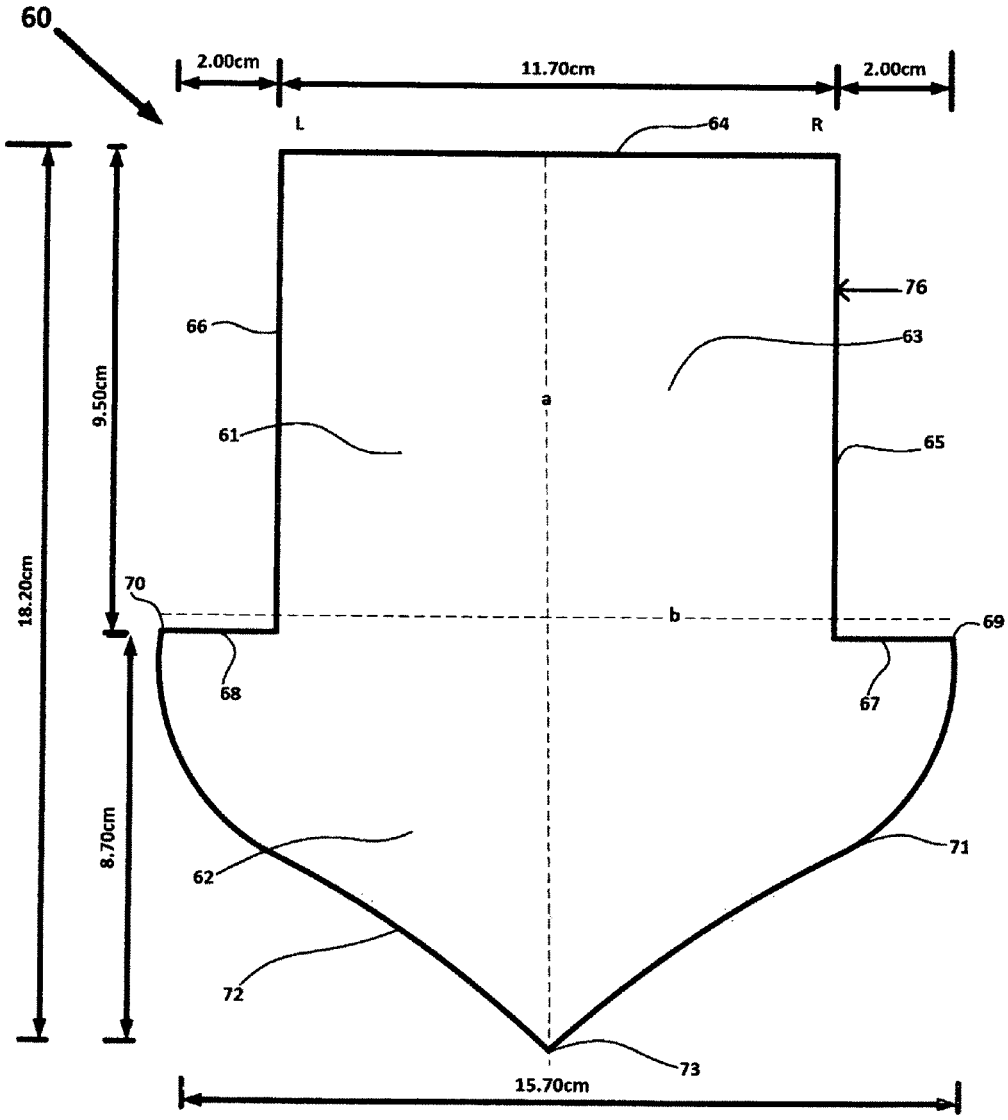
FIG. 30 is a top planar view of one side of a promotional pocket cover pattern of a modification of the promotional pocket cover pattern in FIG. 15 showing dimensions demonstrative of a small size promotional pocket cover.
Figure 31:
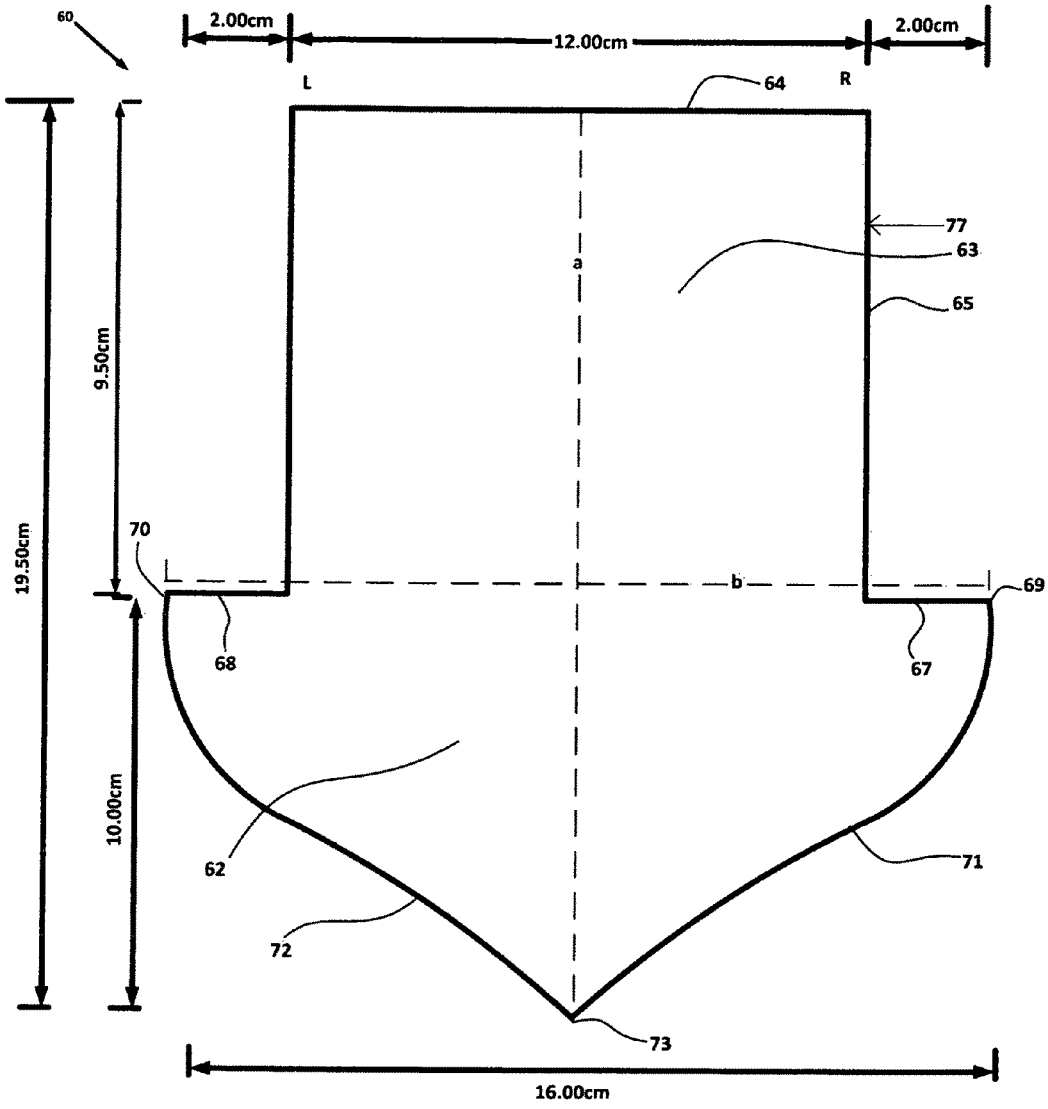
FIG. 31 is a top planar view of one side of a promotional pocket cover pattern of a modification of the promotional pocket cover pattern in FIG. 15 showing dimensions demonstrative of a medium promotional pocket cover.
Figure 32:
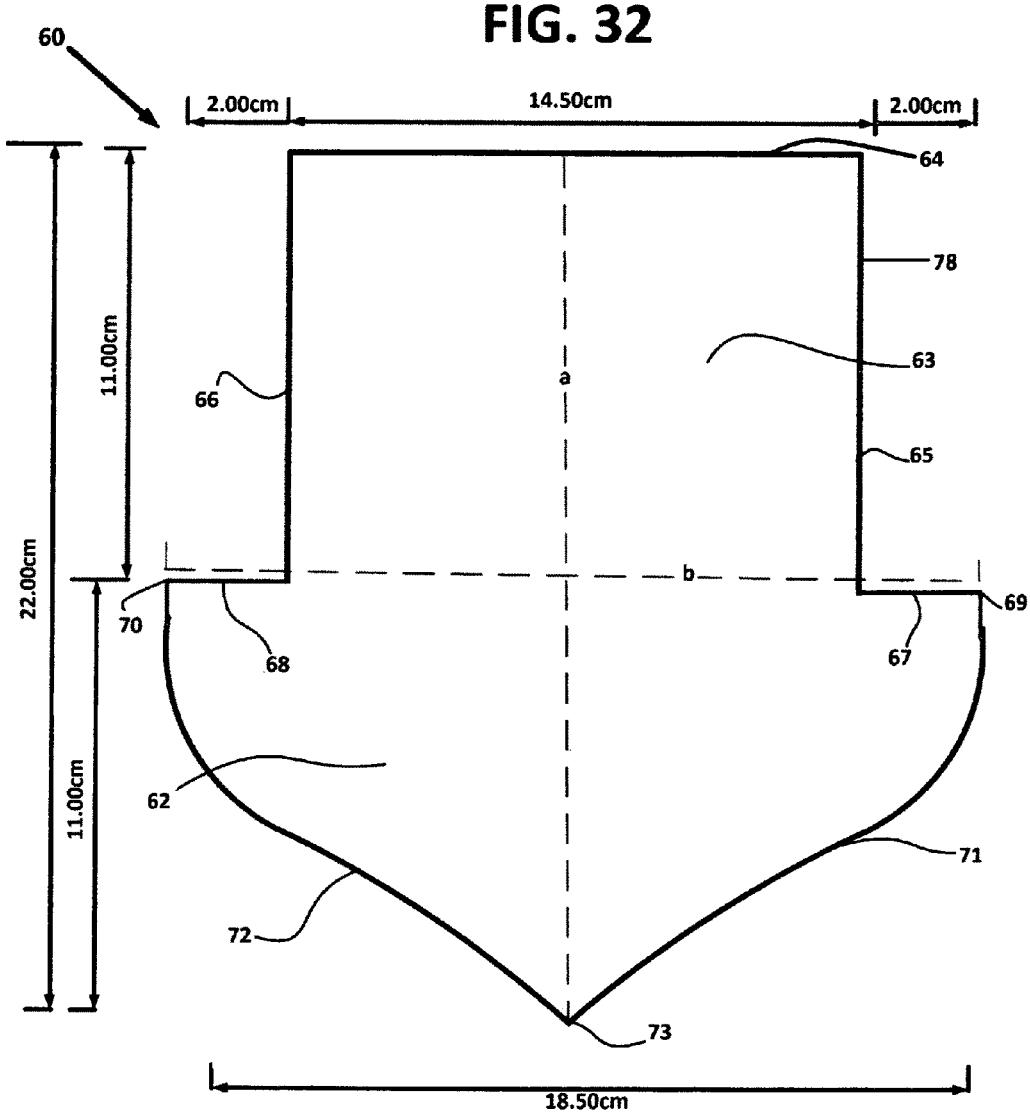
FIG. 32 is a top planar view of one side of a promotional pocket cover pattern of a modification of the promotional pocket cover pattern in FIG. 15 showing dimensions demonstrative of a large promotional pocket cover.

| Figure | Longitudinal straight edge 64 | Length of lateral side straight edges 65 and 66 of insert element | Width of longitudinal straight edges 67 and 68 of flap element 62 | Length from longitudinal straight edge to vertex line a | Widest width of flap element line b |
|---|---|---|---|---|---|
| FIG. 28 Toddler Pattern 74 | 7.50 cm | 8.50 cm | 2.00 cm | 15.00 cm | 11.50 cm |
| FIG. 29 Pre-K Pattern 75 | 10.50 cm | 9.00 cm | 2.00 cm | 17.00 cm | 14.50 cm |
| FIG. 30 Small Pattern 76 | 11.70 cm | 9.50 cm | 2.00 cm | 18.20 cm | 15.70 cm |
| FIG. 31 Medium Pattern 77 | 12.00 cm | 9.50 cm | 2.00 cm | 19.50 cm | 16.00 cm |
| FIG. 32 Large Pattern 78 | 14.50 cm | 11.00 cm | 2.00 cm | 22.00 | 18.50 cm |

FIG. 28 shows a modification of the promotional pocket cover pattern 60, as illustrated in FIG. 27, defining the dimensions configured to construct a toddler size 74 of the promotional pocket cover 10. The toddler pattern 74 is a single body unit generally in the shape of an arrow including a generally rectangular shaped insert unit 63 configured to construct the insert module 12 of the promotional pocket cover 10; and a generally triangular shaped cover unit 62 configured to construct the cover module 11 of the promotional pocket cover 10, and so configured that the cover unit 62 and insert unit 63 are continuously seamlessly joined together to form the single body unit the generally arrow shape of the toddler size pattern 74 generally in the shape of an arrow; having a longitudinal line a defined at phantom line a and a lateral line b defined at phantom line b. The insert unit 63 of the toddler pattern 74 includes a horizontal longitudinal lower straight edge 64 of predetermined width measuring approximately 7.50 cm joined by two opposing generally parallel vertical lateral side straight edges 65 and 66 which extend a predetermined length measuring approximately 8.50 cm; wherein said two vertical side edges 65 and 6 at said predetermined length delineate at right angles in opposing directions parallel to said horizontal lower linear straight edge 64 form two exterior opposing right angles forming two opposing longitudinal basal linear edges 67 and 68 of the cover module 62; wherein the longitudinal linear length of opposing longitudinal horizontal linear edges 67 and 68 measuring a distance of approximately 2.00 cm on each side forming the opposing longitudinal basal straight edges 67 and 68 of the cover unit 62, and thereby creating a width approximately 11.50 cm extending a distance from point 69 to point 70 along the lateral line b, defined by phantom line b; and the generally triangular cover unit 62 includes two opposing curvilinear side edges 71 and 72 which meet at vertex 73 forming an obtuse angle and creating a distance 6.50 cm extending from phantom line b to vertex 73; and the toddler pattern 74 measures approximately 15.00 cm in length extending a distance from the longitudinal straight edge 64 to the vertex 73 along the longitudinal line a, defined by phantom line a.

FIG. 29 shows a modification of the promotional pocket cover pattern 60, as illustrated in FIG. 27 defining the dimensions configured to construct a pre-kindergarten size 75 promotional pocket cover 10. The pre-kindergarten pattern 75 is a single body unit generally in the shape of an arrow, including a generally rectangular shaped insert unit 63 configured to construct the insert module 12 of the promotional pocket cover 10; and a generally triangular cover unit 62 configured to construct the cover module 11 of the promotional pocket cover 10, and disposed so that the insert unit 63 and the cover unit 62 are continuously seamlessly joined together to form the single body unit of the generally arrow shaped pre-school pattern 75; having a longitudinal line a, defined by phantom line a; and a lateral line b, defined by phantom line b. The insert unit 63 of the pre-school pattern 75 includes a horizontal longitudinal lower straight edge 64 of predetermined width measuring approximately 10.50 cm joined by two opposing generally parallel vertical lateral side straight edges 65 and 66 which extend a predetermined length measuring approximately 9.00 cm from the longitudinal straight edge 64 to lateral line b, defined by phantom line b, and wherein said two vertical side edges 65 and 66 delineate at said predetermined length at right angles in opposing directions parallel to said horizontal lower linear edge 64 form two exterior opposing right angles forming two opposing longitudinal basal linear edges 67 and 68 of the cover module 62; with the longitudinal length of the two opposing linear basal edges 67 and 68 measuring a distance of approximately 2.00 cm on each side forming the opposing horizontal longitudinal basal edges 67 and 68 of the cover unit 62, and thereby creating a width approximately 14.50 cm extending a distance from point 69 to point 70 along the lateral line b, defined by phantom line b. The triangular cover unit 62 includes two opposing curvilinear side edges 71 and 72 which meet at an vertex 73 forming an obtuse angle creating a distance of 8.00 cm extending from lateral line b, defined at phantom line b to vertex 73; and the pre-school pattern 75 measures approximately 17.00 cm distance extending from the longitudinal straight edge 64 to the vertex 73 along the longitudinal line a, defined by phantom line a.

FIG. 30 shows a modification of the promotional pocket cover pattern 60, as illustrated in FIG. 27 defining the dimensions configured to construct a small size 76 promotional pocket cover 10. The size small pattern 76 is a single body unit-generally in the shape of an arrow including a generally rectangular shaped insert unit 63 configured to construct the insert module 12 of the promotional pocket cover 10; and an generally triangular shaped cover unit 62 configured to construct the cover module 11 of the promotional pocket cover 10, and disposed so that the insert unit 63 and the cover unit 62 are continuously seamlessly joined together to form the single body arrow shape of the small size pattern 76; having a longitudinal line a defined at phantom line a, and a lateral line b, defined by phantom line b. The insert unit 63 of the small pattern 76 includes a horizontal longitudinal lower straight edge 64 of predetermined width measuring approximately 11.70 cm joined by two opposing generally parallel vertical lateral side straight edges 65 and 66 which extend a predetermined length measuring approximately 9.50 cm from the longitudinal lower straight edge 64 to the lateral line b defined at phantom line b, and vertical lateral side edges 65 and 66 delineate at said predetermined length at right angles in opposing directions parallel to said horizontal lower linear edge 64 form two exterior opposing right angles forming two opposing longitudinal basal linear edges 67 and 68 of the cover module 62; a distance of approximately 2.00 cm on each side forming the opposing longitudinal basal straight edges 67 and 68 of the generally triangular cover unit 62 and thereby creating a width approximately 15.70 cm extending a distance from point 69 to point 70 along the lateral line b, as defined at phantom line b; and the cover unit 62 includes two opposing curvilinear side edges 71 and 72 which meet at vertex 73 forming an obtuse angle creating a distance of approximately 8.70 cm extending from phantom line b to vertex 73; and the size small pattern 76 measures approximately 18.20 cm distance extending from the longitudinal edge 64 to the vertex 73 along the longitudinal line a, defined by phantom line a.

FIG. 31 shows a modification of the promotional pocket cover pattern 60, as illustrated in FIG. 27 defining the dimensions configured to construct a medium size 77 promotional pocket cover 10. The size medium pattern 77 is a single body unit generally in the shape of an arrow including a generally rectangular insert unit 63 configured to construct the insert module 12 of the promotional pocket cover 10; and a generally triangular shaped cover unit 62 configured to construct the cover module 11 of the promotional pocket cover 10, and the insert unit 63 and cover unit 62 are disposed so that the two units 62 and 63 are continuously seamlessly joined together to form the single body arrow shape of the medium size pattern 77. The insert unit 63 of the medium pattern 77 includes a longitudinal linear lower straight edge 64 of predetermined width measuring approximately 12.00 cm joined by two opposing generally parallel lateral side straight edges 65 and 66 which extend a predetermined length measuring approximately 9.50 cm extending from the longitudinal lower straight edge 64 to lateral line b, defined at phantom line b; and vertical lateral side straight edges 65 and 66 vertical lateral side straight edges 65 and 66 which extend a predetermined length; and then wherein said two vertical side edges 65 and 66 delineate at said predetermined length at right angles in opposing directions parallel to said horizontal lower linear straight edge 64 form two exterior opposing right angles forming two opposing longitudinal horizontal basal linear edges 67 and 68 of the triangular cover unit 62 with the longitudinal length measuring a distance of approximately 2.00 cm on each side forming the opposing horizontal longitudinal basal straight edges 67 and 68 of the cover unit 62, and thereby creating a width approximately 16.00 cm extending a distance from point 69 to point 70 along the lateral line b, defined by phantom line b; and the cover unit 62 includes two opposing curvilinear side edges 71 and 72 which meet at vertex 73 forming an obtuse angle creating a distance of approximately 10.00 cm extending from lateral line b, defined at line b, to vertex 73; and the size medium pattern 77 measures approximately 19.50 cm length extending a distance from the longitudinal straight edge 64 to vertex 73 along the longitudinal line a, as defined by phantom line a.

FIG. 32 shows a modification of the promotional pocket cover pattern 60, as illustrated in FIG. 27 defining the dimensions configured to construct a large size 78 promotional pocket cover 10. The size large pattern 78 is a single body unit generally in the shape of an arrow including a generally rectangular insert unit 63 configured to construct the insert module 12 of the promotional pocket cover 10; and a generally triangular shaped cover unit 62 configured to construct the cover module 11 of the promotional pocket cover 10, and insert unit 63 and cover unit 62 disposed so that the two units 62 and 63 are continuously seamlessly joined together to form the generally arrow shape of the large size pattern 60. The rectangular insert unit 63 of the large pattern 78 includes a longitudinal horizontal lower linear straight edge 64 of predetermined width measuring approximately 14.50 cm joined by two opposing generally parallel vertical-lateral side straight edges 65 and 66 which extend a predetermined length measuring approximately 11.00 cm from the longitudinal straight edge 64 to the lateral line b, defined at phantom line b; and lateral side edges 65 and 66 further extend longitudinally in opposing directions forming two opposing external right angles, with the longitudinal length measuring a distance of approximately 2.00 cm on each side forming the opposing horizontal longitudinal basal straight edges 67 and 68 of the cover unit 62, and thereby creating a width approximately 18.50 cm extending a distance from point 69 to point 70 along the lateral line b, defined at phantom line b; and the triangular cover unit 62 includes two opposing curvilinear side edges 71 and 72 which meet at vertex 73 forming an obtuse angle creating a distance of 11.00 cm extending from phantom line b, defined at phantom line b, to vertex 73; and the size large pattern 78 measures approximately 22.00 cm in length extending a distance from the longitudinal straight edge 64 to vertex 73 along the longitudinal line a, as defined by phantom line a.

Figure 34:
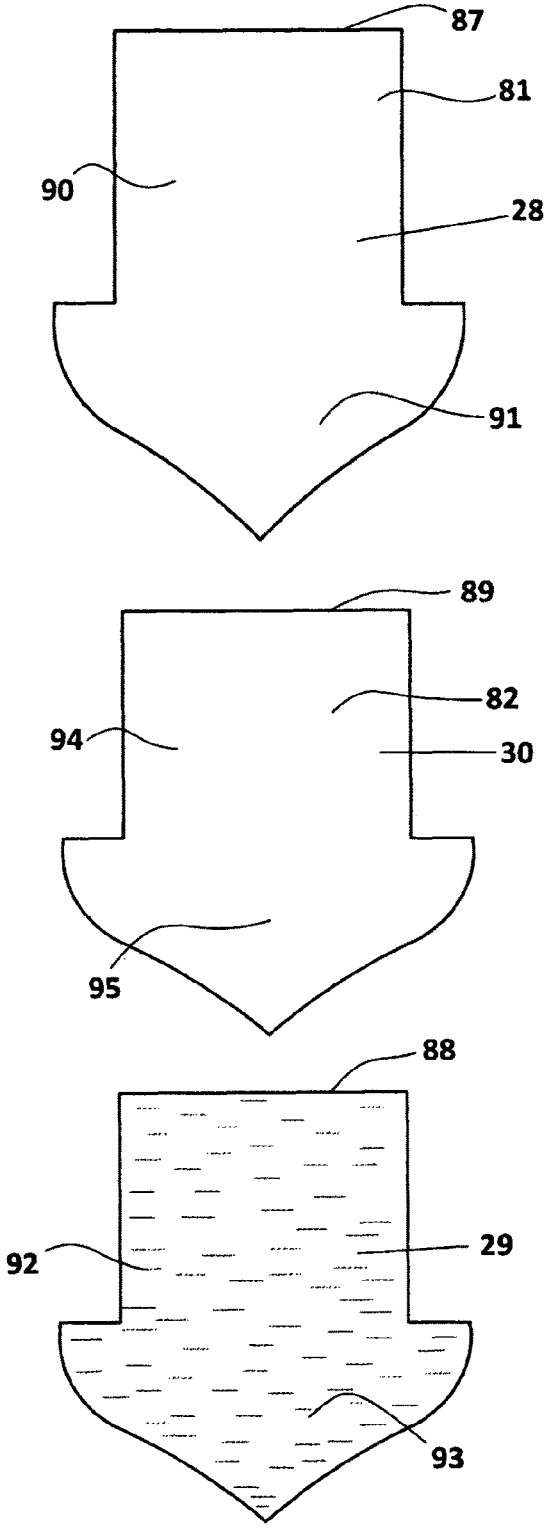
FIG. 34 is a front perspective view of the three cut panels, useful in construction of the promotional pocket cover, according to the preferred embodiment of the present invention with pellon panel positioned at the bottom of the three panels below the back panel; and back panel below the top panel pattern.

Referring to FIG. 34, shows three exemplary panels 28, 29, and 30, of material generally in the shape of an arrow, substantially identical in shape, cut from one pattern 60. The three panels may be cut from any of the described patterns: toddler pattern 74; pre-K pattern 75; small pattern 76, medium pattern 77; or large pattern 78. The three panels when configured together, as described below, construct the single body unit forming the promotional pocket cover 10, according to the preferred embodiment of the present invention. A promotional pocket cover 10 is constructed having a first panel which comprises a wearer selectable material which is constructed to be the top panel 28 of the promotional pocket cover; a second panel comprises a stiffening panel which is constructed to be the middle panel 29 of a promotional pocket cover; and a third panel comprising a wearer selectable material which is constructed to be the back panel 30 of the promotional pocket cover.

The top panel 28, the middle panel 29, and the back panel 30 are cut from the desired pattern 60 selected by placing the pattern 60 on top of each of the selected materials, separately, and cutting out the arrow shape with a cutting means, preferably a rounded rolling means, or may be a scissors, around the entire perimeter of the pattern 60 to form the top panel 28, middle panel 29, and the back panel 30.

The top panel 28 formed is a single body unit generally in the shape of an arrow formed with a generally rectangular section 90 formed with a longitudinal horizontal lower linear edge 87 and a generally triangular section 91 seamlessly joined together; and dimensioned substantially identical to the pattern 60, for illustrative purposes, but not exclusive to, from which it was cut, as described above. The top panel 28 of the promotional pocket cover 10 comprises a wearer-selected material which provides a displaying means comprising a material with a surface sufficient in resiliency and suppleness to affix thereon a variety of promotional adornments 40 readily identifiable or associated with a specific cause to enable the display thereof to a viewer; the obverse side of the top side is constructed and configured to be displayed in the direction of the viewer.

The middle panel 29 formed is a single body unit generally in the shape of an arrow formed with a generally rectangular section 92, and formed with a longitudinal horizontal lower linear edge 88 and a generally triangular section 93 seamlessly joined together; and dimensioned substantially identical to the pattern 60, for illustrative purposes, but not exclusive to, from which it was cut, as described above. The middle panel 29 comprises a flexible supporting backing material with sufficient stiffness and flexibility; a sufficient stiffness to retain the form of the promotional pocket cover 10 in use, and thereby prevents the promotional pocket cover 10 from collapsing while having a promotional adornment 40 affixed thereon; but at the same time a sufficient flexibility to allow easy folding of the promotional pocket cover 10 when folded over the jean pocket 25 edge upon installation of the promotional pocket cover 10 to a preexisting jean pocket 25 face panel 38 to reveal the promotional adornments 40 affixed thereon. The middle panel is manufactured from material comprised of pellon material to provide a supporting means. The pellon can be substituted with any one of silicone, silicone resins, foam rubber, polyurethane foam, sponge, or supportive material. Upon completion of construction of the promotional pocket cover 10, described below, the middle panel of pellon (hereinafter, "pellon panel") 29 is sandwiched therebetween the top panel 28 and the back panel 30 and remains hidden upon completion of construction of the promotional pocket cover 10.

The back panel 30 formed is a single body unit generally in the shape of an arrow formed with a generally rectangular section 94 and formed with a longitudinal horizontal lower linear edge 89; and a generally triangular section 95 seamlessly joined together; and dimensioned substantially identical to the pattern 60, for illustrative purposes, but not exclusive to, from which it was cut, as described above. The back panel 30 comprises a wearer selectable material to provide a back side to the promotional pocket cover 10, as illustrated in FIG. 3, which can be of a complementary color, fabric, design, texture, material to the top panel 28 material, or the back panel 30 material can be identical to the top panel 28 material, or any wearer selected material.

The top panel 28 and the back panel 30 may be manufactured from cotton, denim, denim different color than the jeans, dungaree, broadcloth, polyester, linen, leather, corduroy, vinyl, flannel, seersucker, spandex, satine, silk, satin, velvet, felt, velvet, corduroy, leather, faux fur, wool, wool blends, rayon, viscose, nylon, bamboo, cashmere, recycled materials, or any wearer selected material, and as noted above.

Figure 35:
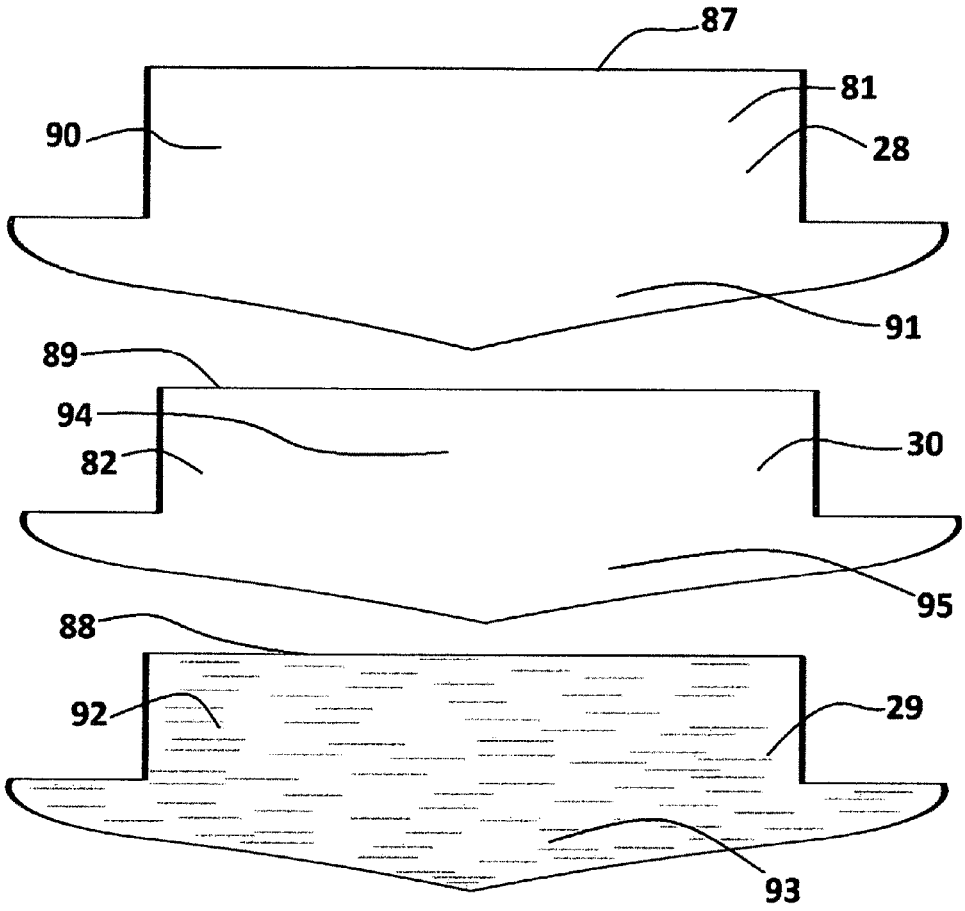
FIG. 35 is an exploded front perspective view of the three cut panels, useful in construction of the promotional pocket cover, according to the preferred embodiment of the present invention with pellon panel positioned below the back panel; and back panel positioned below the top panel.
Figure 36:
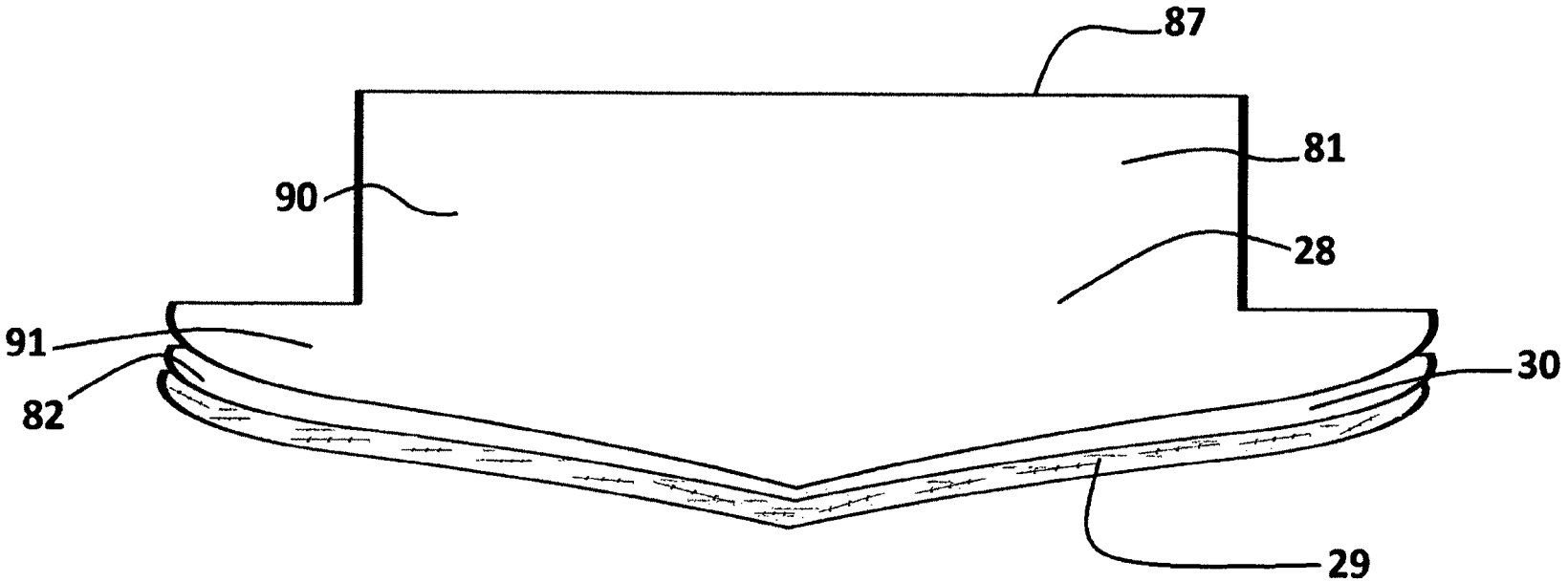
FIG. 36 is a front perspective view of the front of the three cut panels superimposed one upon the other; with the pellon panel positioned on the bottom, the back panel in the middle, and the top panel on top, in preparation of construction of the promotional pocket cover, according to the preferred embodiment of the present invention.

FIGS. 34, 35, and 36, illustrates the initial position of the three panels 28, 30, and 29, according to the preferred method of construction of the promotional pocket covers 10. Initially, as shown in FIGS. 34 and 35, the pellon panel 29 may be placed on a working surface (not shown) where the pellon panel 29 is positioned below the reverse side 83 of the back panel 30; the back panel 30 is positioned obverse side 82 up above the pellon panel 29; and the top panel 28 is positioned obverse side 82 down above the back panel 30 so that the obverse side 80 of the top panel 28 is facing the obverse side 82 of the back panel 30; and thereby the reverse side 81 of the top panel 28 is facing up towards the viewer, and forming initial placement of the three layers of panels 28, 30, and 29 according to the preferred embodiment of construction of the present invention, and described in detail, herein.

Thereafter, referring to FIG. 36 the back panel 30 is superimposed upon the pellon panel 29, and the top panel 28 is superimposed upon the back panel 30; and the three panels 28, 30, and 29 are aligned with each other such that the peripheral edges of all three panels 28, 30, 29 are substantially equal; thereafter straight pins can be inserted temporarily around the peripheral borders of the three panels 28, 29, and 30 to retain alignment of the three panels, 28, 29, and 30, before hemming them together.

Figure 37:
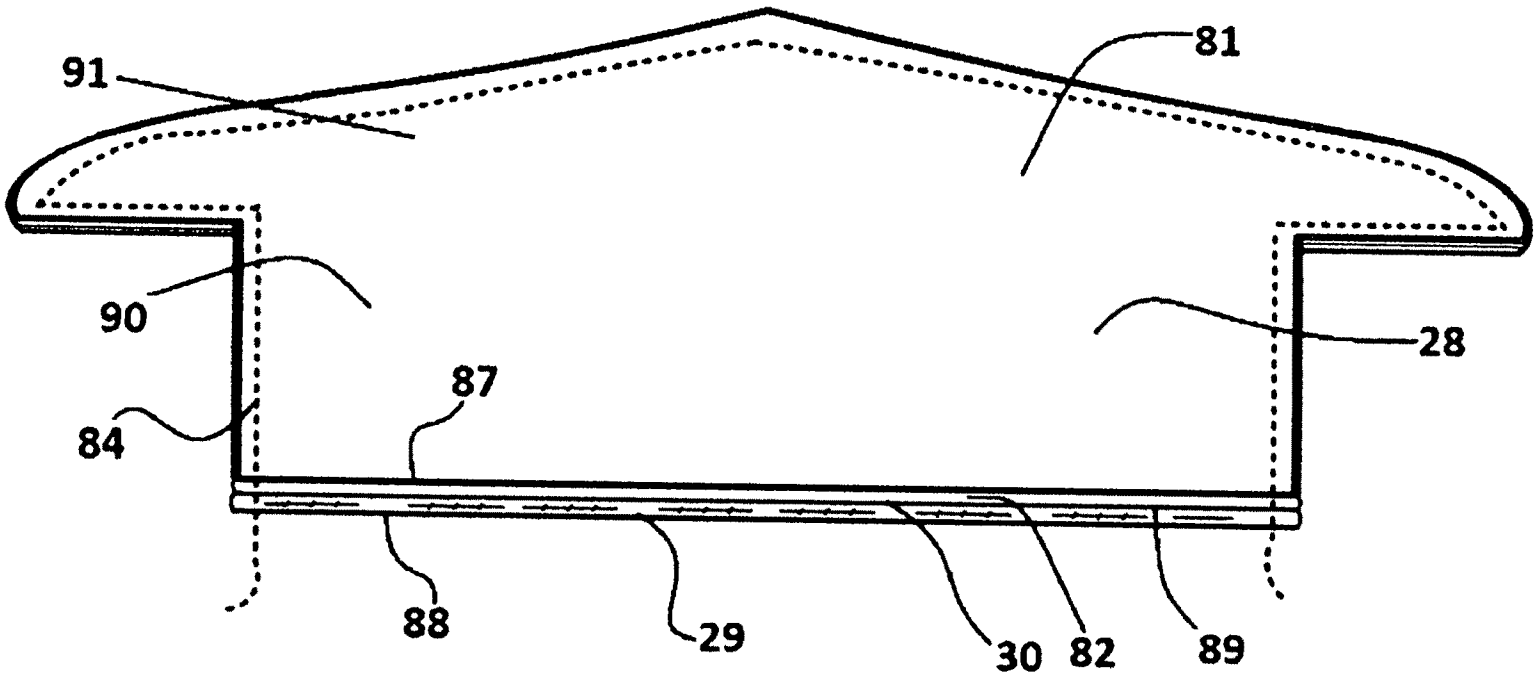
FIG. 37 is a rear perspective view of the three cut patterns affixed together during construction of the promotional pocket cover, according to the preferred embodiment of the present invention with the pellon panel positioned on the bottom, and back panel in the middle and top panel on top.

Thereafter, the pellon panel 29, the back panel 30, and the top panel 28 are affixed to each other by stitching, as shown in FIG. 37 leaving the top panel 28 longitudinal linear edge 87; and pellon panel 29 longitudinal linear edge 88; and back panel 30 longitudinal linear edge 89 unaffixed and open. The three panels 28, 30, and 29 which will form the promotional pocket cover 10 are sewn together along the marginal peripheral edges 23 of the arrow shaped panels creating a narrow stitched hem 84 of approximately 0.30 cm to 1.00 cm in from the marginal edges of the three panels 28, 30, and 29. A conventional sewing machine (not shown) may be used or an industrial sewing machine may be used, or a computerized sewing machine may be used to sew the three panels 28, 29, and 30 together. As shown in FIG. 37 the top panel 28, the back panel 30, and the pellon panel 29, are sewn together along the marginal edges 23, with the horizontal longitudinal lower straight edges 87, 88, and 89 of all three panels 28, 29, and 30 not sewn together, and therefore remain open at this step. The three panels 28, 29, and 30, are affixed together, preferably sewn together using a conventional sewing machine, and to which a narrow hem of approximately 0.3 cm-1.00 cm is sewn along the border of the three panels 28, 29, and 30, and leaving the longitudinal lower straight edges 87, 88, and 89 of the insert module 12 open to allow for the folding of the panels inside-out. Trim the corners and edges without crossing over the stitches before folding the three panels 28, 29, and 30 inside-out.

Figure 38:
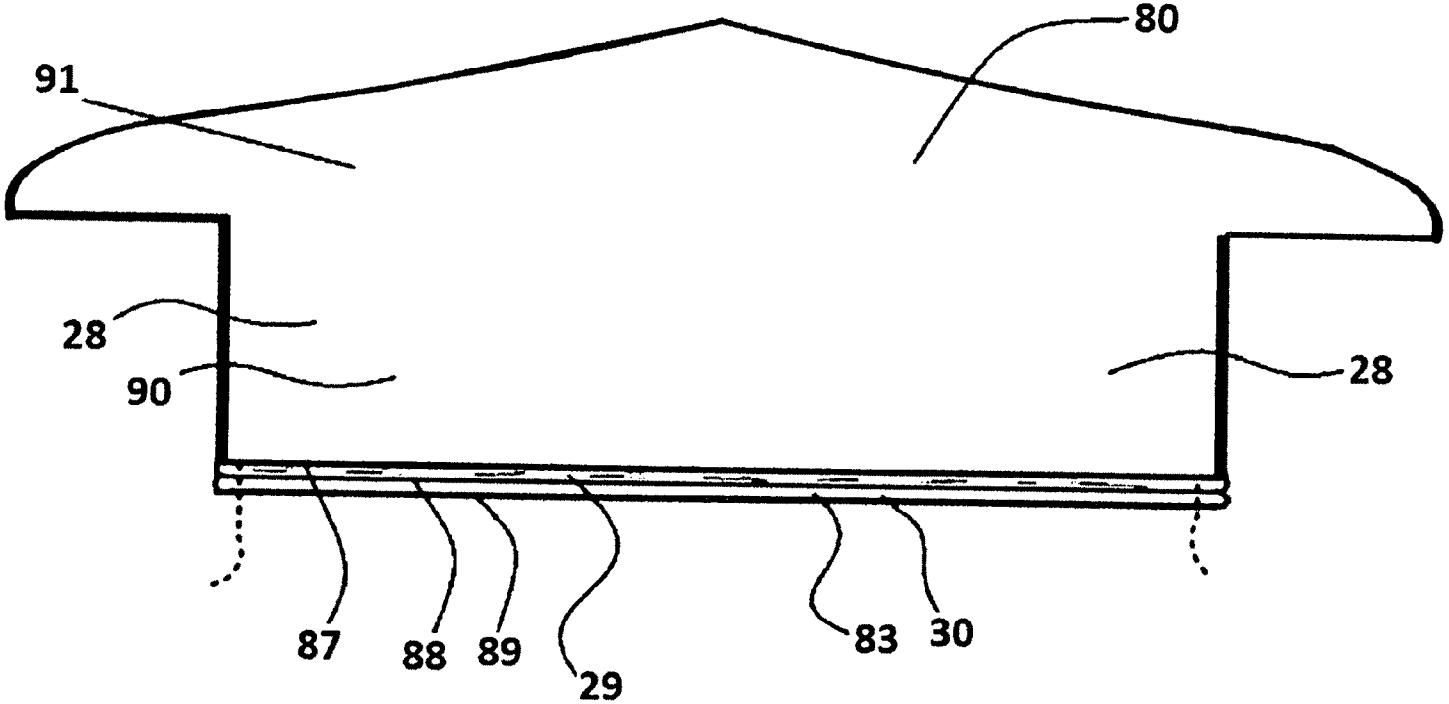
FIG. 38 is a rear perspective view of the three cut patterns affixed together after the patterns as illustrated in FIG. 23 have been turned inside out showing the pellon panel positioned in the middle during construction of the promotional pocket cover.

As mentioned, and as shown in FIG. 37, the pellon panel 29 is initially positioned below the back panel 30; and the back panel 30 is positioned below the top panel 28; and the obverse side of the back panel 82 and the obverse side 80 of the top panel 28 are facing each other so that outward folding of the back panel 30 held temporarily together with the pellon panel 29 along with the contemporaneous outward folding of the top panel 28 orients said pellon panel 29 in the middle sandwiched between the top panel 28 and the back panel 30. With this configuration, the apex 20, which is presently located interiorly, is turned 180° and pulled through the inside of the promotional pocket cover 10 across the open longitudinal straight edges at 87, 88, and 89; and apex 20 traveling between the top panel 28 and the back panel 30; and with the pellon panel 29 travelling together and congruent with the back panel 30 is folded inside-out; and the top panel 28 is folded inside-out. Again, as mentioned, this step orients the pellon panel 29 in the middle sandwiched between the top panel 28 and the back panel 30, as illustrated in FIG. 38. Furthermore, upon completion of turning the inside apex 20 180° and pulling through the inside of the decorative cover 10 and across open longitudinal straight edges 87, 88, and 89; and turning the three panels 28, 29 and 30 inside-out, as described above, orients the top panel 28 with its obverse side 80 revealed, and orients the back panel 30 with its obverse side 82 revealed. Preferably, turning the panels 28, 29, and 30 in-side out orients the obverse surface 80 of the top panel 28 of the promotional pocket cover 10 such that the wearer selected grain, pattern, color, design, of the top panel 28 material is revealed; and orients the obverse surface 82 of the back panel 30 of the promotional pocket cover 10 such that the preferred grain, pattern, color, design, of the material of the back panel 30 is revealed. Further, as shown in FIG. 38 this configuration of folding, orients the back panel 30 and top panel 28 sufficiently to conceal the sewn hem 84, and to conceal the pellon panel 29; and to reveal the obverse surface 80 of what will become the insert module 12 of the promotional pocket cover 10; and reveal the obverse surface 80 of what will become the cover module 11. The contouring of the interior peripheral edges of the sewn panels 28, 29, and 30 is assisted utilizing a dowel stick (not shown). Again the dowel stick is used to contour the hemmed edges sufficiently to retain the original arrow shape of the promotional pocket cover 10. The dowel is used to assist in configuring the generally arrow shape novel to the promotional pocket cover 10 and contouring the generally triangular cover module 11 and the generally rectangular insert module 12. As a result of turning the three panels 28, 29, and 30 inside-out and contouring the newly formed promotional pocket cover 10; the promotional pocket cover 10 is approximately 0.03 cm-1.00 cm less than the dimensions of the chosen pattern 60, for example, toddler pattern 74, pre-kindergarten pattern 75, small pattern 76, medium pattern 77, or large pattern 78, used to construct the promotional pocket cover 10.

Figure 39A:
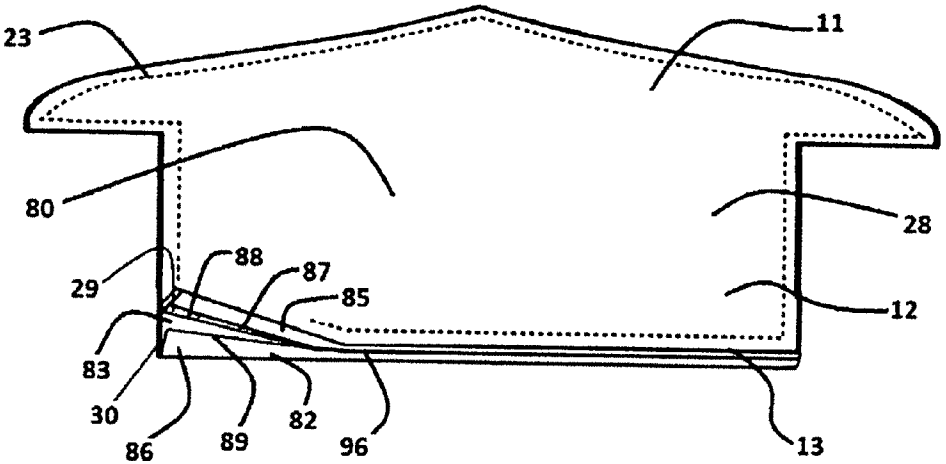
FIG. 39A is a rear perspective view of the three cut patterns as illustrated in FIG. 38 during construction of the promotional pocket cover; showing marginal stitches along the borders; and illustrating formation of hem at articulation line.
Figure 39B:
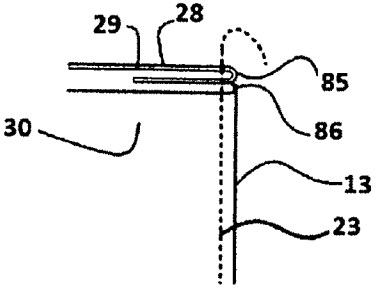
FIG. 39B is a rear perspective view of a vertical cut out of the right corner of the formation of the hem.
Figure 40:
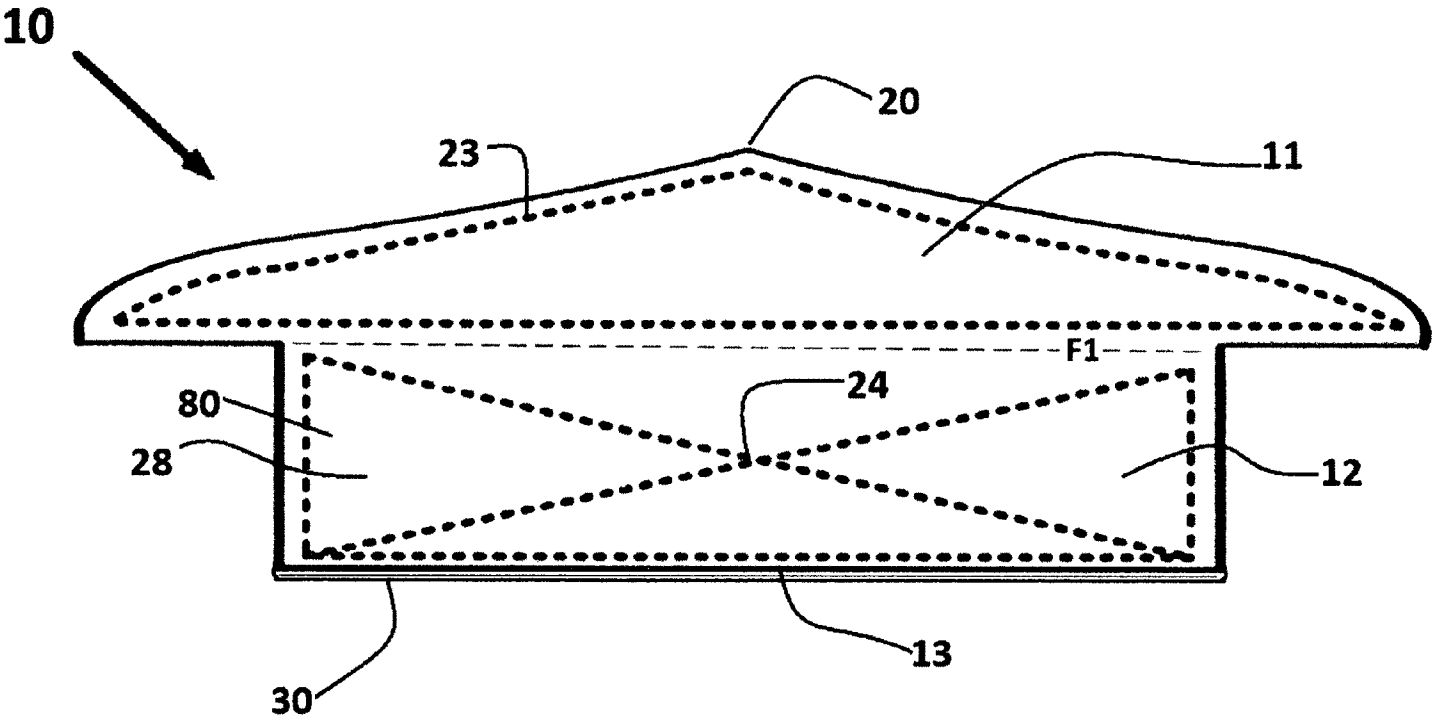
FIG. 40 is a rear perspective view of the promotional pocket cover showing completion of surface stitching along the marginal edges and within the insert module forming an "X" therein.

Thereafter, as illustrated in FIGS. 39A and 39B the open longitudinal linear edges 87, 88, and 89 of the three panels 28, 29, and 30 are hemmed and stitched closed forming the longitudinal horizontal lower linear edge 13 of the formed promotional pocket cover 10. The process of hemming the longitudinal straight edges 87 includes folding the top panel 28 together with the pellon panel 29 longitudinal straight edges 87 inwardly to form a top straight hem 85 approximately 0.03 cm-1.00 cm; and the back panel 30 is folded inwardly to form a linear straight hem 86 approximately 0.03 cm-1.00 cm; and concealing the cut edges within, and pressing the folded edges down making a smooth secured straight edge forming the longitudinal horizontal lower linear edge 13 of the promotional pocket cover 10. Secure with straight pins, or the like, to prepare for sewing it closed, along the articulation line 96. Affixing the longitudinal linear edge of the promotional pocket cover 10 and sewing the edges of the promotional pocket cover 10 along the line of articulation 96. Reinforcing the edges by stitching a marginal edge 23 along the marginal perimeter of the promotional pocket cover 10 with selected thread a distance 0.03 cm to 1 cm, but not limited to, in from the perimeter's edge using stitches as shown in FIG. 40, and with reference to FIGS. 1, 2, 3, and 4 to 17, according to the preferred embodiment of the present invention. Stitches are sewn within the insert module 12 of the promotional pocket cover 10 marking an "X" 24 to reinforce the attachment of the three panels 28, 29, and 30 and to retain the position and shape of the pellon panel 29 sandwiched therebetween the top panel 28 and the back panel 30. The marginal stitching 23 provides a narrow decorative border to be sewn along the edges of the promotional pocket cover 10, as does the configuration of an "X" 24 within the insert module 12 of the promotional pocket cover 10. In addition, the stitching provides additional reinforcement to the structure and form of the promotional pocket cover 10 to supplement its durability during use. More particularly, the stitched marginal edges 23 can be sewn with a wearer-selected thread from a variety of colors and textures that are different from the promotional pocket cover 10 material, and thereby provide an additional enhancement to the promotional pocket cover 10. More particularly, the stitched marginal edges 23 can be sewn with a wearer-selected thread of a color, texture, including indicia identifiably with a known sports team, charitable organization, non-profit organization, or for-profit organization, or any specific cause, and therefore provides additional promotional enhancement to the promotional pocket cover 10. FIG. 40 and referring back to FIGS. 1 and 2 illustrates the promotional pocket cover 10 with the obverse side 80 facing up, which illustrates the pattern of stitching and contouring of stitching along the edges of the single body of the promotional pocket cover 10. The back side of the promotional pocket cover 10 with the obverse side of the back panel 30 facing up is illustrated in FIG. 3.

Use the fold line F1, defined by phantom line F1 at the base of the cover module 11, as the point at which to fold the cover module 11 downward such that the apex 20 is pointing downward, and the cover module 11 is covering a substantial portion of the ventral side 48 of the insert module 12. With a heated iron, press the cover module 11 of the promotional pocket cover 10 against the insert module 12 of the promotional pocket cover 10. Referring back to FIGS. 5A and 6A shows the promotional pocket cover 10 in a folded state from a front planar view; and FIGS. 5B and 6B shows the folded promotional pocket cover 10 from a rear perspective view.

The cover module 11 of the formed promotional pocket cover 10 is now ready to receive the logo, indicia, embellishments, ribbon, decoration, promotional image, publicity image, or message, or promotional adornment 40 desired or needed by the user. The cover module 11 provides a surface area to enable the display of promotional adornments 40 as illustrated in FIGS. 7A, 7B, 8A, 8B, 9, 10, 11, 12A, 12B, 13A, 13B, 14A, 14B, 15A, 15A, 16A, and 16B. Each, individual indicia, logo, indicia, sports team mascots, ribbons, button, threads, names, marks, inspirational or motivation slogan, studs, grommet, symbols, names, pictures, colors, or any decoration, is of a size and flexibility that permits it to be affixed wherein to the obverse side of the promotional pocket cover 10 such that the particular indicium, logo, or color, ribbon, button, mascot, or inspirational or motivational slogan, and the like, etc. is displayed for viewers and observers to see.

Method of affixation of promotional adornments 40 can be affixed by heat transfer printing, other methods used may include, heat press, digital imaging, embroidery, silk screen, sewing, puff paint, gluing, pinning, hook and loop components 56, computerized printing of images on fabric, or fabric graphics.

The promotional pocket cover, in another embodiment may be used to affix a decorative adornment. For example, FIG. 41 shows a pair of promotional pocket covers 10 with rhinestones 55 affixed to the cover module 11 which may be used for promotional, or non-promotional reasons, and, therefore, the promotional pocket covers 10 provide an enhancement to a pair of jeans 26.

Figure 42:
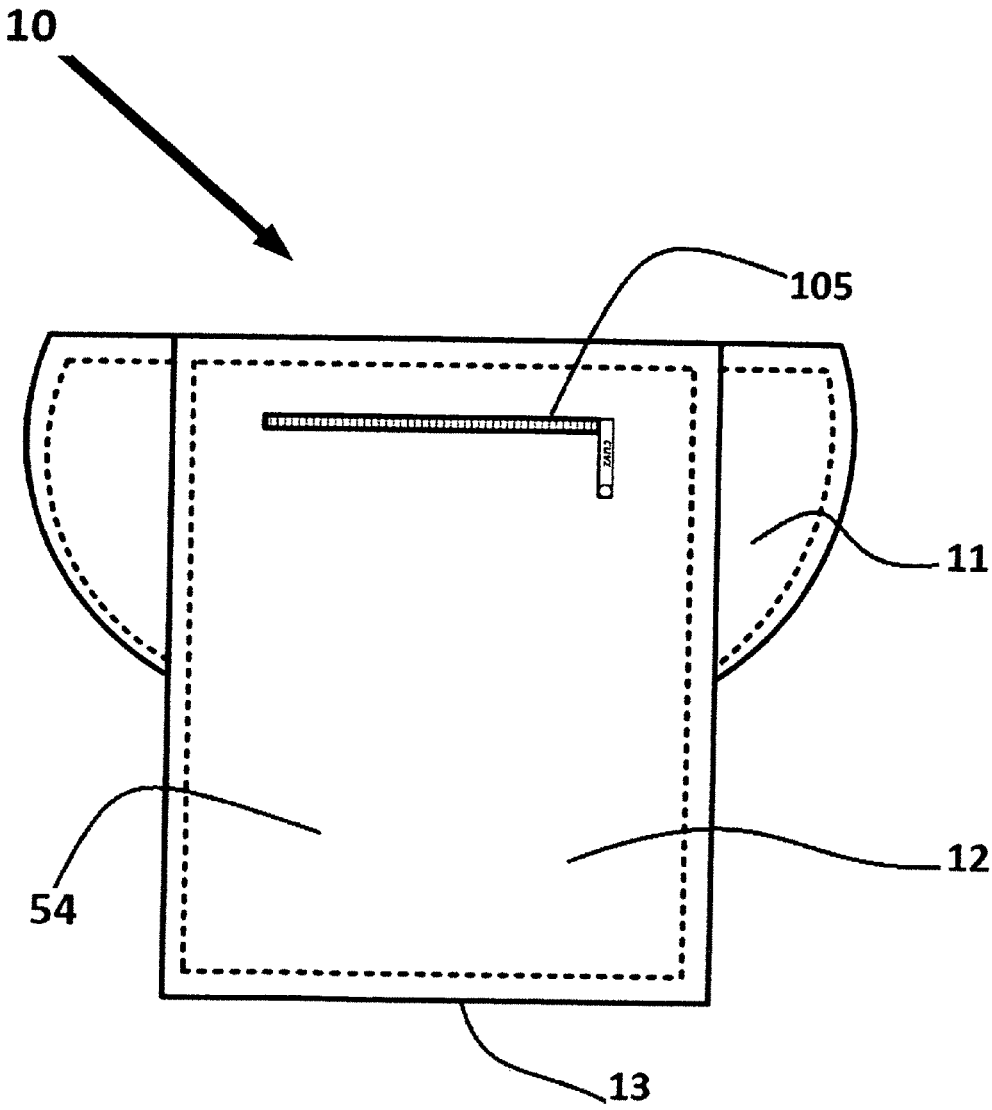
FIG. 42 is a planar rear view of another embodiment of the promotional pocket cover showing a zipper with a hidden pocket.
Figure 43:
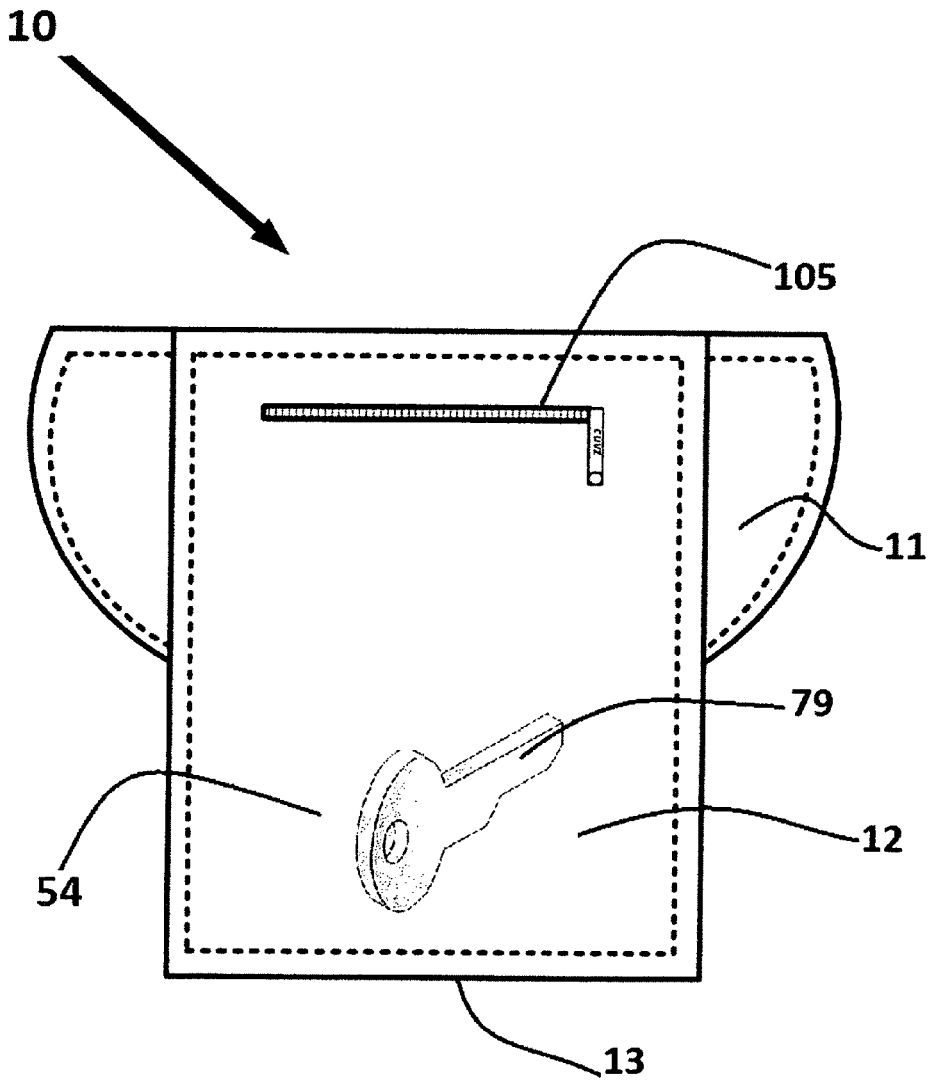
FIG. 43 is a planar rear view of another embodiment of the promotional pocket cover showing a zipper and hidden pocket with a key therein.

In another embodiment, of the present invention, the promotional pocket cover 10 may be constructed without the reinforced stitched "X" 24, as illustrated in FIGS. 42 and 43, sewn within the insert module 12, as illustrated in the preferred embodiment of the present invention, with reference to FIGS. 1, 2, 3, 4, and 40. With this modified configuration, as illustrated in FIGS. 42 and 43, the three panels within the insert module are unobstructed interiorly and provide a cavity for a hidden pocket 54 which may be secured by a zipper 105. In addition, the hidden pocket 54 may serve as a receptacle for small personal items, for example, a key 79, as illustrated in FIG. 43. Other small personal items may include, lipstick, ChapStick®, credit card, identification card, driver's license, money, jewelry, phone, transit pass, tickets, and the like.

In addition, preferably a tack pin, 23 is removably attached to the cover module 11 proximate to the apex 20, but not exclusive to, as described above, which provides an attachment means to removably attach the promotional pocket cover 10 to a pre-existing jean pocket 25 face panel 38.

The promotional pocket cover 10 may be manufactured from material, fabric, or any other material capable of retaining a decoration, as mentioned above, and preferably is washable. Thus, a promotional pocket cover 10 is utilized as an article of manufacture as a means to prominently display a variety of promotional adornments removably attached with a jean pocket 25 face panel 38 and interchangeable between the same jeans 26 or among several pairs of jeans 26 and does not comprise the jeans 26, therefore, maintaining the original integrity of the jeans 26 and overcoming the burden of acquiring a variety of jeans which display a logo or promotional adornment 40 of an individual's favorite sport, or sports athlete, or charitable organization, or non-profit, or for-profit organization, or any specific cause.

The cover module 11 may also have three-dimensional structure (for example, a three-dimensional seal or medallion). The promotional pocket cover 10 may also comprise an active display device such as graphics display device or digital picture frame, or other incorporated moving or changing elements. All three panels 28, 29, and 30 may be formed from wearer-selectable material; selected by the person(s) or manufacturer(s) manufacturing the decorative pocket panel 10.

While there has been shown but one-preferred embodiment of this invention, it should be understood that many alterations and modification of this invention may be made without departing from the spirit and scope of the present invention. In the preferred embodiment, the promotional pocket covers 10 are comprised of a material, preferably a fabric, or any fabric, cloth, broad cloth, and any natural or synthetic cloth. However, in another embodiment of the present invention, the promotional pocket cover, or any part wherein, may be comprised of foam, plastic, leather, rubber, polyurethane, sponge, silicone, and/or the like, or any material capable of being inserted into a pouch or cavity of a pocket and/or retaining a logo, indicia, decoration, or promotional adornment 40, and capable of being folded.

In addition, in another embodiment of the present invention, the size of the promotional pocket cover 10 is limited only by the practical constraints of the size of the receiving receptacle or cavity to which it is to be inserted. A wearer will most likely choose a promotional pocket cover 10 amenable with the cavity size, in some embodiments as large as will conveniently fit, but such is not a requirement. It can be dimensioned much smaller for smaller pouch or cavity pockets, for example a jacket pocket or blouse or shirt pocket, or for children, or for pets. Similarly, the promotional pocket cover 10 may vary in the configuration of the cover module 11, where the shape can have contoured sides, tapered, curved, or corrugated surfaces and edges.

In addition, the insert module 12 of the promotional pocket cover 10 is not limited by its configuration or necessarily need to be inserted within a cavity 31 of a jean pocket 25 to anchor the promotional pocket cover 10. For example, the cover module 11 can be removably affixed to any flat panel which can support the promotional pocket cover 10. Moreover, the insert module 12 of the present invention may more generally be referred to as a mounting device, which may be an anchoring device, or silicone material, or some other form of stabilizing device, whereby the removable promotional pocket cover 10 may be suspended from, or placed on, a supporting display element such as a display board, a picture, a plaque, a table name card, or table promotional adornment, or charm, or earrings, and/or the like.

It should be understood that the present invention may be constructed using a variety of materials, fabrics, cloths, nylons, leathers, vinyl, silicon, physical shapes, and sizes, and decorations, and indicia and may vary such that various colors, and designs, and indicia, and words, or absence of words, ranges of angles, and ranges of curves, may vary in accordance with the needs and desires of the user, and still remain within the spirit and scope of this invention and thereby enabling a variety of different themes, styles, looks, and shapes to the promotional pocket covers 10.

In addition, it is possible that the shape or configuration of the cover module 11 of the promotional pocket cover 10 may be other than generally triangular in shape. A particular example, may be a cover that is generally circular in shape, or rectangular in shape, or contoured with a configuration of a promotional adornment, particular indicia, symbol, colors of a flag of a country, or personal initials, and the like, or indicia that is associated with a particular cause, sport team, charitable organization or non-profit organization, sport team, basketball, soccer ball, football, or any image needed or desired by the wearer, that may expand the scope of this invention, which remain true to the spirit of the present invention as described. Other examples of specific configurations of the promotional pocket cover 10 may include a recognizable shape or material, of a building or a bridge that is associated with a particular city, for example, the Space Needle in Seattle, Wash., or the Brooklyn Bridge in New York, or the White House in Washington, D.C.

Method of Fund Raising Using the Promotional Pocket Cover 10

The present invention seeks to provide a method for raising money for a specific cause or campaign, charitable cause, non-profit organization, for-profit organization, publicity event, or any specific cause, by providing promotional pocket covers 10, such as with a sport team logo, or with a ribbon, or names, or images, or indicia, or any promotional adornments, affixed thereon, in return for a donation of money for the selected specific cause, or for money given to raise revenue for profit. In each such transaction, each promotional pocket cover 10 has had affixed thereon a specific logo, indicium, or inspirational or motivational slogan, publicity indicia, or any specific promotional adornment which readily identifies the selected sports booster, charitable cause, or non-profit organization, or fund raiser for a specific family in need, or publicity event, or any specific cause being supported in that specific fund raising campaign. A method of raising money in any one fundraiser for a specific charitable cause or non-profit organization, or for-profit organization, or sports booster program, or music program, or any specific cause where the charitable cause or non-profit organization, or sports booster program, or any specific cause has a readily identifiable or indicium, or promotional adornment 40 associated with it; or a promotional adornment 40 created for that specific cause by which it is readily identified, said method comprising the steps of:

(a) Obtaining a plurality of promotional pocket covers 10 including a cover module 11 and an insert module 12, and an attaching means, so as to enable each promotional pocket cover 10 to be removably attached to a pre-existing pair of jeans having at least one jean pocket 25 having a face panel 38, a top longitudinal straight edge 27 and a cavity 31;

(b) Obtaining a plurality of removably attaching means, preferably a tack pin 41 for removably attaching the promotional pocket cover 10 to the pre-existing jean pocket 25; and (c) obtaining a plurality of removably attaching means, such as hook and loop fastener components 56 to removably attach the promotional pocket cover 10, if used by a child; and (d) obtaining a plurality of specific logos, indicia, or promotional adornments 40 for the selected specific charitable cause or non-profit organization, or sports booster program, or music program, or publicity event, or any selected specific cause, where each individual promotional adornment 40 for that specific cause is of a size and resiliency so as to permit it to be affixed upon the cover module 11 of the promotional pocket cover 10 whereby it can be displayed for a viewer to easily recognize as being the promotional adornment 40 associated with that selected specific cause on whose behalf the fundraising event is being conducted;

(e) affixing the promotional adornment 40 for the selected specific cause upon the obverse side 97 of the cover module 11 of the promotional pocket cover 10; and (f) giving each selected promotional pocket cover 10 with the promotional adornment 40 affixed thereon to a donor or participant in consideration and exchange for a donation in the form of money, check, or service, or for a pledge of money or service; and (g) contributing a predetermined percentage of the money raised from the donations made in exchange of the promotional pocket covers 10 with donors and participants, to the specific charitable cause or non-profit organization, or sports booster program, or for the selected specific cause for whom the fundraising event was conducted; and (h) retaining a predetermined percentage of the money raised from the donations made by donors and paying the host fee, sponsor, venue, individual who made the promotional pocket covers 10, or manufacturer of the promotional pocket covers 10.

In view of the foregoing description, it will be understood that the present invention comprises a promotional pocket cover 10, method of construction, and use, which espouses numerous advantages over the prior art. One important advantage includes the unique single body unit configuration comprising the cover module 11 continuously and seamlessly connected to the insert module 12, instead of two or more independent units or members. Furthermore, the promotional pocket cover is removably attached to the preexisting jean pocket 25, preferably, by a single tack pin 41, and preferably by hook and loop fastener component 56 for children using the promotional pocket cover 10; and does not require magnets, adhesives, or glue, or wires, to affix the promotional pocket cover 10 to the jean pocket 25 which provide less secure attachment and contribute to wear and damage of pocket covers or garments. Another advantage, the promotional pocket cover 10 is washable and can be easily removed from the jean pocket 25 and washed separately from the pair of jeans 26. The promotional pocket cover 10, according to the preferred embodiment of the present invention, does not include magnets, which may interfere with a user's cell phone, or credit card, or hotel key card, and can pose a risk of swallowing among children. These tack pins 41 used in the present invention as an attachment means are non- pulling to the promotional pocket cover 10 or to the jean pocket 25, as well, and provide a secure removable attaching means therebetween. In addition, the tack pin 41 can include the logo of the inventor or the manufacturer or the wearer.

In an exemplary embodiment, a pair of promotional pocket covers 10 may be used by a wearer where each promotional pocket flap 10 is complementary to each other and transposable. In another embodiment, the promotional pocket cover 10 can be reversible.

The present invention creates a promotional pocket cover 10 used with a preexisting jean pocket 25 where a flap may not exist. Further, the promotional pocket cover 10 creates promotional pocket covers 10 on any jean pocket, garment pockets, shirt pockets, pant garments, jacket pockets, gymnastic bags, pocket books; computer bags, golf bags, baby bags, pet carriers, pet garments, or on any garment or apparel which includes a pocket or slit with a cavity and pocket face panel with a top edge.

The promotional pocket cover 10, as described above, can be designed with a plurality of fabrics having a vast array of prints, designs, logos, images, or other promotional adornments 40, and virtually any other adornment that can fit within the surface area of the cover module. This provides infinitely greater variability over a traditional promotional garment by creating a multitude of personalized promotional pocket covers 10 displaying a wearer's favorite sports team, or special cause, or supporting a fallen hero, or natural disaster, and/or the like, as mentioned above. The user can change the promotional pocket covers 10 used on the jean pockets 25 as needed or desired. For example, the wearer may use a pair of promotional pocket covers 10 removably attached to a pair of jean pockets 25 where the promotional pocket covers 10 include his/her favorite sports team logo affixed thereon, and including the favorite sports team colors. The wearer may instantaneously and easily remove the sporty promotional pocket covers 10 and removably attach a pair of promotional pocket covers 10 including a pink ribbon 53 identified with breast cancer, if the wearer needs to attend a cancer fund raising event or campaign, and wishes to wear the same pair of jeans 26. Therefore, the wearer can change the theme and appearance of the jeans 26 without the expense of purchasing another pair of jeans. The wearer can promote and raise recognition, awareness, support, loyalty, passion, spirit, and dedication for a particular cause, charitable organization, or non-profit organization, or for-profit organization, or sports team, or sports league, or amateur sports team, or sports affiliation, NASCAR®, or medical needs group, or commercial entity, or a special needs group, or foundation, or military organization, or commercial entity, or product, or public figure, publicity event, or personal figure, or a media event, or public event, or personal event, special event, personal loss, animals, holidays, a college, a university, a high school, an automobile racing series, and an automobile racing team, churches, clubs, companies, departments, political parties, candidates, and issues, interest groups and causes, t.v. show, movie, movie characters, super-hero, animated character, and the like, through a specific logo, or mark, or indicium, or inspirational or motivational slogan, or ribbon, or button, or mascot, or team logo, or team colors, or image, or names, or letters, initials, monogram, moniker, coat-of-arms, family crest, numbers, or symbols, or dates, or embroidery, or decorations, or promotional images, or inspirational messages, or special timely messages, or embellishments, or other adornments associated with the specific cause and which are affixed and displayed on the cover module 11 of the promotional pocket covers 10. Moreover, the promotional pocket covers 10, of the present invention, are easily transposed and interchangeable with each other, and can be easily transferred among pockets 25 of the same pair of jeans 26, or transferred to pockets 25 of other pairs of jeans 25, or garments, or apparel.

The promotional pocket cover 10, having a hidden pocket 54, in another embodiment, provides the user with a hidden pocket to store a key 79, money, credit card or small personal item which one desires or needs to store separately from a larger pocket book or carry all bag, or wallet.

The promotional pocket cover 10 can be used as part of a uniform for a military organization to display medals or seniority. In addition, the promotional pocket cover 10 can be used as part of a uniform for a hospital, food vendor, movie studio, club, t.v. set, or any type of business, where the cover module can display the company logo or product, and the like. The promotional pocket cover 10 offers users unlimited original personalized and promotional displays for use with one pair of jeans 26 without altering the jean garment 26.

The present invention will enhance the user's wardrobe where the user can select a promotional pocket cover 10 with a promotional adornment 40 suitable for day-wear and easily remove the promotional pocket cover 10 and replace it with one which would be more glamorous for night-wear, for example, if the user were to go to a club, the user may choose a promotional pocket cover 10 with ILLUMINATE® or one with rhinestone studs 55. In addition, a promotional pocket cover 10 to be worn for the day-shift or a promotional pocket cover 10 to be worn for the night shift can be envisioned.

The promotional pocket cover 10 can also be used as a stand-alone promotional pocket cover 10 which can be used to removably attach to luggage or a computer bag as an identification tag that is readily identifiable, and which also can display a promotional adornment 40. In addition, the promotional pocket cover 10, used as a stand-alone can be used as a promotional article for a fund raiser where the contributor's name is engraved on the cover module 11 together with specific logo, or ribbon, or promotional adornment 40 readily identified with that specific cause. In addition, the promotional pocket cover 10 may provide a name tag promotional pocket cover 10, or a table place card promotional pocket cover 10, which can be placed on a fund raiser's table to identify where participants should sit, or to be used as a paddle if attending an auction.

Miniature promotional pocket covers 10 can be envisioned and embodied which would provide a promotional accessory, such as, an earring, or a charm for a necklace or bracelet.

In sum, the promotional pocket cover 10 is easy, inexpensive, convenient, and fun to use to display promotional adornments 40, enhancing one's jean pockets 25 of persons of all ages and sizes.

Other advantages from the use of the invention will readily suggest themselves to those skilled in the art. It is evident to the reader the many embodiments the present invention contains yet assuredly the scope of this invention is far more expansive.

Although particular embodiments of the invention have been illustrated in the accompanying Drawings and described in the foregoing Detailed Description, it will be understood that the present application is not limited to the embodiments disclosed but is intended to embrace any alternatives, modifications, rearrangements and substitutions of parts and/or units as fall within the spirit and scope of the invention. Consequentially, the true essence or scope of this invention should be determined by the claims which follow and their legal equivalents.

We claim:

1. A removably attachable promotional pocket cover, comprising:

a single body unit generally in the shape of an arrow including an insert module and a cover module seamlessly connected thereto;

said single body unit removably attached to a preexisting garment pocket;

said insert module generally rectangular in shape having a longitudinal horizontal lower linear edge of a predetermined width joined by two opposing vertical parallel linear side edges of a predetermined length;

wherein said two vertical side edges delineating at said predetermined length at right angles in opposing directions for a predetermined width parallel to said horizontal lower linear edge form two exterior opposing right angles forming two opposing longitudinal basal linear edges of the cover module;

said cover module generally triangular in shape having two opposing curvilinear sides meeting at an obtuse angle forming an upper apex;

said cover module includes a surface area to affix promotional adornments thereon;

said arrow shaped pocket cover formed of three panel layers of material including a top panel layer, a middle panel layer and a bottom panel layer of wearer selected materials;

wherein said top panel and said bottom panel layers are of decorative complimentary materials, and said middle layer is of a stiffening material;

said three panel layers are superimposed upon each other wherein said top layer lies outwardly thereon the pocket cover; and said three panels are sewn along the curvilinear and linear marginal edges and closed along the margin of the longitudinal horizontal lower linear edges.

2. The removably attachable promotional pocket cover according to claim 1 wherein said cover module is generally triangular in shape with a wider base than said width of the insert module; and wherein said insert module has a rectangular shape that has a length equal to or longer than said cover module length.

3. The removably attachable promotional pocket cover as claimed in claim 1 wherein the cover module includes contoured side edges of any curvilinear shape.

4. The removably attachable promotional pocket cover according to claim 1 wherein the cover module is configured of predetermined dimensions to cover a top portion of a face of the preexisting garment pocket of which it is placed thereon.

5. The removably attachable promotional pocket cover according to claim 1 wherein the insert module is configured of predetermined dimensions less than dimensions of the preexisting garment pocket of which the insert module is placed therein for easy insertion and concealment therein.

6. The removably attachable promotional pocket cover according to claim 1 wherein the promotional adornment includes any type of printed matter of any one of logos, images, trademarks, tradenames or decorative embellishment including any one of colors, ink, paint, puff paint, sequins, leather, jewelry, precious metals, studs, embroidery, ribbons, buttons, or combinations thereof.

7. The removably attachable promotional pocket cover according to claim 1 wherein the material forming the top panel layer is of a foldable and supple material including any one of a plurality of natural or synthetic fabric materials.

8. The removably attachable promotional pocket cover according to claim 1 wherein the wearer selected material forming the top panel is manufactured from a material including any one of cotton, denim, colored denim, dungaree polyester, linen, leather, corduroy, vinyl, flannel, seersucker, spandex, satine, silk, satin, velvet, felt, velveteen, faux fur, wool, wool blends, rayon, viscose, nylon, bamboo, cashmere or combinations thereof.

9. The removably attached promotional pocket cover according to claim 1 wherein the wearer selected material forming the top panel includes any promotional adornment woven therein as being of specific promotional color, promotional print, or promotional design with a logo thereon.

10. The removably attachable promotional pocket cover according to claim 1 wherein the material forming the middle panel layer is comprised of pellon material to provide a supporting means.

11. The removably attachable promotional pocket cover according to claim 10 wherein the material forming the middle panel pellon is substituted with any one of silicone, silicone resins, foam rubber, polyurethane foam or sponge supportive material.

12. The removably attachable promotional pocket cover according to claim 1 wherein the sewn marginal edges are formed with thread including any one of colors, sparkles, textures, variegated , stripes, or combination thereof.

13. The removably attachable promotional pocket cover according to claim 1 wherein sewn stiches along the marginal edges are varied with any one of wide stitches, broken line stitches, zigzag stitches, and contoured stitches.

14. The removably attachable promotional pocket cover according to claim 1 comprising a promotional pocket cover which is reversible.

15. The removably attachable promotional pocket cover according to claim 1 wherein the preexisting garment is a jean pant having at least one pocket having a face panel, upper top edge, and a cavity therein.

16. The removable promotional pocket cover according to claim 15 wherein the promotional pocket cover is easily interchangeable among a plurality of promotional pocket covers used with at least one preexisting jean pocket on the same pair of jeans eliminating the burden of purchasing additional jeans with different promotional adornments.

17. The removable promotional pocket cover according to claim 15 wherein the promotional pocket cover is easily interchangeable among a plurality of promotional pocket covers which are transferable among several preexisting jean pockets among several preexisting pairs of jeans.

18. The removably attachable promotional pocket cover according to claim 1 wherein the pocket cover is removably attached to a preexisting garment pocket by means of a tack pin including a pin element and a butterfly clutch.

19. The removably attachable promotional pocket cover according to claim 18 wherein the tack pin is wearer selectable from any one of wearer's logo, manufacturing logo, trademark, tradename, design or color as a decorative embellishment.

20. The removable promotional pocket cover according to claim 1 wherein the cover module is affixed with promotional adornments and provides a means to display wearer selectable promotional adornments affixed thereon.

21. The removably attachable promotional pocket cover according to claim 1 further comprising a pair of promotional pocket covers which are interchangeable and transposable with each other.

22. The promotional pocket cover according to claim 1 further comprising a hidden pocket on said promotional pocket cover to provide a holding means for any one of keys, money, credit card, or other small personal items.

23. The removably attachable promotional pocket cover according to claim 1 wherein the attachment means is a hook and loop fastener component having two corresponding attaching pieces, a first piece and second corresponding piece, wherein the first piece and second corresponding piece when pressed against each other become removably engaged.

24. A method of displaying the promotional pocket cover, in accordance with claim 23, on a preexisting garment pocket, the method comprising the following steps:

a) providing a pre- existing garment pocket having a face panel including a front side and a reverse side; a top edge; and a cavity as a receiving means;

b) providing a promotional pocket cover including an embellishment affixed thereon the cover module;

c) affixing the first hook and loop fastener component to the reverse side of the face panel and affixing the second hook and loop fastener to the bottom panel of the insert module wherein the first piece and second corresponding piece when pressed against each other become removably engaged;

d) inserting the insert module of the promotional pocket cover into the cavity of the garment pocket disposed such that the affixed second hook and loop fastener is aligned with affixed first hook and loop fastener;

e) engaging the two corresponding pieces of hook and loop fastener components; and f) folding the cover module over a garment pocket top edge orienting the apex of the cover module downward such that an affixed embellishment is displayed.

25. The promotional pocket cover according to claim 1 wherein the promotional pocket cover is in combination with a pants garment having a pocket wherein the pocket cover is temporarily attached and detached to the garment pocket.

* * * * *